US009523060B2

(12) United States Patent
Cholli et al.

(10) Patent No.: US 9,523,060 B2
(45) **Date of Patent: *Dec. 20, 2016**

(54) LUBRICANT OIL COMPOSITIONS

(71) Applicant: Polnox Corporation, Lowell, MA (US)

(72) Inventors: Ashok L. Cholli, Chelmsford, MA (US); Ashish Dhawan, Lowell, MA (US); Rajesh Kumar, Dracut, MA (US); Vijayendra Kumar, Dracut, MA (US); Suizhou Yang, Lowell, MA (US); Taizoon Canteenwala, Lowell, MA (US)

(73) Assignee: Polnox Corporation, Lowell, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/567,352

(22) Filed: Dec. 11, 2014

(65) Prior Publication Data

US 2015/0159109 A1 Jun. 11, 2015

Related U.S. Application Data

(63) Continuation of application No. 13/469,813, filed on May 11, 2012, now Pat. No. 8,927,472, which is a continuation of application No. 13/165,372, filed on Jun. 21, 2011, now abandoned, which is a continuation of application No. 11/606,785, filed on Nov. 30, 2006, now abandoned.

(60) Provisional application No. 60/742,150, filed on Dec. 2, 2005.

(51) Int. Cl.

| | |
|---|---|
| ***C10M 133/14*** | (2006.01) |
| ***C10M 129/00*** | (2006.01) |
| ***C10M 141/00*** | (2006.01) |
| ***C10M 157/00*** | (2006.01) |
| ***C10M 161/00*** | (2006.01) |
| ***C10M 133/04*** | (2006.01) |

(52) U.S. Cl.

CPC ..... *C10M 133/14* (2013.01); *C10M 133/04* (2013.01); *C10M 141/00* (2013.01); *C10M 157/00* (2013.01); *C10M 161/00* (2013.01); *C10M 2207/024* (2013.01); *C10M 2207/026* (2013.01); *C10M 2207/08* (2013.01); *C10M 2207/284* (2013.01); *C10M 2207/289* (2013.01); *C10M 2209/04* (2013.01); *C10M 2215/062* (2013.01); *C10M 2215/064* (2013.01); *C10M 2215/082* (2013.01); *C10M 2215/14* (2013.01); *C10M 2217/04* (2013.01); *C10M 2217/041* (2013.01); *C10M 2217/046* (2013.01); *C10M 2219/087* (2013.01); *C10M 2223/045* (2013.01); *C10M 2223/049* (2013.01); *C10N 2230/10* (2013.01); *C10N 2260/00* (2013.01)

(58) Field of Classification Search

CPC . C10M 133/04; C10M 133/14; C10M 141/00; C10M 157/00; C10M 161/00; C10M 2207/024; C10M 2207/026; C10M 2207/08; C10M 2207/284; C10M 2207/289; C10M 2209/04; C10M 2215/062; C10M 2215/064; C10M 2215/082; C10M 2215/14; C10M 2217/04; C10M 2217/041; C10M 2217/046; C10M 2219/087; C10M 2223/045; C10M 2223/049; C10N 2230/10; C10N 2260/00

USPC ..... 508/560

See application file for complete search history.

(56) References Cited

U.S. PATENT DOCUMENTS

| | | | |
|---|---|---|---|
| 3,116,305 | A | 12/1963 | Morris et al. |
| 3,294,836 | A | 12/1966 | Peterson et al. |
| 3,441,545 | A | 4/1969 | Blatz et al. |
| 3,459,704 | A | 8/1969 | Peterson et al. |
| 3,557,245 | A | 1/1971 | Phillips et al. |
| 3,632,785 | A | 1/1972 | Bornstein |
| 3,645,970 | A | 2/1972 | Kleiner |
| 3,649,667 | A | 3/1972 | Song et al. |
| 3,655,831 | A | 4/1972 | Friedman |
| 3,870,680 | A | 3/1975 | Schurdak |
| 3,907,939 | A | 9/1975 | Robin et al. |
| 3,953,402 | A | 4/1976 | Kline |
| 3,965,039 | A | 6/1976 | Chaplits et al. |
| 3,983,091 | A | 9/1976 | Gloth et al. |
| 3,994,828 | A | 11/1976 | Zaffaroni |
| 3,996,160 | A | 12/1976 | Dale et al. |
| 3,996,198 | A | 12/1976 | Wang et al. |
| 4,054,676 | A | 10/1977 | Weinshenker et al. |

(Continued)

FOREIGN PATENT DOCUMENTS

| | | |
|---|---|---|
| CS | 111291 | 6/1964 |
| DE | 197 47 644 A1 | 5/1999 |

(Continued)

OTHER PUBLICATIONS

Akkara, J.A., et al., "Hematin-Catalyzed Polymerization of Phenol Compounds," Macromolecules, *33*(7):2377-2382 (2000).

(Continued)

*Primary Examiner* — James Goloboy

(74) *Attorney, Agent, or Firm* — Hamilton, Brook, Smith & Reynolds, P.C.

(57) ABSTRACT

Compositions comprise first antioxidants and first additives, such as, a surface additives, performance enhancing additives and lubricant protective additives and optionally second additives and/or second antioxidants. The compositions are useful to improve lubricants, lubricant oils and other lubricant materials. The compositions and methods generally provide longer shelf lives, increased oxidative resistance, improved quality and/or enhanced performance to lubricants or lubricant oils.

12 Claims, No Drawings

(56) References Cited

U.S. PATENT DOCUMENTS 4,094,857 A 6/1978 Wolfe, Jr.
4,096,319 A 6/1978 Willette et al.
4,097,464 A 6/1978 Kline
4,098,829 A 7/1978 Weinshenker et al.
4,107,144 A 8/1978 Russell et al.
4,136,055 A 1/1979 Lyons
4,202,816 A 5/1980 Moser et al.
4,205,151 A 5/1980 Dale et al.
4,213,892 A 7/1980 Scott
4,219,453 A 8/1980 Sakurai et al.
4,267,358 A 5/1981 Hechenbleikner et al.
4,281,192 A 7/1981 Jacquet et al.
4,283,572 A 8/1981 Klicker
4,317,933 A 3/1982 Parker
4,341,879 A 7/1982 Sugio et al.
4,355,148 A 10/1982 Layer et al.
4,377,666 A 3/1983 Farrar
4,380,554 A 4/1983 Serres, Jr.
4,447,657 A 5/1984 Firth et al.
4,465,871 A 8/1984 Firth et al.
4,510,296 A 4/1985 Hergenrother
4,511,491 A 4/1985 Ishii et al.
4,634,728 A 1/1987 Dunski et al.
4,690,995 A 9/1987 Keskey et al.
4,761,247 A 8/1988 Rei et al.
4,824,929 A 4/1989 Arimatsu et al.
4,849,503 A 7/1989 Cotter et al.
4,855,345 A 8/1989 Rosenberger et al.
4,857,596 A 8/1989 MacLeay et al.
4,870,214 A 9/1989 Mina et al.
4,894,263 A 1/1990 Dubois et al.
4,897,438 A 1/1990 Kikuchi et al.
4,900,671 A 2/1990 Pokora et al.
4,925,591 A 5/1990 Nakauchi et al.
4,968,759 A 11/1990 Kikuchi et al.
4,977,004 A 12/1990 Bettle, III et al.
4,981,917 A 1/1991 MacLeay et al.
4,994,628 A 2/1991 Goddard et al.
5,013,470 A 5/1991 Benfaremo
5,017,727 A 5/1991 Olivier
5,082,358 A 1/1992 Tabata et al.
5,102,962 A 4/1992 Kikuchi et al.
5,117,063 A 5/1992 Stern et al.
5,143,828 A 9/1992 Akkara et al.
5,155,153 A 10/1992 Neri et al.
5,185,391 A 2/1993 Stokich, Jr.
5,185,407 A 2/1993 Wong
5,188,953 A 2/1993 Johnson et al.
5,191,008 A 3/1993 Frost et al.
5,196,142 A 3/1993 Mollet et al.
5,206,303 A 4/1993 Tse et al.
5,207,939 A * 5/1993 Farng et al. ..... 508/557
5,274,060 A 12/1993 Schadeli
5,278,055 A 1/1994 Cyrus, Jr. et al.
5,304,589 A 4/1994 Davidson et al.
5,320,889 A 6/1994 Bettle, III
5,449,715 A 9/1995 Plochocka et al.
5,498,809 A 3/1996 Emert et al.
RE35,247 E 5/1996 Cyrus, Jr. et al.
5,516,856 A 5/1996 Sanchez
5,541,091 A 7/1996 Wheeler et al.
5,565,300 A 10/1996 Uenishi et al.
5,574,118 A 11/1996 Olivier
5,652,201 A * 7/1997 Papay et al. ..... 508/228
5,739,341 A 4/1998 Dubs et al.
5,834,544 A 11/1998 Lin et al.
5,837,798 A 11/1998 Hutchings et al.
5,869,592 A 2/1999 Gagne et al.
5,911,937 A 6/1999 Hekal
5,994,498 A 11/1999 Tripathy et al.
6,018,018 A 1/2000 Samuelson et al.
6,046,263 A 4/2000 Rasberger et al.
6,096,695 A 8/2000 Lam et al.
6,096,859 A 8/2000 Akkara et al.
6,150,491 A 11/2000 Akkara
6,232,314 B1 5/2001 Jarrott et al.
6,342,549 B1 1/2002 Hirose et al.
6,444,450 B2 9/2002 Akkara et al.
6,646,035 B2 11/2003 Koch et al.
6,723,815 B2 4/2004 Callaghan et al.
6,743,525 B2 6/2004 Berntsen et al.
6,770,785 B1 8/2004 Desai et al.
6,794,480 B2 9/2004 Goto et al.
6,800,228 B1 10/2004 Semen
6,828,364 B2 12/2004 Gugumus
6,846,859 B2 1/2005 Coffy et al.
7,132,496 B2 11/2006 Kerres et al.
7,169,844 B2 1/2007 Inokami
7,205,350 B2 4/2007 Thibaut
7,223,432 B2 5/2007 Cholli et al.
7,262,319 B2 8/2007 Rehm et al.
7,323,511 B2 1/2008 Cholli et al.
7,507,454 B2 3/2009 Cholli et al.
7,595,074 B2 9/2009 Cholli et al.
7,601,378 B2 10/2009 Cholli et al.
7,678,877 B2 3/2010 Yang et al.
7,705,176 B2 4/2010 Cholli et al.
7,705,185 B2 4/2010 Kumar et al.
7,727,571 B2 6/2010 Cholli et al.
7,754,267 B2 7/2010 Cholli et al.
7,767,853 B2 8/2010 Cholli et al.
7,799,948 B2 9/2010 Kumar et al.
7,902,317 B2 3/2011 Kumar et al.
7,923,587 B2 4/2011 Cholli
7,956,153 B2 6/2011 Cholli et al.
8,008,423 B2 8/2011 Kumar et al.
8,039,673 B2 10/2011 Cholli et al.
8,080,689 B2 12/2011 Kumar et al.
8,242,230 B2 8/2012 Cholli et al.
8,252,884 B2 8/2012 Kumar et al.
8,481,670 B2 7/2013 Kumar et al.
8,598,382 B2 12/2013 Cholli et al.
8,691,933 B2 4/2014 Kumar et al.
8,710,266 B2 4/2014 Kumar et al.
8,846,847 B2 9/2014 Cholli et al.
8,927,472 B2 * 1/2015 Cholli ..... C10M 141/00 508/192
9,388,120 B2 7/2016 Kumar et al.
2001/0041203 A1 11/2001 Uno et al.
2002/0007020 A1 1/2002 Higahimura et al.
2002/0128493 A1 9/2002 Romanczyk, Jr. et al.
2002/0143025 A1 10/2002 Pratt et al.
2002/0183470 A1 12/2002 Tripathy et al.
2003/0030033 A1 2/2003 Duyck et al.
2003/0078346 A1 4/2003 Nakamura et al.
2003/0091837 A1 5/2003 Aoki
2003/0176620 A1 9/2003 Romanczyk, Jr. et al.
2003/0191242 A1 10/2003 Zedda et al.
2003/0229196 A1 12/2003 Braat et al.
2003/0230743 A1 12/2003 Cholli et al.
2004/0015021 A1 1/2004 Adams et al.
2004/0164279 A1 8/2004 Stevenson et al.
2004/0180994 A1 9/2004 Pearson et al.
2004/0186167 A1 9/2004 Dou et al.
2004/0186214 A1 9/2004 Li et al.
2004/0198875 A1 10/2004 Kaprinidis et al.
2004/0214935 A1 10/2004 Cholli et al.
2005/0170978 A1 8/2005 Migdal et al.
2005/0209379 A1 9/2005 Botkin et al.
2005/0238789 A1 10/2005 Cholli et al.
2005/0242328 A1 11/2005 Baranski
2006/0029706 A1 2/2006 Cholli et al.
2006/0040833 A1 2/2006 Al-Akhdar et al.
2006/0041087 A1 2/2006 Cholli
2006/0041094 A1 2/2006 Cholli
2006/0128929 A1 6/2006 Yang et al.
2006/0128930 A1 6/2006 Dhawan et al.
2006/0128931 A1 6/2006 Kumar et al.
2006/0128939 A1 6/2006 Kumar et al.
2006/0154818 A1 7/2006 Destro et al.
2006/0189820 A1 8/2006 Rehm et al.
2006/0189824 A1 8/2006 Kumar et al.
2006/0208227 A1 9/2006 Shiraki
2006/0233741 A1 10/2006 Kumar et al.

(56) References Cited

U.S. PATENT DOCUMENTS

| | | | |
|---|---|---|---|
| 2007/0010632 | A1 | 1/2007 | Kaplan et al. |
| 2007/0106059 | A1 | 5/2007 | Cholli et al. |
| 2007/0135539 | A1 | 6/2007 | Cholli et al. |
| 2007/0149660 | A1 | 6/2007 | Kumar et al. |
| 2007/0154430 | A1 | 7/2007 | Cholli et al. |
| 2007/0154608 | A1 | 7/2007 | Cholli et al. |
| 2007/0154720 | A1 | 7/2007 | Cholli et al. |
| 2007/0161522 | A1 | 7/2007 | Cholli et al. |
| 2008/0249335 | A1 | 10/2008 | Cholli et al. |
| 2008/0293856 | A1 | 11/2008 | Kumar et al. |
| 2008/0311065 | A1 | 12/2008 | Cholli |
| 2009/0184294 | A1 | 7/2009 | Cholli et al. |
| 2011/0040125 | A1 | 2/2011 | Kumar et al. |
| 2011/0282098 | A1 | 11/2011 | Cholli et al. |
| 2012/0004150 | A1 | 1/2012 | Cholli et al. |
| 2012/0071596 | A1 | 3/2012 | Kumar et al. |
| 2012/0123145 | A1 | 5/2012 | Cholli et al. |
| 2012/0142968 | A1 | 6/2012 | Kumar et al. |
| 2013/0041171 | A1 | 2/2013 | Cholli et al. |
| 2013/0072586 | A1 | 3/2013 | Kumar et al. |
| 2013/0130955 | A1 | 5/2013 | Cholli et al. |
| 2014/0011901 | A1 | 1/2014 | Kumar et al. |
| 2014/0014880 | A1 | 1/2014 | Cholli et al. |
| 2014/0316163 | A1 | 10/2014 | Kumar et al. |
| 2016/0115117 | A1 | 4/2016 | Cholli |

FOREIGN PATENT DOCUMENTS

| | | | |
|---|---|---|---|
| DE | 198 43 875 | A1 | 3/2000 |
| EP | 0 181 023 | A1 | 5/1986 |
| EP | 0 289 077 | A2 | 11/1988 |
| EP | 0 358 157 | | 3/1990 |
| EP | 0 404 039 | A1 | 12/1990 |
| EP | 0 618 203 | A1 | 10/1994 |
| EP | 0 688 805 | A1 | 12/1995 |
| EP | 1 067 144 | A1 | 1/2001 |
| EP | 1 468 968 | A1 | 10/2004 |
| FR | 2 183 973 | | 12/1973 |
| GB | 1042639 | | 8/1964 |
| GB | 1 283 103 | | 7/1972 |
| GB | 1 320 169 | | 6/1973 |
| GB | 1 372 042 | | 10/1974 |
| GB | 1 389 442 | | 4/1975 |
| GB | 1 469 245 | | 4/1977 |
| GB | 1 482 649 | | 8/1977 |
| JP | 69002715 | B | 1/1966 |
| JP | 43016392 | B4 | 7/1968 |
| JP | 43018453 | | 8/1968 |
| JP | 44024274 | | 10/1969 |
| JP | 44028850 | | 11/1969 |
| JP | 45 2980 | | 1/1970 |
| JP | 45-2980 | | 1/1970 |
| JP | 49 29339 | | 3/1974 |
| JP | 57085366 | A | 5/1982 |
| JP | 59025814 | | 2/1984 |
| JP | 59197447 | | 11/1984 |
| JP | 60-199832 | | 10/1985 |
| JP | 05 199858 | | 8/1993 |
| JP | 06135876 | A | 5/1994 |
| JP | 06 247959 | | 9/1994 |
| JP | 08027226 | A | 1/1996 |
| JP | 09262069 | | 10/1997 |
| JP | 09 328519 | | 12/1997 |
| JP | 09 328521 | | 12/1997 |
| JP | 9322784 | A | 12/1997 |
| JP | 11-80063 | | 3/1999 |
| JP | 11-158103 | | 6/1999 |
| JP | 2003138258 | | 5/2003 |
| NL | 7 905 000 | | 3/1980 |
| WO | WO 92/20734 | | 11/1992 |
| WO | WO 97/14678 | A1 | 4/1997 |
| WO | WO 00/39064 | | 7/2000 |
| WO | WO 01/18125 | A1 | 3/2001 |
| WO | WO 01/48057 | A1 | 7/2001 |
| WO | WO 02/28820 | A1 | 4/2002 |
| WO | WO 02/079130 | A1 | 10/2002 |
| WO | WO 03/087260 | A1 | 10/2003 |
| WO | WO 03/102004 | A1 | 12/2003 |
| WO | WO 2004/024070 | A2 | 3/2004 |
| WO | WO 2004/050795 | A2 | 6/2004 |
| WO | WO 2005/025513 | A2 | 3/2005 |
| WO | WO 2005/025646 | A2 | 3/2005 |
| WO | WO 2005/060500 | A2 | 7/2005 |
| WO | WO 2005/070974 | A2 | 8/2005 |
| WO | WO 2005/071005 | A1 | 8/2005 |
| WO | WO 2006/018403 | A1 | 2/2006 |
| WO | WO 2006/060800 | A1 | 6/2006 |
| WO | WO 2006/060801 | A2 | 6/2006 |
| WO | WO 2006/104957 | A2 | 10/2006 |
| WO | WO 2008/005358 | A2 | 1/2008 |
| WO | WO 2015/077635 | | 5/2015 |

OTHER PUBLICATIONS

Akkara, J.A., et al., "Synthesis and Characterization of Polymers Produced by Horseradish Peroxidase in Dioxane," *J. of Polymer Science: Part A: Polymer Chemistry*, 29(11):1561-1574 (1991).

Al-Malaika, S and Suharty, N., "Reactive Processing of Polymers: Mechanisms of Grafting Reactions of Functional Antioxidants on Polyolefins in the Presence of a Coagent," Polymer Degradation and Stability 49: 77-89 (1995).

Armengol, E., et al., "Acid Zeolites as Catalysts in Organic Reactions, *tert*-Butylation of Anthracene, Naphthalene and Thianthrene," *Appl. Catal. A* 149:411-423 (1997).

Ayyagari, M.S., et al., "Controlled Free-Radical Polymerization of Phenol Derivatives by Enzyme-Catalyzed Reactions in Organic Solvents," *Macromolecules*, 28(15):5192-5197 (1995).

Badamali, S.K., et al., "Influence of Aluminium Sources on the Synthesis and Catalytic Activity of Mesoporous AIMCM-41 Molecular Sieves," *Catal. Today* 63:291-295 (2000).

Belyaev, A., et al., "Structure-Activity Relationship of Diaryl Phosphonate Esters as Potent Irreversible Dipeptidyl Peptidase IV Inhibitors," *J. Med. Chem.*, 42:1041-1052 (1999).

Blokhin, Y.I, et al., "Phosphorylation of Dihydric Phenols with Amides of Phosphorous Acid," *Russian Chem. Bulletin*, 45(9):2250-2251 (1996).

Bruno, F.F., et al., "Enzymatic Template Synthesis of Polyphenol," Materials Research Society Symposium Proceedings vol. 600, Electroactive Polymers (EAP):255-259 (1999).

Chandra, K.G. and Sharma, M.M., "Alkylation of Phenol with MTBE and Other tert-butylethers:Cation Exchange Resins as Catalysts," *Catal. Lett.* 19(4):309-317 (1993).

Circ-Marjanovic, et al., Chemical Oxidative Polymerization of Aminodiphenylamines, Journal of Physical Chemistry B, 112, 23: 6976-6987 (2008).

Coppinger, G.B., et al., "Photo-Fries Rearrangement of Aromatic Esters. Role of Steric and Electronic Factors" *J. of Phy. Chem.*, 70(11):3479-3489 (1966).

Database Beilstein [online] Beilstein Institut Zur Forderung Der Chemischen Wissenschaften; XP002420027, Beilstein Registry No. 3517906.

Database Beilstein [online] Beilstein Institut Zur Förderung Der Chemischen Wissenschaften; XP002420028, Beilstein Registry No. 5840042.

Database Beilstein [online] Beilstein Institut Zur Förderung Der Chemischen Wissenschaften; XP002420029, Beilstein Registry No. 2311871.

Database Beilstein [online] Beilstein Institut Zur Förderung Der Chemischen Wissenschaften; XP002420030, Beilstein Registry No. 8876646.

Database Beilstein [online] Beilstein Institut Zur Förderung Der Chemischen Wissenschaften; XP002420031, Beilstein Registry No. 2271400.

Database Beilstein [online] Beilstein Institut Zur Förderung Der Chemischen Wissenschaften; XP002420032, Beilstein Registry No. 2212095.

(56) References Cited

OTHER PUBLICATIONS

Database Beilstein [online] Beilstein Institut Zur Förderung Der Chemischen Wissenschaften; XP002420033, Beilstein Registry No. 8941955.
Database Beilstein [online] Beilstein Institut Zur Förderung Der Chemischen Wissenschaften; XP002420034, Database Accession No. 2312425.
Database Beilstein [online] Beilstein Institut Zur Förderung Der Chemischen Wissenschaften; XP002420035, Beilstein Registry No. 905950.
Database Beilstein [online] Beilstein Institut Zur Förderung Der Chemischen Wissenschaften; XP002420036, Beilstein Registry No. 2140308.
Database Beilstein [online] Beilstein Institut Zur Förderung Der Chemischen Wissenschaften; XP002420037, Beilstein Registry No. 134886.
Database Beilstein [online] Beilstein Institut Zur Förderung Der Chemischen Wissenschaften; XP002420038, Beilstein Registry No. 1961007.
Database CA [online] Chemical Abstracts Service, Columbus, Ohio, US, XP-002429584, Database Accession No. 81::153647, Organic Phosphate Stabilizers for Polyamides and Polyurethanes, abstract, Minagawa, M. (1974).
Database Caplus [online] Chemical Abstracts Service, Columbus, Ohio, US, XP-002387095, Database Accession No. 1981:572206, Effectiveness of Inhibitors in the Oxidation of Jet Fuel with an Initiator, abstract, Kovalev, et al.
Devassy, B.M., et al., "Zirconia Supported Phosphotungstic Acid as an Efficient Catalyst for Resorcinol *tert*-Butylation and *n*-Heptane Hydroisomcrization," *J. Mol. Catalysis A: Chemical* 221:113-119 (2004).
Ding, et al., "Chemical Trapping Experiments Support a Cation-Radical Mechanism for the Oxidative Polymerization of Aniline," Journal of Polymer Science, Part A: Polymer Chemistry, vol. 37: 2569-2579 (1999).
Dordick, J.S., "Enzymatic Catalysis in Monophasic Organic Dolvents," *Enzyme Microb. Technol*., 11(4):194-211 (1989).
Dordick, J.S., et al., "Polymerization of Phenols Catalyzed by Peroxidase in Nonaqueous Media," *Biotechnology and Bioengineering*, XXX:31-36 (1987).
English Abstract of Kovalev, G. I., et al., "Study of the Effectiveness of Inhibitors in Oxidation of Jet Fuel in a Closed Volume, "*Deposited Doc*., VINITI: 443-82 (1981).
English Abstract of Kovalev, G.1., et al., "Effectiveness of Inhibitors in the Oxidation of Jet Fuel With an Initiator," *J. Neftekhimiya* (*Petroleum Chemistry*), 21(2): 287-298 (1981).
Faber, K., "Biotransformations in Organic Chemistry," A Textbook, Fourth Completely Revised and Extended Edition, Springer-Verlag pp: 347-349 (1953).
FS&T 821 "Antioxidant," [online], [retrieved on 2002-10-29]. Retrieved from the Internet <URL: http://class.fst.ohio-state.edu/fst821/>.
FS&T 821 "Food Lipids," [online], Oct. 2001 [retrieved on Oct. 29, 2002]. Retrieved from the Internet <URL: http://class.fst.ohio-state.edu/fst821/>.
FST 821 "Course Schedule," [online], [retrieved on Oct. 29, 2002]. Retrieved from the Internet <URL: http://class.fst.ohio-state.edu/fst821/>.
Hatayama, K., et al., "Anti-ulcer Effect of Isoprenyl Flavonoids. III.[1)] Synthesis and Anti-ulcer Activity of Metabolites of 2'-Carboxymethoxly-4,4'-bis(3-methyl-2-butenyloxy)chalcone[2)]," *Chemical & Pharmaceutical Bulletin*, 33(4), 1327-1333(Apr. 1985).
Heidekum, A., et al., "Nafion/Silica Composite Material Reveals High Catalytic Potential in Acylation Reactions," *J. Catal*. 188:230-232 (1999).
Hidalgo, M.E., et al., "Antioxidant Activity of Depsides and Depsidones," Phytochemistry, *37*(6):1585-1587 (1994).
Hofer, K., et al., "[[(Anilinooxalyl)amino]phenyl] Phosphite Stabilizers for Polypropylene," Chemical Abstracts Service, ZCAPLUS, document No. 77:62780 (1972).
Ikeda, R., et al., "Novel Synthetic Pathway to a Poly(phenylene oxide). Laccase-Catalyzed Oxidative Polymerization of Syringic Acid," *Macromolecules*, 29:3053-3054 (1996).
International Search Report for related foreign application PCT/US2007/015177, mailed on Jun. 13, 2008.
International Search Report for related foreign application PCT/US2005/044021, mailed on May 22, 2006.
International Search Report for related foreign application PCT/US2005/044022, mailed on May 2, 2006.
International Search Report for related foreign application PCT/US2005/044023, mailed on Nov. 3, 2006.
International Search Report for related foreign application PCT/US2005/044019, mailed on Apr. 28, 2006.
International Search Report for related foreign application PCT/US2005/025646, mailed on Mar. 13, 2006.
International Search Report for related foreign application PCT/US2005/025513, mailed on Mar. 13, 2006.
International Search Report for related foreign application PCT/US2006/006355, mailed on Jul. 31, 2006.
International Search Report for related foreign application PCT/US2006/010985, mailed on Dec. 19. 2006.
International Search Report for related foreign application PCT/US2006/042240, mailed on May 3, 2007.
International Search Report for related foreign application PCT/US2006/042235, mailed on Apr. 27, 2007.
International Search Report for related foreign application PCT/US2006/045929, mailed on Apr. 20, 2007.
Ismail, M.N. and Wazzan, A.A., "Evaluation of New Thermal Stabilizers and Antifatigue Agents for Rubber Vulcanizates," *Polymer-Plastics Tech. and Eng*., 45:751-758 (2006).
Jayaprakasha, G.K., et al., "Antioxidant Activity of Grape Seed (*Vitis vinifera*) Extracts on Peroxidation Models In Vitro," *Food Chemistry*, 73:285-290 (2001).
Jialanella, G.and Pilrma, I., "Synthesis of Poly(vinyl alcohol-co-vinyl gallate) by the Chemical Modification of Poly(vinyl alcohol)," Polymer Bulletin 18:385-389 (1987).
Joossens, J., et al., "Diphenyl Phosphonate Inhibitors for the Urokinase-Type Plasminogen Activator: Optimization of the P4 Position," *J. Med. Chem*., 49:5785-5793 (2006).
Kamitori, Y., et al., "Silica Gel as an Effective Catalyst for the Alkylation of Phenols and Some Heterocylic Aromatic Compounds," *J. Org. Chem*. 49: 4161-4165 (1984).
Kazandjian, R.Z., et al., "Enzymatic Analyses in Organic Solvents," *Biotechnology and Bioengineering*, XXVIII:417-421 (1986).
Khan, K.M., et al., "An Expedient Esterification of Aromatic Carboxylic Acids Using Sodium Bromate and Sodium Hydrogen Sulfite," *Tetrahedron 59*(29):5549-5554 (2003).
Kim, T. H., et al., "Melt Free-Radical Grafting of Hindered Phenol Antioxidant onto Polyethylene," *J. Applied Polymer Science*, 77:2968-2973 (2000).
Klibanov, A.M., et al., "Enzymatic Removal of Toxic Phenols and Anilines from Waste Waters," *J. of Applied Biochemistry*, 2(5):414-421 (1980).
Koshchii, V.A., et al. "Alkylation of Phenol by Alcohols in the Presence of Alumium Phenolate," *Org. Chem*. 24(7):1358-1361 (1988).
Lalancette, J.M., et al. "Metals Intercalated in Graphite. II. The Friedel-Crafts Reactions with $ALCL_3$-Graphite," Can. J. Chem. 52:589-591 (1974).
Li, et al., "Novel Multifunctional Polymers from Aromatic Diamines by Oxidative Polymerizations," Chemical Reviews, vol. 102(9): pp. 2925-2943 (2002).
Maki, M., et al., "Weather-Resistant Colored Polypropylene," Chemical Abstracts Service, ZCAPLUS, document No. 89:111364 (1978).
Mar., J., Advanced Organic Chemistry, McGraw Hill Book Company, New York, pp. 251-259 (1977).
Masada, H. and Oishi, Y., "A New Synthesis of aryl *t*-butyl Ethers," *Chem. Letters*, 57-58 (1978).

(56) References Cited

OTHER PUBLICATIONS

Masada, H. et al., "A New Heterogeneous Williamson Synthesis of Ethers Using *t*-alkyl Substrates," The *Chemical Society of Japan* 3:275-282 (1996).
Masada, H., et al., "A New Method for the Williamson Ether Synthesis Using *t*-alkyl Halides in Nonpolar Solvents," *The Chemical Society of Japan*, 2:164-166 (1995).
Mehdipour-Ataei, S., et al., "Novel Diols Containing Ester and Amide Groups and Resulting Poly(ester amide ester)s," *J. Applied Polymer Sci*., 93:2699-2703 (2004), XP002420014.
Mejias, L., et al.,, "New Polymers From Natural Phenols Using Horseradish or Soybean Peroxidase," *Macromol. Biosci*., 2:24-32 (2002).
Ol'dekop, Yu. A., et al. "Simple Synthesis of the tert-butyl Ether of Phenol" Inst. Fiz-Org. Khim., Minsk, USSR. *Zhurnal Obshchei Khimii*, 50(2):475-6 (1980).
Overgaag, M., et al., "Rearrangement of Alkyl Phenyl Ethers Over Dealuminated HY Zeolites Under Liquid-Phase Conditions," *Applied Catalysis A: General, Elsevier Sci*., 175(1-2):139-146 (1998).
Pätoprstý, V., et al., "$^{13}$C NMR Study of 3,9-Di(alkylphenoxy)-2,4,8,10-tetraoxa-3,9-diphosphaspiro[5.5]undecanes," *Magnetic Resonance in Chem*, 23(2):122-126 (1985).
PCT Application No. PCT/US2005/001946: International Preliminary Report on Patentability issued Jul. 24, 2006.
PCT Application No. PCT/US2005/025513: International Preliminary Report on Patentability and Written Opinion mailed on Jan. 23, 2007.
PCT Application No. PCT/US2005/025646: International Preliminary Report on Patentability mailed on Dec. 20, 2006.
PCT Application No. PCT/US2005/025646: Written Opinion mailed on Nov. 14, 2006.
PCT Application No. PCT/US2006/042251: Notification Concerning Transmittal of International Preliminary Report on Patentability mailed on May 8, 2008.
PCT Application No. PCT/US2006/042251: Notification Concerning Transmittal of International Search Report and Written Opinion of the International Searching Authority, or the Declaration mailed on Feb. 22, 2007.
PCT Application No. PCT/US2007/015177: Notification Concerning Transmittal of International Preliminary Report on Patentability mailed on Jan. 15, 2009.
PCT Application No. PCT/US2007/015177: Notification of Transmittal of the International Search Report and Written Opinion of the International Searching Authority, or the Declaration, mailed on Jun. 13, 2008.
Pirozhenko, V.V., et al., "NMR Study of Topomerization of *N*-Aroyl-*p*-Benzoquinonemonoimines," *Russian J. of Organic Chem*., 31(11):1514-1519 (1995).
Quaschning, V., et al., "Properties of Modified Zirconia Used as Friedel-Crafts-Acylation Catalysts," J. Catal. 177:164-174 (1998).
RN 85650-63-1, 1984.
Ryu, K., et al., "Peroxidase-Catalyzed Polymerization of Phenols," Biocatalysis in Agricultural Biotechnology, Chapter10:141-157 (1988).
Sakthivel, A., et al., "Vapour Phase Tertiary Butylation of Phenol Over Sulfated Zirconia Catalyst," *Catal. Lett*., 72(3-4):225-228 (2001).
Sartori G., et al., "Highly Selective Mono-*tert*-butylation of Aromatic Compounds," *Chem. Ind*., (London), (22):762-763 (1985).
Scharpe, S.L., et al., "Serine Peptidase Modulators, Their Preparation, and Their Therapeutic Use," Chemical Abstracts Service, ZCAPLUS, document No. 131:223514 (1999).
Search Report in international application PCT/US2006/042251 (Feb. 2007).
Singh, A. and Kaplan, D. L., "Biocatalytic Route to Ascorbic Acid-Modified Polymers for Free-Radical Scavenging," *Adv. Matter*., 15(15):1291-1294 (2003).
Spano, R., et al., "Substituted Anilides of 3-Monoethyl Ester of 4 Hydroxyisophthalic Acid," *J. of Med. Chem*., 15(5):552-553 (1972).
Thompson, C. Ray, "Stability of Carotene in Alfalfa Meal: Effect of Antioxidants," *Industrial & Engineering Chemistry*, 24(5): 922-925 (1950).
Tsvetkov, O.N., et al., "Alkylation of Phenols with Higher Olefins. Part I," *Int. Chem. Eng*. 7(1):104-121 (1967).
XP-002419239, "Discover Our World of Effects for Polyolefins," *Ciba Speciality Chemicals*, (2003).
http://www.machinerylubrication.com/Read/1028/Oxidation-Lubricant (Mar. 29, 2010, pp. 1-7).
Irgafos® 126, BASF publication, pp. 1-3, Jul. 2010.
USPTO Search Report for U.S. Appl. No. 13/572,884, Mar. 20, 2013.
Invitation to Pay Additional Fees and Where Applicable, Protest Fee of the International Searching Authority mailed Feb. 3, 2015 for International Application No. PCT/US2014/066935 filed Nov. 21, 2014 entitled "Macromolecular Antioxidants Based on Dual Type Moiety Per Molecule: Structures Methods of Making and Using the Same".
Knobloch G: "Ein Neuer Weg Zu Polymergebudenen Alterungsschutzmitteln Technologisch Einfach Und Effcktiv a New Way to Polymer Bound Antioxidants Technologically Simple and Efficient," Kautschuk Und Gummi, Kutststoffe, Huthig, Verlag, Heidelberg, DE, vol. 52, No. 1, Jan. 1, 1999, pp. 10-14.
PCT/US2014/066935 Notification Concerning Transmittal of International Preliminary Report on Patentability mailed Jun. 2, 2016 entitled "Macromolecular Antioxidants Based on Dual Type Moiety Per Molecule: Structures, Methods of Making and Using the Same."

* cited by examiner

LUBRICANT OIL COMPOSITIONS

RELATED APPLICATIONS

This application is a continuation of U.S. application Ser. No. 13/469,813, filed May 11, 2012, which is a continuation of U.S. application Ser. No. 13/165,372, filed Jun. 21, 2011, now abandoned, which is a continuation of U.S. application Ser. No. 11/606,785, filed Nov. 30, 2006, now abandoned, which claims the benefit of U.S. Provisional Application No. 60/742,150, filed on Dec. 2, 2005. The entire teachings of the above applications are incorporated herein by reference.

BACKGROUND OF THE INVENTION

Early lubrication began with animal fats and oils and slowly evolved to petroleum-based oils. Petroleum-based oil, however, do not perform as well as many of the animal-based products and require a lot of refining and treatment. Synthetic oils, which are made from small molecules, have historically had superior lubricating performance characteristics that could not be achieved with conventional oils. However, while many lubricants currently exist, there is still a need for lubricants with improved properties.

SUMMARY OF THE INVENTION

The present invention relates to compositions comprising i) a first antioxidant and at least one first additive, selected from the group comprising surface additives, performance enhancing additives and lubricant protective additives and optionally ii) a second additive and/or a second antioxidant (or stabilizer). These compositions are useful in the methods of the present invention to improve, for example, increase the shelf life, improve the quality and/or performance of lubricants, such as lubricant oils.

In one embodiment, the present invention is a composition comprising a first antioxidant, and at least one first additive selected from the group consisting of i) a surface additive; ii) a performance enhancing additive; and iii) a lubricant protective additive.

In another embodiments the present invention is a lubricant composition comprising: a lubricant or a mixture of lubricants, a first antioxidant and at least one first additive selected from the group consisting of i) a surface additive; ii) a performance enhancing additive; and iii) a lubricant protective additive.

In yet another embodiment the present invention is a method of improving a composition comprising combining the composition with a first antioxidant; and at least one first additive selected from the group consisting of i) a surface additive; ii) a performance enhancing additive; and iii) a lubricant protective additive.

In yet another embodiment the present invention is a method of improving a lubricant or a mixture of lubricants comprising combining the lubricant or mixture of lubricants with a first antioxidant; and at least one first additive selected from the group consisting of i) a surface additive; ii) a performance enhancing additive; and iii) a lubricant protective additive.

The compositions and methods of the present invention generally provide increased shelf life, increased oxidative resistance, enhanced performance and/or improved quality to materials, such as, for example, lubricants and lubricant oils. In general it is believed that because of the synergy of the antioxidants with the additives, the compositions described herein have superior oxidation resistance. The additives exhibit several key functions such as corrosion inhibition, detergency, viscosity modification, antiwear performance, dispersant properties, cleaning and suspending ability. The disclosed compositions, in general provide superior performance of lubricants in high temperatures applications due to the presence of antioxidants which are thermally stable at high temperatures with enhanced oxidation resistance.

DETAILED DESCRIPTION OF THE INVENTION

The present invention relates to compositions for improving lubricants, wherein the compositions comprise i) a first antioxidant selected from the group comprising of antioxidants described in Provisional Patent Application Nos. 60/632,893, 60/633,197, 60/633,252, 60/633,196, 60/665,638, 60/655,169, 60/731,125, 60/731,021 and 60/731,325; U.S. patent application Ser. Nos. 11/184,724, 11/184,716, 11/040,193, 10/761,933, 10/408,679 and 10/761,933; PCT Patent Application Nos. PCT/US2005/001948, PCT/US2005/001946 and PCT/US03/10782, the entire contents of each of which are incorporated herein by reference; along with at least one first additive selected from the groups comprising of surface additives, performance enhancing additives and lubricant protective additives; and optionally ii) a second additive and/or a second antioxidant (or stabilizer) wherein examples of suitable second additives and antioxidants are as described herein.

In one embodiment, the first antioxidants which are suitable for use in the compositions and methods of the present invention include, but are not limited to: polyalkyl phenol based antioxidants, sterically hindered phenol based antioxidants, sterically hindered phenol based macromolecular antioxidants, nitrogen and hindered phenol containing dual functional macromolecular antioxidants, alkylated macromolecular antioxidants, sterically hindered phenol and phosphite based macromolecular antioxidants.

In one embodiment, the first antioxidants which are suitable for use in the compositions and methods of the present invention include antioxidant polymers which comprises repeat units that include one or both of Structural Formulas (I) and (II):

(I)

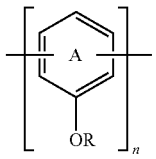

(II)

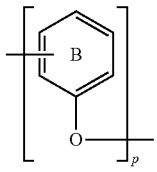

where:

R is —H or a substituted or unsubstituted alkyl, substituted or unsubstituted acyl or substituted or unsubstituted aryl group;

Ring A is substituted with at least one tert-butyl group or substituted or unsubstituted n-alkoxycarbonyl group, and optionally one or more groups selected from the group consisting of —OH, —NH, —SH, a substituted or unsubstituted alkyl or aryl group, and a substituted or unsubstituted alkoxycarbonyl group;

Ring B is substituted with at least one —H and at least one tert-butyl group or substituted or unsubstituted n-alkoxycarbonyl group and optionally one or more groups selected from the group consisting of —OH, —NH, —SH, a substituted or unsubstituted alkyl or aryl group, and a substituted or unsubstituted alkoxycarbonyl group;

n is an integer equal to or greater than 2; and p is an integer equal to or greater than 0.

In another embodiment, the first antioxidants which are suitable for use in the compositions and methods of the present invention include polymers with repeat units represented by one or both of Structural Formulas (III) and (IV):

(III)

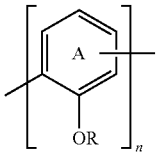

(IV)

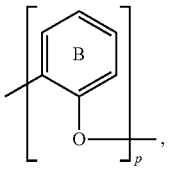

where Rings A and B are substituted as described above and n and p are as defined above.

Preferably, Ring A and Ring B in Structural Formulas (I) to (IV) are each substituted with at least one tert-butyl group.

In another embodiment, the first antioxidants which are suitable for use in the compositions and methods of the present invention include polymers with repeat units represented by one or more of Structural Formulas (Va), (Vb), (Vc), (VIa), (VIb) and (VIc):

(Va)

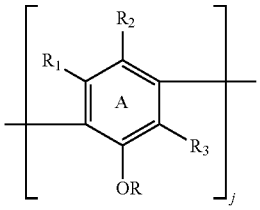

(Vb)

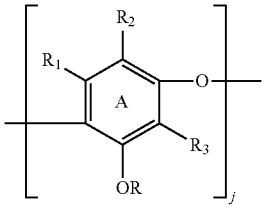

-continued (Vc)

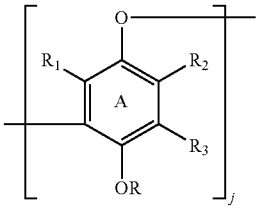

(VIa)

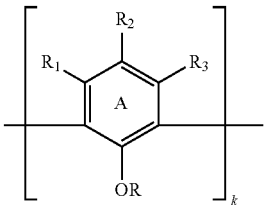

(VIb)

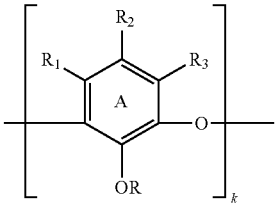

(VIc)

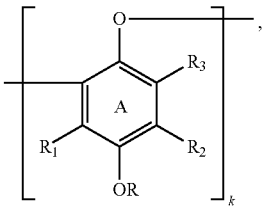

where $R_1$, $R_2$ and $R_3$ are independently selected from the group consisting of —H, —OH, —NH, —SH, a substituted or unsubstituted alkyl or a substituted or unsubstituted aryl group, and a substituted or unsubstituted alkoxycarbonyl group, provided that at least one of $R_1$, $R_2$ and $R_3$ is a tert-butyl group; and j and k are independently integers of zero or greater, such that the sum of j and k is equal to or greater than 2.

In a particular embodiment, R is —H or —$CH_3$; $R_2$ is —H, —OH, or a substituted or unsubstituted alkyl group; or both.

Specific examples of repeat units included in polymers which are suitable for use in the compositions and methods of the present invention are represented by one of the following structural formulas:

(VII)

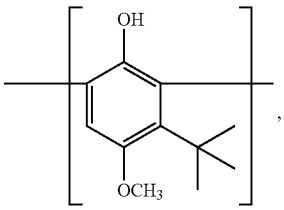

-continued (VIII)

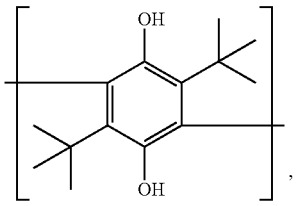

(IX)

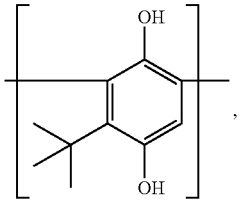

(X)

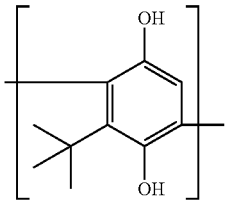

(XI)

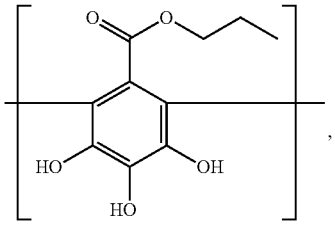

(XII)

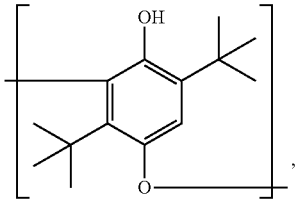

(XIII)

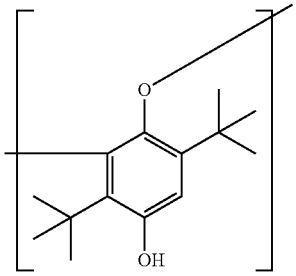

(XIV)

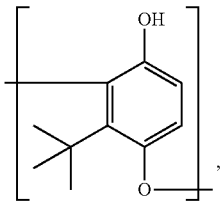

-continued (XV)

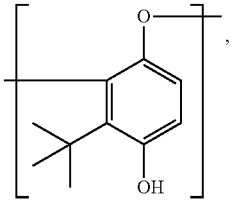

(XVI)

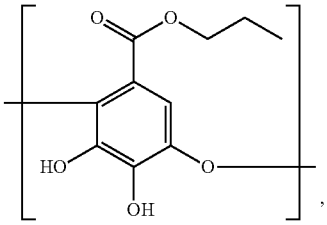

(XVII)

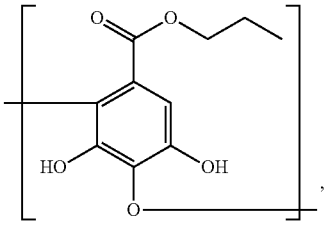

and (XVIII)

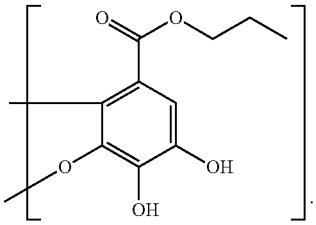

Antioxidant polymers as described immediately above which are suitable for use in the compositions and methods of the present invention have two or more repeat units, preferably greater than about five repeat units. The molecular weight of the polymers disclosed above is generally selected to be appropriate for the desired application. Typically, the molecular weight is greater than about 500 atomic mass units (amu) and less than about 2,000,000 amu, greater than about 1000 amu and less than about 100,000, greater than about 2,000 amu and less than about 10,000, or greater than about 2,000 amu and less than about 5,000 amu.

Antioxidant polymers as described immediately above which are suitable for use in the compositions and methods of the present invention can be either homopolymers or copolymers. A copolymer preferably contains two or more or three or more different repeating monomer units, each of which has varying or identical antioxidant properties. The identity of the repeat units in a copolymer can be chosen to modify the antioxidant properties of the polymer as a whole, thereby giving a polymer with tunable properties. The second, third and/or further repeat units in a copolymer can be either a synthetic or natural antioxidant.

Antioxidant polymers as described immediately above which are suitable for use in the compositions and methods of the present invention are typically insoluble in aqueous media. The solubility of the antioxidant polymers in non-aqueous media (e.g., oils) depends upon the molecular weight of the polymer, such that high molecular weight polymers are typically sparingly soluble in non-aqueous media. When an antioxidant polymer of the invention is insoluble in a particular medium or substrate, it is preferably well-mixed with that medium or substrate.

Antioxidant polymers as described immediately above which are suitable for use in the compositions and methods of the present invention can be branched or linear, but are preferably linear. Branched antioxidant polymers can only be formed from benzene molecules having three or fewer substituents (e.g., three or more hydrogen atoms), as in Structural Formulas (XX), (XXI) and (XXIV).

In another embodiment, the first antioxidants which are suitable for use in the compositions and methods of the present invention include polymers with repeat units represented by one or both of Structural Formulas (I) and (II):

(I)

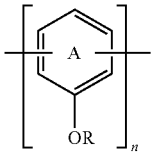

(II)

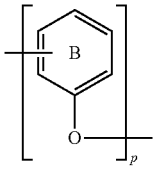

where:

R is —H or a substituted or unsubstituted alkyl, acyl or aryl group;

Ring A is substituted with at least one tert-butyl group, 1-ethenyl-2-carboxylic acid group or ester thereof, substituted or unsubstituted alkylenedioxy group, or substituted or unsubstituted n-alkoxycarbonyl group and zero, one or more additional functional groups;

Ring B is substituted with at least one —H and at least one tert-butyl group, 1-ethenyl-2-carboxylic acid group or ester thereof, substituted or unsubstituted alkylenedioxy group, or substituted or unsubstituted n-alkoxycarbonyl group and zero, one or more additional functional groups;

n is an integer equal to or greater than 2; and p is an integer equal to or greater than 0, where the polymer includes two or more repeat units represented by one or both of Structural Formulas (I) and (II) that are directly connected by a C—C or C—O—C bond between benzene rings.

Polymers as described immediately above which are suitable for use in the compositions and methods of the present invention that do not include any repeat units represented by Structural Formula (I) are preferably substituted on Ring B with one or more hydroxyl or acyloxy groups.

Repeat units of the antioxidant polymers as described immediately above which are suitable for use in the compositions and methods of the present invention include substituted benzene molecules. These benzene molecules are typically based on phenol or a phenol derivative, such that they have at least one hydroxyl, ester or ether functional group. Preferably, the benzene molecules have a hydroxyl group. The hydroxyl group is not restricted to being a free hydroxyl group, and the hydroxyl group can be protected or have a cleavable group attached to it (e.g., an ester group). Such cleavable groups can be released under certain conditions (e.g., changes in pH), with a desired shelf life or with a time-controlled release (e.g., measured by the half-life), which allows one to control where and/or when an antioxidant polymer is able to exert its antioxidant effect.

Substituted benzene repeat units of an antioxidant polymer as described immediately above which are suitable for use in the compositions and methods of the present invention are also typically substituted with a bulky alkyl group, a 1-ethenyl-2-carboxylic acid group, a substituted or unsubstituted alkylenedioxy group, or an n-alkoxycarbonyl group. Preferably, the benzene monomers are substituted with a bulky alkyl group. More preferably, the bulky alkyl group is located ortho or meta to a hydroxyl group on the benzene ring. A "bulky alkyl group" is defined herein as an alkyl group that is branched alpha- or beta- to the benzene ring. Preferably, the alkyl group is branched alpha to the benzene ring. More preferably, the alkyl group is branched twice alpha to the benzene ring (i.e., to form an alpha-tertiary carbon), such as in a tert-butyl group. Other examples of bulky alkyl groups include isopropyl, 2-butyl, 3-pentyl, 1,1-dimethylpropyl, 1-ethyl-1-methylpropyl and 1,1-diethylpropyl. The bulky alkyl groups are preferably unsubstituted, but they can be substituted with a functional group that does not interfere with the antioxidant activity of the molecule or the polymer.

Substituted benzene repeat units that are substituted with a substituted or unsubstituted alkylenedioxy group typically have an unsubstituted alkylenedioxy group. Substituted alkylenedioxy groups are also suitable, although the substituents should not interfere with the antioxidant activity of the molecule or the polymer. Typically, an alkylenedioxy group is a lower alkylenedioxy group, such as a methylenedioxy group or an ethylenedioxy group. A methylenedioxy group is preferred (as in sesamol).

Straight chained alkoxycarbonyl groups typically have an alkyl chain of one to sixteen carbon atoms, and include methoxycarbonyl, ethoxycarbonyl, n-propoxycarbonyl, n-butoxycarbonyl and n-pentoxycarbonyl. n-propoxycarbonyl is a preferred group. Similar to the bulky alkyl groups, n-alkoxycarbonyl groups are optionally substituted with a functional group that does not interfere with the antioxidant activity of the molecule or the polymer. Alkoxycarbonyl groups can also be present in their hydrolyzed form, namely as carboxy groups or carboxylic acid groups.

In substituted benzene repeat units having a 1-ethenyl-2-carboxylic acid group or an ester thereof, the 1-carbon (i.e., the carbon distal from the carboxylic acid moiety) is attached to the benzene ring.

In addition to the substituents named above, substituted benzene repeat units can have additional functional groups as substituents. For example, the additional functional groups can be selected from the group consisting of —OH, —NH, —SH, a substituted or unsubstituted alkyl or aryl group, a substituted or unsubstituted alkoxycarbonyl group, a substituted or unsubstituted alkoxy group and a saturated or unsaturated carboxylic acid group. Typically, the additional functional groups are selected from the group consisting of —OH, a substituted or unsubstituted alkoxy group and a saturated or unsaturated carboxylic acid group.

Preferably, Ring A and Ring B in Structural Formulas (I) to (IV) are each substituted with at least one tert-butyl group.

Further, specific examples of repeat units included in polymers which are suitable for use in the compositions and methods of the present invention are represented by one of the following structural formulas:

(XVIIIa)

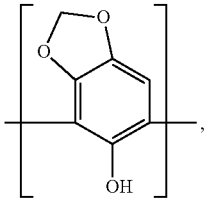

(XVIIIb)

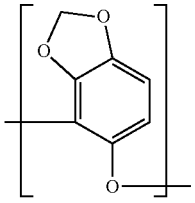

and (XVIIIc)

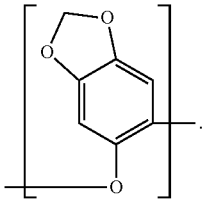

Although Structural Formulas (XI), (XVI), (XVII) and (XVIII) are represented as having a propoxycarbonyl substituent, this group can generally be replaced with a different $C_1$-$C_{16}$ n-alkoxycarbonyl group or can be a carboxylate group.

A particular polymer suitable for use in the methods and compositions of the present invention is poly(2-tert-butyl-4-hydroxyanisole).

Antioxidant polymers as described immediately above which are suitable for use in the methods and compositions of the present invention have two or more repeat units, preferably greater than about five repeat units. The molecular weight of the polymers disclosed herein is generally selected to be appropriate for the desired application. Typically, the molecular weight is greater than about 500 atomic mass units (amu) and less than about 2,000,000 amu, greater than about 1000 amu and less than about 100,000, greater than about 2,000 amu and less than about 10,000 amu, or greater than about 2,000 amu and less than about 5,000 amu.

Antioxidant polymers as described immediately above which are suitable for use in the methods and compositions of the present invention can be either homopolymers or copolymers. A copolymer preferably contains two or more or three or more different repeating monomer units, each of which has varying or identical antioxidant properties (including monomers having no antioxidant activity). The identity of the repeat units in a copolymer can be chosen to modify the antioxidant properties of the polymer as a whole, thereby giving a polymer with tunable properties. The second, third and/or further repeat units in a copolymer can be either a synthetic or natural antioxidant. In one example, a composition of the invention includes one or more homopolymers and one or more copolymers (e.g., in a blend). Preferably, both homopolymers and copolymers include two or more substituted benzene repeat units that are directly connected by a C—C or C—O—C bond. Preferably, at least 50%, such as at least 70%, for example, at least 80%, but preferably about 100% of the repeat units in a copolymer are substituted benzene repeat units directly connected by a C—C or C—O—C bond.

Examples of copolymers include poly(TBHQ-co-propyl gallate), poly(TBHQ-co-BHA), poly(TBHQ-co-sesamol), poly(BHA-co-sesamol), poly(propyl gallate-co-sesamol) and poly(BHA-co-propyl gallate). The ratio of one monomer to another, on a molar basis, is typically about 100:1 to about 1:100, such as about 10:1 to about 1:10, for example, about 2:1 to about 1:2. In one example, the ratio of monomers is about 1:1.

Antioxidant polymers as described immediately above which are suitable for use in the methods and compositions of the present invention are typically insoluble in aqueous media, although certain polymers of gallic acid and its esters are water soluble. The solubility of the antioxidant polymers in non-aqueous media (e.g., oils) depends upon the molecular weight of the polymer, such that high molecular weight polymers are typically sparingly soluble in non-aqueous media. When an antioxidant polymer of the invention is insoluble in a particular medium or substrate, it is preferably well-mixed with that medium or substrate.

Antioxidant polymers as described immediately above which are suitable for use in the methods and compositions of the present invention can be branched or linear, but are preferably linear. Branched antioxidant polymers can only be formed from benzene molecules having three or fewer substituents (e.g., three or more hydrogen atoms), as in Structural Formulas (XX), (XXI) and (XXIV).

In another embodiment, the first antioxidants which are suitable for use in the compositions and methods of the present invention include a polyalkylphenol antioxidant represented by Structural Formula U or U'.

U

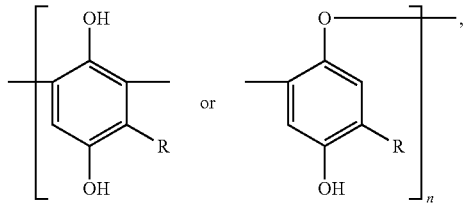

U'

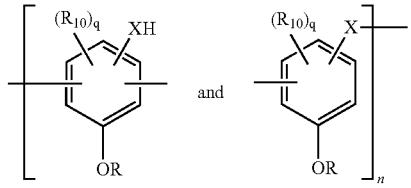

In Structural Formula U or U', n is an integer equal or greater than 2. R is a C1-C10 alkyl group, an aryl group, or a benzyl group. Typically, R is a tertiary alkyl group, or in preferred embodiments, a tertiary butyl group. X is —O—, —NH— or —S—. Each $R_{10}$ is independently an optionally substituted C1-C10 alkyl group, an optionally substituted aryl group, and optionally substituted alkoxy group, an optionally substituted carbonyl group, an optionally substituted alkoxycarbonyl group, an optionally substituted aryloxycarbonyl group, —OH, —SH or —$NH_2$; or two $R_{10}$ groups on adjacent carbon atoms join together to form an optionally substituted aromatic ring or an optionally substituted carbocyclic or heterocyclic non-aromatic ring. q is an integer from 0 to 2.

Repeat units of the antioxidant polymers as described immediately above which are suitable for use in the compositions and methods of the present invention include substituted benzene molecules. These benzene molecules are typically based on phenol or a phenol derivative, such that they have at least one hydroxyl or ether functional group. Preferably, the benzene molecules have a hydroxyl group. The hydroxyl group can be a free hydroxyl group and can be protected or have a cleavable group attached to it (e.g., an ester group). Such cleavable groups can be released under certain conditions (e.g., changes in pH), with a desired shelf life or with a time-controlled release (e.g., measured by the half-life), which allows one to control where and/or when an antioxidant polymer can exert its antioxidant effect. The repeat units can also include analogous thiophenol and aniline derivatives, e.g., where the phenol —OH can be replaced by —SH, —NH—, and the like.

Substituted benzene repeat units of an antioxidant polymer as described immediately above which are suitable for use in the compositions and methods of the present invention are also typically substituted with a bulky alkyl group or an n-alkoxycarbonyl group. Preferably, the benzene monomers are substituted with a bulky alkyl group. More preferably, the bulky alkyl group is located ortho or meta to a hydroxyl group on the benzene ring, typically ortho. A "bulky alkyl group" is defined herein as an alkyl group that is branched alpha- or beta- to the benzene ring. Preferably, the alkyl group is branched alpha to the benzene ring. More preferably, the alkyl group is branched twice alpha to the benzene ring, such as in a tert-butyl group. Other examples of bulky alkyl groups include isopropyl, 2-butyl, 3-pentyl, 1,1-dimethylpropyl, 1-ethyl-1-methylpropyl and 1,1-diethylpropyl. The bulky alkyl groups are preferably unsubstituted, but they can be substituted with a functional group that does not interfere with the antioxidant activity of the molecule or the polymer. Straight chained alkoxylcarbonyl groups include methoxycarbonyl, ethoxycarbonyl, n-propoxycarbonyl, n-butoxycarbonyl and n-pentoxycarbonyl. n-propoxycarbonyl is a preferred group. Similar to the bulky alkyl groups, n-alkoxycarbonyl groups are optionally substituted with a functional group that does not interfere with the antioxidant activity of the molecule or the polymer.

In another embodiment, the first antioxidants which are suitable for use in the compositions and methods of the present invention include a polymer comprising repeat units represented by one or both of Structural Formulas (i) and (ii):

(i)

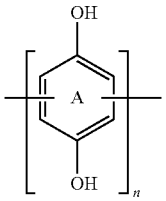

(ii)

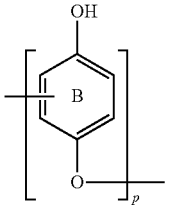

where:

Ring A is substituted with at least one tert-butyl group, and optionally one or more groups selected from the group consisting of a substituted or unsubstituted alkyl or aryl group, and a substituted or unsubstituted alkoxycarbonyl group;

Ring B is substituted with at least one —H and at least one tert-butyl group and optionally one or more groups selected from the group consisting of—a substituted or unsubstituted alkyl or aryl group, and a substituted or unsubstituted alkoxycarbonyl group;

n is an integer equal to or greater than 2; and p is an integer equal to or greater than 0.

In another embodiment, the first antioxidants which are suitable for use in the compositions and methods of the present invention are polymers represented by one or both of Structural Formulas (iv) and (v):

(iii)

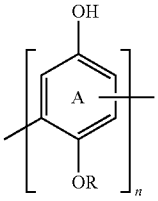

(iv)

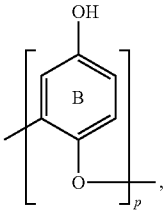

where Ring A is substituted with at least one tert-butyl group, and optionally one or more groups selected from the group consisting of a substituted or unsubstituted alkyl or aryl group, and a substituted or unsubstituted alkoxycarbonyl group; Ring B is substituted with at least one —H and at least one tert-butyl group and optionally one or more groups selected from the group consisting of a substituted or unsubstituted alkyl or aryl group, and a substituted or unsubstituted alkoxycarbonyl group; R is —H, an optionally substituted C1-C10 alkyl group, an aryl group, a benzyl group, or an acyl group n is an integer equal to or greater than 2; and p is an integer equal to or greater than 0. In one embodiment R is a C1-10 branched or linear alkyl group.

Antioxidant polymers as described immediately above which are suitable for use in the methods of the present invention have two or more repeat units, preferably greater than about five repeat units. The molecular weight of the polymers disclosed herein can be generally selected to be appropriate for the desired application. Typically, the molecular weight can be greater than about 500 atomic mass units (amu) and less than about 2,000,000 amu, greater than about 1,000 amu and less than about 100,000, greater than about 2,000 amu and less than about 10,000, or greater than about 2,000 amu and less than about 5,000 amu.

Antioxidant polymers as described immediately above which are suitable for use in the methods of the present invention can be either homopolymers or copolymers. A copolymer preferably contains two or more or three or more different repeating monomer units, each of which has varying or identical antioxidant properties. The identity of the repeat units in a copolymer can be chosen to modify the antioxidant properties of the polymer as a whole, thereby giving a polymer with tunable properties. The second, third and/or further repeat units in a copolymer can be either a synthetic or natural antioxidant.

Antioxidant polymers as described immediately above which are suitable for use in the methods of the present invention are typically insoluble in aqueous media. The solubility of the antioxidant polymers in non-aqueous media (e.g., oils) depends upon the molecular weight of the polymer, such that high molecular weight polymers are typically sparingly soluble in non-aqueous media. When an antioxidant polymer of the invention can be insoluble in a particular medium or substrate, it can be preferably well-mixed with that medium or substrate.

Antioxidant polymers as described immediately above which are suitable for use in the methods of the present invention can be branched or linear, but are preferably linear. Branched antioxidant polymers can only be formed from benzene molecules having three or fewer substituents (e.g., three or more hydrogen atoms), as in Structural Formulas (XX), (XXI) and (XXIV).

Another specific example of a repeat unit included in polymers which are suitable for use in the compositions and methods of the present invention is represented by the following structural formula:

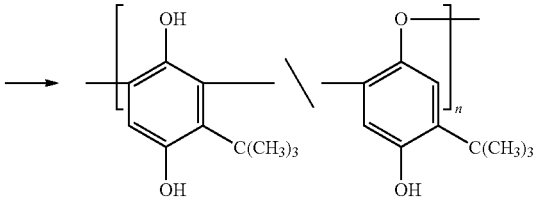

In another embodiment, the first antioxidant polymers which are suitable for use in the compositions and methods of the present invention includes a macromolecule which can be represented by one or both of Structural Formulas R and S:

R

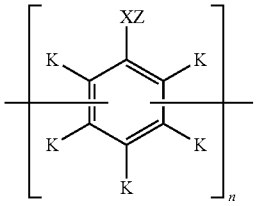

S

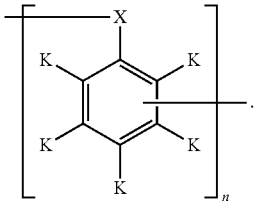

In Structural Formulas R and S, n is an integer equal to or greater than 2.

The variable X is O, NH, or S.

The variable Z is H.

Each variable K is independently —H or —OH, with at least one —OH adjacent to a —H; or K is a bond when that position is involved in the polymer chain.

In another embodiment, the first antioxidants which are suitable for use in the compositions and methods of the present invention includes a macromolecular antioxidant polymer represented by one or both of Structural Formulas T and V or T' and V':

T

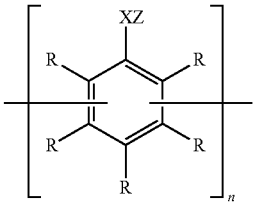

V

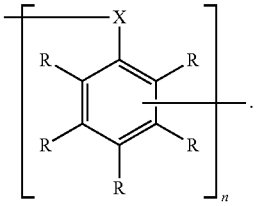

T'

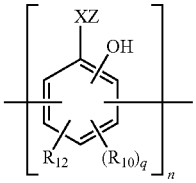

V'

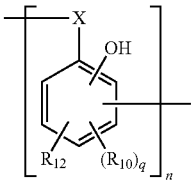

In Structural Formulas T, T', V and V', n is an integer equal to or greater than 2.

The variable X is O, NH, or S.

The variable Z is H.

Each variable R is independently —H, —OH, a C1-C10 alkyl group, or a bond when that position is involved in the polymer chain wherein at least one —OH is adjacent to a C1-C10 alkyl group, e.g., a tertiary butyl group.

Each $R_{10}$ is independently an optionally substituted C1-C10 alkyl group, an optionally substituted aryl group, and optionally substituted alkoxy group, an optionally substituted carbonyl group, an optionally substituted alkoxycarbonyl group, an optionally substituted aryloxycarbonyl group, —OH, —SH or —$NH_2$ or two $R_{10}$ groups on adjacent carbon atoms join together to form an optionally substituted aromatic ring or an optionally substituted carbocyclic or heterocyclic non-aromatic ring. q is an integer from 0 to 2. $R_{12}$ is a bulky alkyl group substituent bonded to a ring carbon atom adjacent (ortho) to a ring carbon atom substituted with an —OH group.

n is an integer equal to or greater than 2.

These macromolecular antioxidant polymers can contain, for example, tert-butylhydroquinone, 2,5-di-tert-butylhydroquinone, BHT type repeat units and their combinations. In some embodiments, of the macromolecular antioxidants described immediately above can be homopolymers, copolymers, terpolymers, and the like Substituted benzene repeat units of an antioxidant polymer as described immediately above which are suitable for use in the methods and compositions of the present invention are typically substituted with a bulky alkyl group or an n-alkoxycarbonyl group. Preferably, the benzene monomers are substituted with a bulky alkyl group. More preferably, the bulky alkyl group is located ortho or meta to a hydroxyl group on the benzene ring, typically ortho. A "bulky alkyl group" is defined herein as an alkyl group that is branched alpha- or beta- to the benzene ring. Preferably, the alkyl group is branched alpha to the benzene ring. More preferably, the alkyl group is branched twice alpha to the benzene ring, such as in a tert-butyl group. Other examples of bulky alkyl groups include isopropyl, 2-butyl, 3-pentyl, 1,1-dimethylpropyl, 1-ethyl-1-methylpropyl and 1,1-diethylpropyl. The bulky alkyl groups are preferably unsubstituted, but they can be substituted with a functional group that does not interfere with the antioxidant activity of the molecule or the polymer. Straight chained alkoxylcarbonyl groups include methoxycarbonyl, ethoxycarbonyl, n-propoxycarbonyl, n-butoxycarbonyl and n-pentoxycarbonyl. n-propoxycarbonyl is a preferred group. Similar to the bulky alkyl groups, n-alkoxycarbonyl groups are optionally substituted with a functional group that does not interfere with the antioxidant activity of the molecule or the polymer.

Antioxidant polymers as described immediately above which are suitable for use in the methods and compositions of the present invention have two or more repeat units, preferably greater than about five repeat units. The molecular weight of the polymers disclosed herein can be generally selected to be appropriate for the desired application. Typically, the molecular weight can be greater than about 500 atomic mass units (amu) and less than about 2,000,000 amu, greater than about 1,000 amu and less than about 100,000, greater than about 2,000 amu and less than about 10,000, or greater than about 2,000 amu and less than about 5,000 amu.

Antioxidant polymers as described immediately above which are suitable for use in the methods and compositions of the present invention can be either homopolymers or copolymers. A copolymer preferably contains two or more or three or more different repeating monomer units, each of which has varying or identical antioxidant properties. The identity of the repeat units in a copolymer can be chosen to modify the antioxidant properties of the polymer as a whole, thereby giving a polymer with tunable properties. The second, third and/or further repeat units in a copolymer can be either a synthetic or natural antioxidant.

Antioxidant polymers as described immediately above which are suitable for use in the methods and compositions of the present invention are typically insoluble in aqueous media. The solubility of the antioxidant polymers in non-aqueous media (e.g., oils) depends upon the molecular weight of the polymer, such that high molecular weight polymers are typically sparingly soluble in non-aqueous media. When an antioxidant polymer of the invention can be insoluble in a particular medium or substrate, it can be preferably well-mixed with that medium or substrate.

Antioxidant polymers as described immediately above which are suitable for use in the methods and compositions of the present invention can be branched or linear, but are preferably linear. Branched antioxidant polymers can only be formed from benzene molecules having three or fewer substituents (e.g., three or more hydrogen atoms), as in Structural Formulas (XX), (XXI) and (XXIV).

Specific examples of repeat units included in polymers which are suitable for use in the compositions and methods of the present invention are represented by one of the following structural formulas:

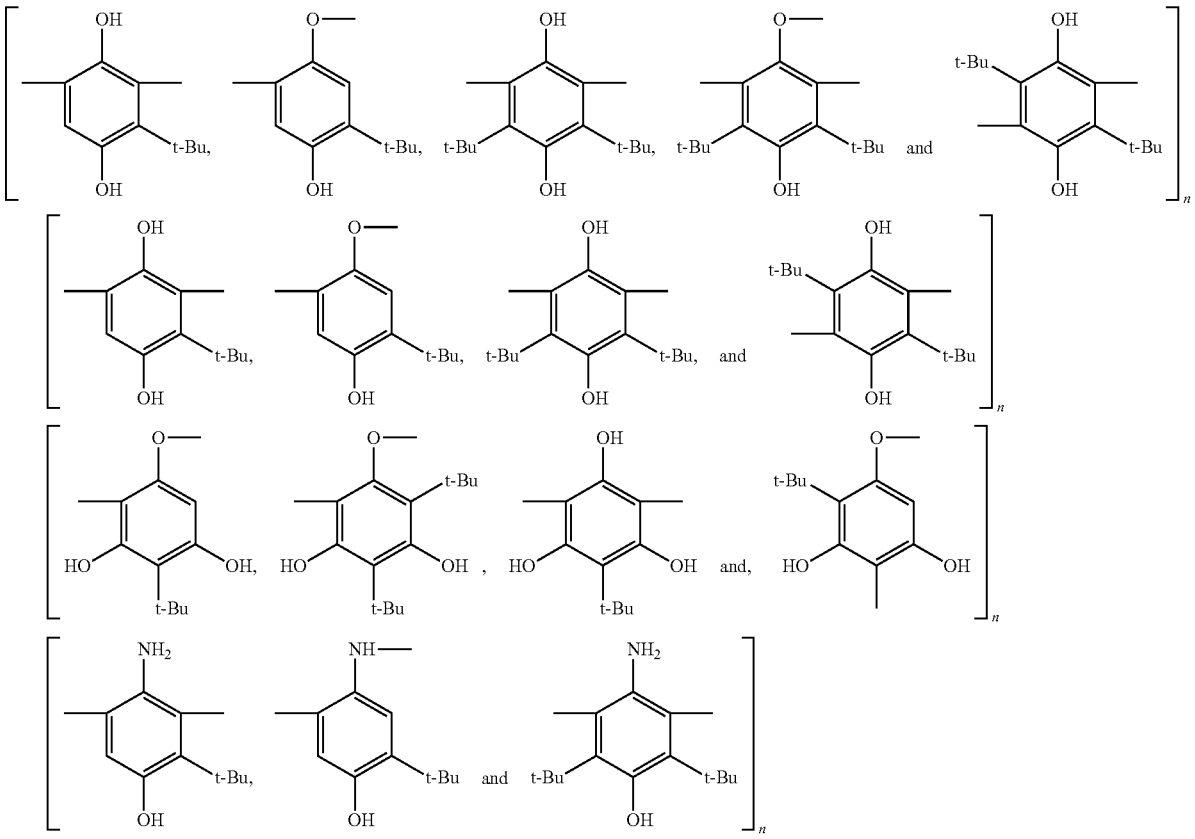

-continued

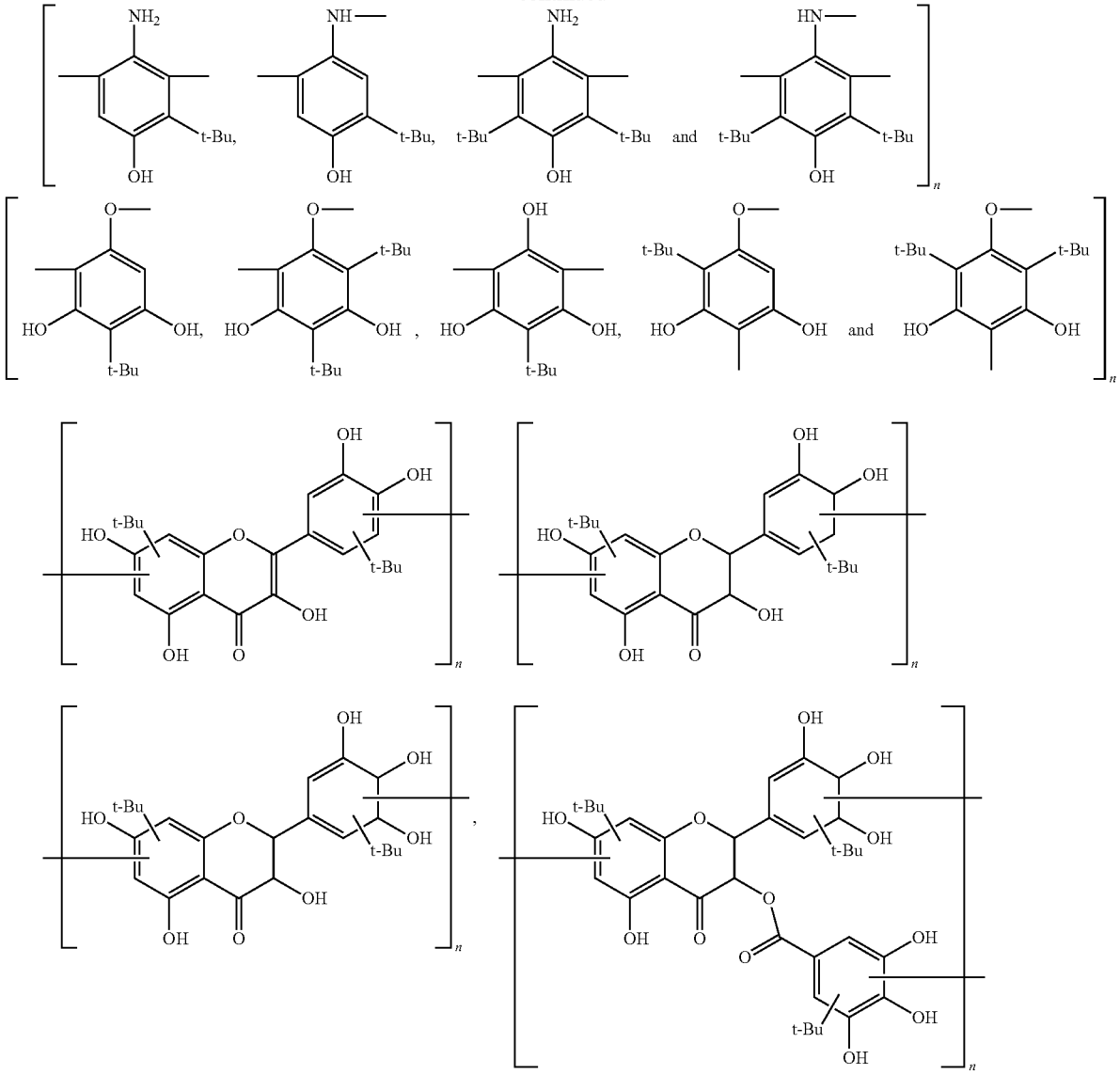

n is an integer equal to or greater than 2.

In another embodiment, the first antioxidants which are suitable for use in the compositions and methods of the present invention includes an antioxidant polymer represented by Structural Formula M or M'.

M

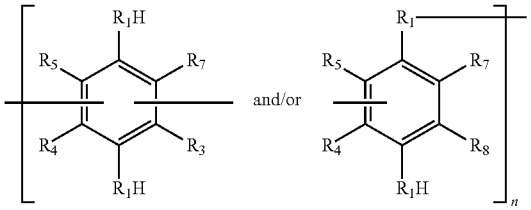

-continued

M'

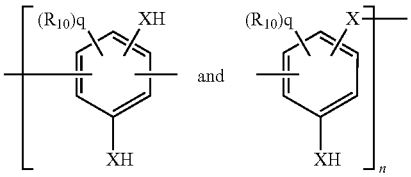

In Structural Formula M:

n is an integer equal to or greater than 2;

$R_1$ is O, S, or NH;

$R_4$, $R_5$, $R_7$ and $R_8$ are independently —H, —OH, —NH, —SH, a substituted or unsubstituted alkyl or aryl group, or a substituted or unsubstituted alkoxycarbonyl group, or a bond when part of the polymer chain, provided that:

(1) at least one of $R_4$, $R_5$, $R_7$ and $R_8$ is a tert-butyl group or a substituted or unsubstituted alkoxycarbonyl group, and at least two of $R_4$, $R_5$, $R_7$ and $R_8$ are —H; or (2) at least one of $R_4$, $R_5$, $R_7$ and $R_8$ is a tert-butyl group or a substituted or unsubstituted alkoxycarbonyl group, at least one of $R_4$, $R_5$, $R_7$ and $R_8$ is a hydroxyl, alkoxy, alkoxycarbonyl or aryloxycarbonyl group, and at least one of $R_4$, $R_5$, $R_7$ and $R_8$ is —H.

In structural formula M' each X is independently —O—, —NH— or —S—. Each $R_{10}$ is independently an optionally substituted C1-C10 alkyl group, an optionally substituted aryl group, and optionally substituted alkoxy group, an optionally substituted carbonyl group, an optionally substituted alkoxycarbonyl group, an optionally substituted aryloxycarbonyl group, —OH, —SH or —$NH_2$; and/or two $R_{10}$ groups on adjacent carbon atoms join together to form an optionally substituted aromatic ring or an optionally substituted carbocyclic or heterocyclic non-aromatic ring. q is an integer from 0 to 2. n is an integer greater than or equal to 2.

Substituted benzene repeat units of an antioxidant polymer as described immediately above which are suitable for use in the methods and compositions of the present invention are also typically substituted with a bulky alkyl group or an n-alkoxycarbonyl group. Preferably, the benzene monomers are substituted with a bulky alkyl group. More preferably, the bulky alkyl group is located ortho or meta to a hydroxyl group on the benzene ring, typically ortho. A "bulky alkyl group" is defined herein as an alkyl group that is branched alpha- or beta- to the benzene ring. Preferably, the alkyl group is branched alpha to the benzene ring. More preferably, the alkyl group is branched twice alpha to the benzene ring, such as in a tert-butyl group. Other examples of bulky alkyl groups include isopropyl, 2-butyl, 3-pentyl, 1,1-dimethylpropyl, 1-ethyl-1-methylpropyl and 1,1-diethylpropyl. The bulky alkyl groups are preferably unsubstituted, but they can be substituted with a functional group that does not interfere with the antioxidant activity of the molecule or the polymer. Straight chained alkoxylcarbonyl groups include methoxycarbonyl, ethoxycarbonyl, n-propoxycarbonyl, n-butoxycarbonyl and n-pentoxycarbonyl. n-propoxycarbonyl is a preferred group. Similar to the bulky alkyl groups, n-alkoxycarbonyl groups are optionally substituted with a functional group that does not interfere with the antioxidant activity of the molecule or the polymer.

Antioxidant polymers as described immediately above which are suitable for use in the methods and compositions of the present invention have two or more repeat units, preferably greater than about five repeat units. The molecular weight of the polymers disclosed herein can be generally selected to be appropriate for the desired application. Typically, the molecular weight can be greater than about 500 atomic mass units (amu) and less than about 2,000,000 amu, greater than about 1,000 amu and less than about 100,000, greater than about 2,000 amu and less than about 10,000, or greater than about 2,000 amu and less than about 5,000 amu.

Antioxidant polymers as described immediately above which are suitable for use in the methods and compositions of the present invention can be either homopolymers or copolymers. A copolymer preferably contains two or more or three or more different repeating monomer units, each of which has varying or identical antioxidant properties. The identity of the repeat units in a copolymer can be chosen to modify the antioxidant properties of the polymer as a whole, thereby giving a polymer with tunable properties. The second, third and/or further repeat units in a copolymer can be either a synthetic or natural antioxidant.

Antioxidant polymers as described immediately above which are suitable for use in the methods and compositions of the present invention are typically insoluble in aqueous media. The solubility of the antioxidant polymers in non-aqueous media (e.g., oils) depends upon the molecular weight of the polymer, such that high molecular weight polymers are typically sparingly soluble in non-aqueous media. When an antioxidant polymer of the invention can be insoluble in a particular medium or substrate, it can be preferably well-mixed with that medium or substrate.

Antioxidant polymers as described immediately above which are suitable for use in the methods and compositions of the present invention can be branched or linear, but are preferably linear. Branched antioxidant polymers can only be formed from benzene molecules having three or fewer substituents (e.g., three or more hydrogen atoms), as in Structural Formulas (XX), (XXI) and (XXIV).

In another embodiment, the first antioxidants which are suitable for use in the compositions and methods of the present invention include a polymer having at least one repeat unit that is represented by a structure selected from the group consisting of Structural Formulas (A), (B), (C), (D) and combinations thereof:

(A)

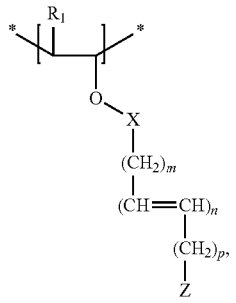

(B)

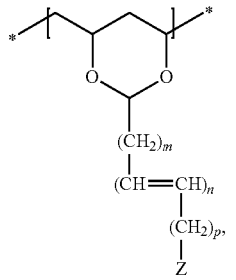

(C)

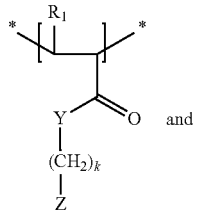

and (D)

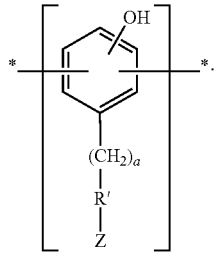

R' is a covalent bond, —O—, —C(O)O—, —C(O)N—, —C(O)—, —CH=CH—, —S— or —N—.

$R_1$ is —H or an alkyl group, or —$(CH_2)_k$—O—X—Z. Typically, $R_1$ is —H or alkyl.

Each X is independently a covalent bond, —C(O)—, —C(O)O— or —C(O)N—.

Y is —O—, —N— or —S—.

Each Z is an independently selected antioxidant.

a is an integer from 0 to 12.

Each k is independently an integer from 0 to 12.

m is an integer from 0 to 6.

n is 0 or 1.

p is an integer from 0 to 6.

In one embodiment, the polymer does not include cyclic anhydride repeat units.

An antioxidant can be attached to the polymer by one or more linkages or bonds. Examples of suitable linkages include acetal, amide, amine, carbamate, carbonate, ester, ether and thioether linkage. Carbon-carbon bonds can be also suitable. As used herein, an amide is distinguished from a diacyl hydrazide.

There are many examples of polymers that can be derivatized with an antioxidant. One type of such polymer has pendant hydroxyl groups, such as poly(vinyl alcohol) and copolymers thereof (e.g., poly(ethylene-co-vinyl alcohol)). The hydroxyl groups of poly(vinyl alcohol), a polyhydroxyalkyl methacrylate (e.g., polyhydroxy methyl methacrylate), and poly(ethylene-co-vinyl alcohol) react with an antioxidant to form the derivatized antioxidant polymer. Another type of derivatizable polymer contains pendant carboxylic acid groups or esters thereof, such as poly(acrylic acid), poly(alkylacrylic acid) and esters thereof. Poly(acrylic acid) is a preferred polymer; the carboxylic acid groups of poly (acrylic acid) can be derivatized, although carboxylic acid groups generally require activation before derivatization can occur.

An additional type of derivatizable polymer can be a poly(substituted phenol), where the substituted phenol has a substituent with a nucleophilic or electrophilic moiety. Such poly(substituted phenols) can include repeat units represented by the following structural formulas:

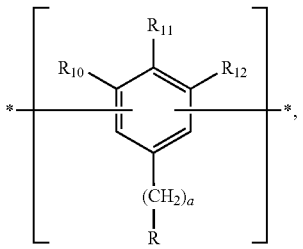

where a is an integer from 0 to 12; R is —OH, —COOH, —$NH_2$, —SH or a halogen; and $R_{10}$, $R_{11}$ and $R_{12}$ are each independently —H, —OH, —$NH_2$ or —SH, provided that at least one of $R_{10}$, $R_{11}$ and $R_{12}$ is —OH, —$NH_2$ or —SH. Preferably, one of $R_{10}$, $R_{11}$ and $R_{12}$ is —OH and the remaining two are optionally —H. More preferably, $R_{11}$ is —OH and $R_{10}$ and $R_{12}$ are —H.

The derivatizable polymers can be homopolymers or copolymers. Copolymers include, for example, block, star, hyperbranched, random, gradient block, and alternate copolymers. The derivatizable polymers can be branched or linear, but are preferably linear.

In copolymers, it is only necessary for one repeat unit to include a pendant reactive group. Second and further repeat units of a copolymer can optionally include a pendant reactive group. For example, about 1% to 100%, such as 10% to 50% or 50% to 100%, of the repeat units of a polymer include pendant functional groups.

All or a fraction of the pendant reactive groups of a derivatizable polymer can be derivatized with an antioxidant. In one example, about 100% of the pendant reactive groups can be derivatized. In another example, about 5% to about 90%, such as about 20% to about 80% (e.g., about 50% to about 80%) of the pendant reactive groups can be derivatized.

These polymers can be minimally derivatized with a single type of antioxidant, but can be derivatized with two or more antioxidants (e.g., chemically distinct antioxidants). When there can be two or more antioxidants, they can be in the same class, as described below, or can be in different classes. The ratio of antioxidants can be varied in order to obtain a polymer having a desired set of properties. For example, when a polymer can be derivatized with two antioxidants, the ratio of a first antioxidant to a second antioxidant can be from about 20:1 to about 1:20, such as from about 5:1 to about 1:5 (e.g., about 1:1).

Many antioxidants can be suitable, provided that they can be attached to a polymer and retain their antioxidant activity. One class of suitable antioxidants can be phenolic antioxidants. Phenolic antioxidants typically have one or more bulky alkyl groups (alkyl groups having a secondary or tertiary carbon alpha to the phenol ring) ortho or meta, preferably ortho, to the phenol hydroxyl group. Phenolic antioxidants can alternatively have an alkylenedioxy substituent, an alkoxycarbonyl substituent, a 1-propenyl-3-carboxylic acid substituent or an ester thereof. A preferred bulky alkyl group is a tert-butyl group. The phenol hydroxyl group can be protected by a removable protecting group (e.g., an acyl group). Phenolic antioxidants for use in the present invention also generally have a substituent that can react with the pendant reactive group of one of the polymers described above to form a covalent bond between the antioxidant and the polymer.

One group of suitable phenolic antioxidants can be represented by Structural Formula (E):

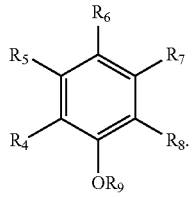

(E)

$R_9$ is —H or a substituted or unsubstituted alkyl, acyl or aryl group, preferably —H or an acyl group.

$R_4$, $R_5$, $R_6$, $R_7$ and $R_8$ are independently chosen substituent groups, such that at least one substituent can be a substituted or unsubstituted alkyl or aryl group, a substituted or unsubstituted alkoxycarbonyl group, a substituted or unsubstituted alkylenedioxy group, a 1-propenyl-3-carboxylic acid group or an ester thereof. Also, at least one of $R_4$, $R_5$, $R_6$, $R_7$ and $R_8$ must be a substituent capable of reacting with the pendant reactive group of the polymers described above, such as a substituent having a nucleophilic or electrophilic moiety. Other suitable substituents include, for example, —H, —OH, —NH and —SH. A substituent should not decrease the antioxidant activity more than two-fold; instead, substituents preferably increase the antioxidant activity of the molecule.

Specific examples of phenolic antioxidants that can be attached to a polymer include phenolic antioxidant can be selected from the group consisting of 3-(3,5-di-tert-butyl-4-hydroxyphenyl) propionic acid, 3,5-di-tert-butyl-4-hydroxybenzenethiol, 2-(3,5-di-tert-butyl-4-hydroxyphenyl)acetic acid, 3,5-di-tert-butyl-4-hydroxybenzoic acid, 3,5-di-tert-butyl-4-hydroxycinnamic acid, gallic acid, alkyl gallates, 3,5-di-tert-butyl-4-hydroxybenzyl alcohol, tert-butyl-hydroquinone, 2,5-di-tert-butyl-hydroquinone, 2,6-di-tert-butyl-hydroquinone, 3,5-di-tert-butyl-4-hydroxybenzaldehyde, monoacetoxy-tert-butylhydroquinone, sesamol, isoflavones, flavanoids and coumarins.

Another antioxidant that can be attached to one of the polymers described immediately above can be ascorbic acid or a molecule that contains an ascorbic acid moiety. Typically, ascorbic acid attached to a polymer has the following configuration:

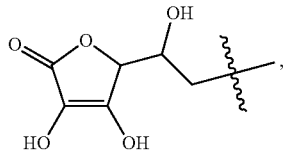

where this moiety can be attached to the polymer by an ether or ester linkage.

Polymers described immediately above which are suitable for use in the compositions and methods of the present invention can be homopolymers or copolymers. One type of copolymer includes ethylene repeat units, particularly in a copolymer containing repeat units represented by Structural Formula (A) and/or Structural Formula (B).

In one embodiment of the invention, a polymer comprises repeat units represented by Structural Formula (A). In a first group of such polymers, the sum of m and p is typically two or greater. When the sum of m and p is greater than two, Z is typically a phenolic antioxidant, as described above. One preferred phenolic antioxidant is a 3,5-di-tert-butyl-4-hydroxyphenyl group, particularly when X is —C(O)—. For these values of X and Z, m is preferably 2 and n and p are each 0. A second preferred antioxidant is a 3,4,5-trihydroxyphenyl group, particularly when X is —C(O)—. Other preferred antioxidants are mono and di-tert-butylated-4-hydroxyphenyl groups, 4-acetoxy-3-tert-butylphenyl groups and 3-alkoxycarbonyl-2,6-dihydroxyphenyl groups (e.g., 3-propoxycarbonyl-2,6-dihydroxyphenyl groups), particularly when X is a covalent bond.

In a second set of these polymer having repeat units represented by Structural Formula (A), m and p are each 0. When m and p are 0, n is also typically 0. For these values of m, n and p, Z is typically ascorbic acid. X is typically a covalent bond. Alternatively, Z is a 3,4,5-trihydroxyphenyl group or a 4-acetoxy-3-tert-butylphenyl group, particularly when X is —C(O)—.

In another embodiment of the invention, an antioxidant polymer has repeat units represented by Structural Formula (B). For these polymers, m, n and p are each typically 0. Z is preferably a phenolic antioxidant, specifically a 3,4,5-trihydroxyphenyl, 3,5-di-tert-butyl-4-hydroxyphenyl group or a 3,5-di-tert-butyl-2-hydroxyphenyl group.

A further embodiment of the invention involves polymers that include repeat units represented by Structural Formula (C). In one group of such polymers, Y is –0- and Z is preferably ascorbic acid, particularly when k is 0. In another group, Y is –0- and Z is a phenolic antioxidant, particularly when k is 0 to 3; more preferably, k is 1. A preferred phenolic antioxidant is a 3,5-di-tert-butyl-4-hydroxyphenyl group. Other examples include of phenolic antioxidants include 4-acetoxy-3-tert-butylphenyl, 3-tert-butyl-4-hydroxyphenyl, 2,6-di-tert-butyl-4-mercaptophenyl and 2,6-di-tert-butyl-4-hydroxyphenyl groups.

In yet another embodiment of the invention, a polymer includes repeat units represented by Structural Formula (D). Typically, R' is a covalent bond or —OH in such polymers. Other typical values of R' are amide and ester linkages. Preferred Z groups can be phenolic antioxidants, as described above. For these polymers, the phenol hydroxyl group is typically para or meta to the group containing Z, more typically para.

Antioxidant polymers described immediately above which are suitable for use in the methods of the present invention have two or more repeat units, preferably greater than about five repeat units. The molecular weight of the polymers disclosed herein can be generally selected to be appropriate for the desired application. Typically, the molecular weight can be greater than about 500 atomic mass units (amu) and less than about 2,000,000 amu, greater than about 1000 amu and less than about 1,000,000 amu, greater than about 1000 amu and less than about 100,000 amu, greater than about 2,000 amu and less than about 10,000 amu, or greater than about 2,000 amu and less than about 5,000 amu.

Antioxidant polymers described immediately above which are suitable for use in the methods of the present invention can be typically insoluble in aqueous media. The solubility of the antioxidant polymers in non-aqueous media (e.g., oils) depends upon the molecular weight of the polymer, such that high molecular weight polymers can be typically sparingly soluble in non-aqueous media. When an antioxidant polymer of the invention can be insoluble in a particular medium or substrate, it can be preferably well-mixed with that medium or substrate.

In another embodiment, the first antioxidants which are suitable for use in the compositions and methods of the present invention are represented by the following structural formula:

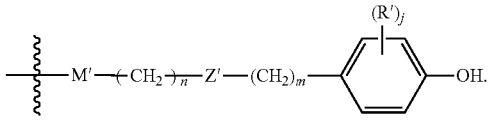

n and m in each occurrence, independently is 0 or a positive integer. Preferably 0 to 18 inclusive.

j in each occurrence, independently is 0, 1, 2, 3 or 4.

Z' in each occurrence, independently is —C(O)O—, —OC(O)—, —C(O)NH—, —NHC(O)—, —NH—, —CH=N—, —N=CH—, —C(O)—, —O—, —S—, —S—S—, —S=N—, —N=S—, —C(S)O—, —OC(S), —OP(O)($OR_4$)O—, OP($OR_4$)O—, —C(O)OC(O)— or a bond. In one embodiment, Z' is —C(O)O—.

R' in each occurrence, independently is C1-C6 alkyl, —OH, —$NH_2$, —SH, an optionally substituted aryl, an optionally substituted ester or

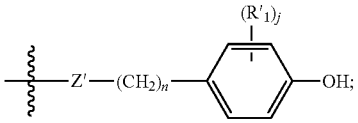

wherein at least one R' adjacent to the —OH group is an optionally substituted bulky alkyl group (e.g., butyl, sec-butyl, tert-butyl, 2-propyl, 1,1-dimethylhexyl, and the like).

$R'_1$ in each occurrence, independently is C1-C6 alkyl, an optionally substituted aryl, an optionally substituted aralkyl, —OH, —$NH_2$, —SH, or C1-C6 alkyl ester wherein at least one $R_1$ adjacent to the —OH group is a bulky alkyl group (e.g., butyl, sec-butyl, tert-butyl, 2-propyl, 1,1-dimethylhexyl, and the like).).

M' is H, an optionally substituted aryl, C1-C20 linear or branched alkyl chain with or without any functional group anywhere in the chain,

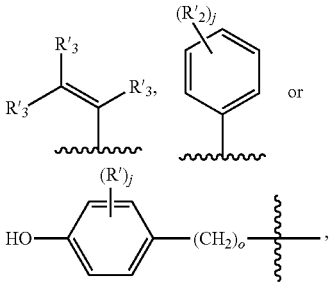

o is 0 or a positive integer, $R'_2$ in each occurrence, independently is —H, C1-C6 alkyl, —OH, —$NH_2$, —SH, optionally substituted aryl, ester, or

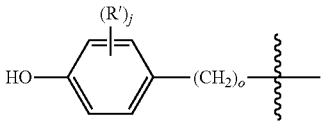

wherein at least one $R'_2$ is —OH.

$R'_3$ in each occurrence, independently is —H, C1-C6 alkyl, optionally substituted aryl, optionally substituted aralkyl —OH, —$NH_2$, —SH or ester.

In another embodiment, the first antioxidants which are suitable for use in the compositions and methods of the present invention are represented by the following structural formula:

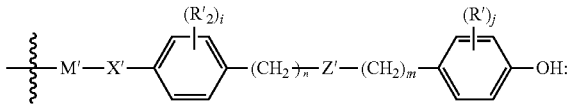

X' in each occurrence, independently is —C(O)O—, —OC(O)—, —C(O)NH—, —NHC(O)—, —NH—, —CH═N—, —C(O)—, —O—, —S—, —C(O)OC(O)— or a bond.

$R'_2$ is C1-C6 alkyl, —OH, —$NH_2$, —SH, aryl, ester, or

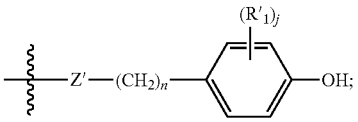

wherein at least one $R'_2$ is —OH, and the values and preferred values for the remainder of the variables are as described immediately above.

In certain embodiments Z' is —C(O)O—. In certain other embodiments Z' is —OC(O)—. In certain other embodiments Z' is —C(O)NH—. In certain other embodiments Z' is —NHC(O)—. In certain other embodiments Z' is —NH—. In certain other embodiments Z' is —CH═N—. In certain other embodiments Z' is —N═CH—. In certain other embodiments Z' is —C(O)—. In certain other embodiments Z' is —O—. In certain other embodiments Z' is —S—. In certain other embodiments Z' is —S—S—. In certain other embodiments Z' is —S═N—. In certain other embodiments Z' is —N═S—. In certain other embodiments Z' is —C(S)O—. In certain other embodiments Z' is —OC(S)—. In certain other embodiments Z' is —OP(O)($OR_4$)O—. In certain other embodiments Z' is OP($OR_4$)O—. In certain other embodiments Z' is —C(O)OC(O)—. In certain other embodiments Z' is a bond.

In certain embodiments both R' groups adjacent to the —OH group is an optionally substituted bulky alkyl group. In a particular embodiment both R' groups adjacent to the —OH group are tert-butyl.

In certain embodiments M' is

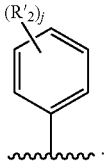

In certain embodiments M' is

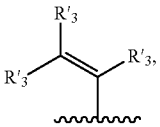

In certain embodiments, at least one R' is

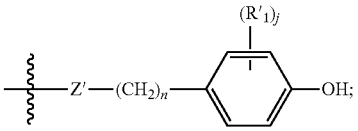

In certain embodiments n is 0.

In certain embodiments m is 1.

In certain embodiments n is 0, m is 1 and Z is —C(O)O—.

In certain embodiments n is 0, m is 1, Z is —C(O)O— and the two R' groups adjacent to the —OH are t-butyl.

In certain embodiments n is 0, m is 1, Z is —C(O)O—, the two R' groups adjacent to the —OH are t-butyl and M' is

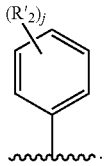

In certain embodiments n is 0, m is 1, Z is —C(O)O—, the two R' groups adjacent to the —OH are t-butyl, M' is

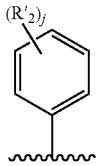

and the $R'_2$ in the para position is —OH.

In certain embodiments n is 0, m is 1, Z is —C(O)O—, the two R' groups adjacent to the —OH are t-butyl, M' is

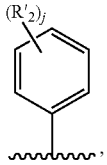

the $R'_2$ in the para position is —OH and an adjacent $R'_2$ is —OH.

In certain embodiments n is 0, m is 1, Z is —C(O)O—, the two R' groups adjacent to the —OH are t-butyl, M' is

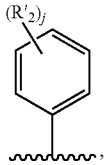

the $R'_2$ in the para position is —OH and the two adjacent $R'_2$ are —OH.

In certain embodiments n is 0, m is 1, Z is —C(O)O—, the two R' groups adjacent to the —OH are t-butyl, M' is

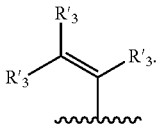

In certain embodiments n is 0, m is 1, Z is —C(O)O—, the two R' groups adjacent to the —OH are t-butyl, M' is

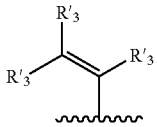

and $R_3$ is —H.

Specific examples of compounds and polymers which are suitable for use in the compositions and methods of the present invention are represented by one of the following structural formulas:

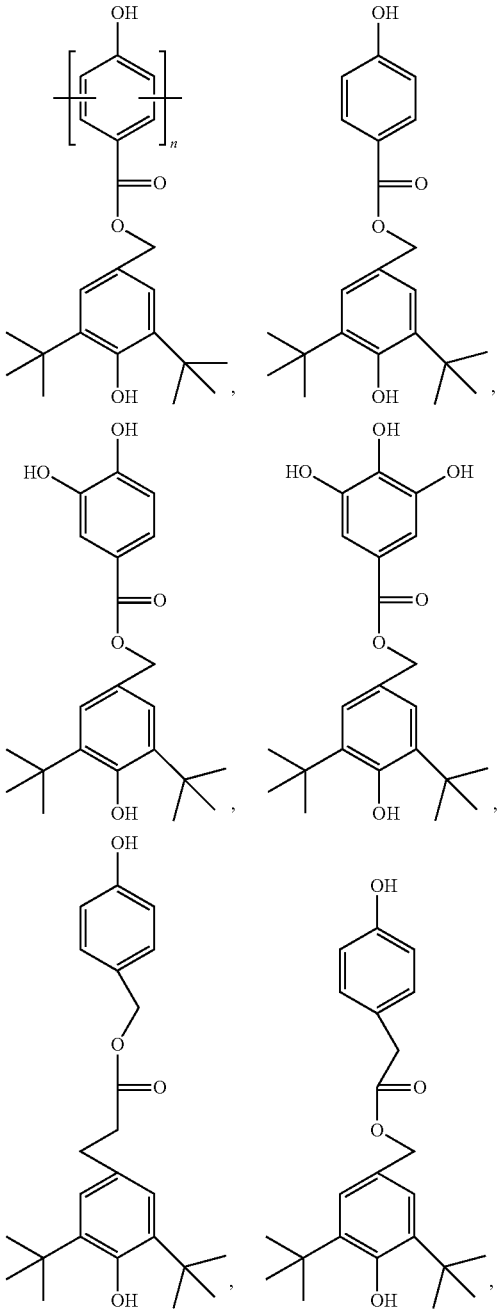

-continued

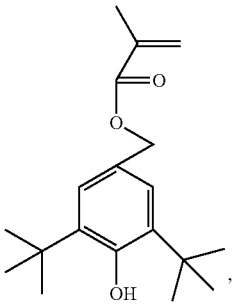

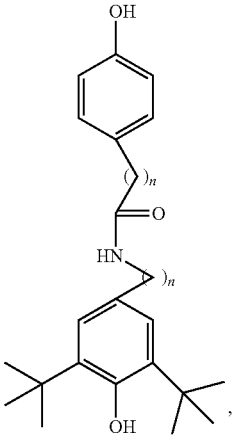

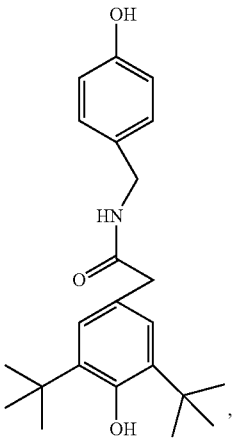

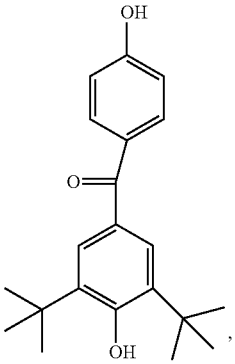

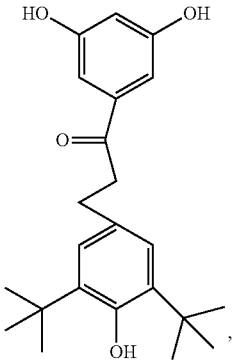

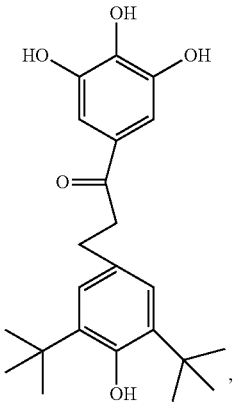

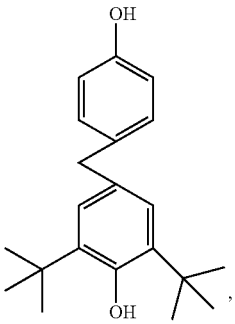

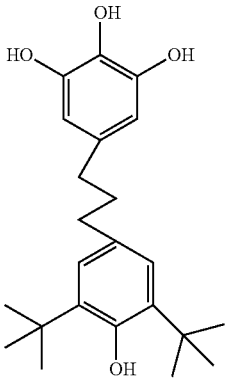

and

-continued

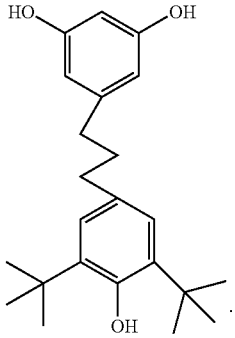

In another embodiment, the first antioxidants which are suitable for use in the compositions and methods of the present invention include a macromonomer represented by Structural Formula I and I'.

I

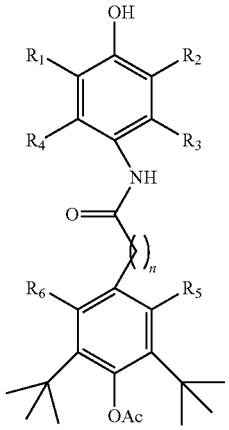

In I, R and $R_1$-$R_6$ are independently —H, —OH, or a C1-C10 optionally substituted linear or branched alkyl group. n is an integer from 0 to 24.

I'

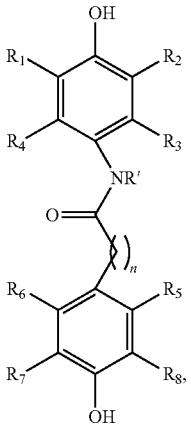

In I', each of R and $R_1$-$R_8$ are independently —H, —OH, or a C1-C10 alkyl group. n is an integer from 0 to 24. R' is —H, optionally substituted C1-C20 alkyl or optionally substituted aryl group.

In another embodiment, the first antioxidants which are suitable for use in the compositions and methods of the present invention include a macromonomer represented by Structural Formula III and an antioxidant polymer represented by Structural Formula IV. The variables are as defined above.

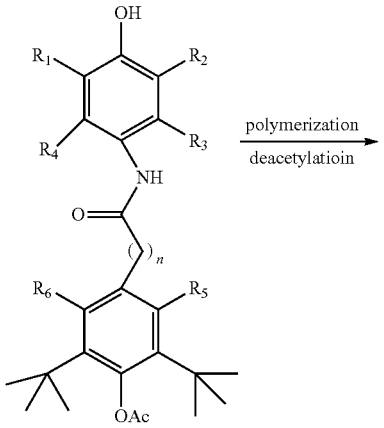

III

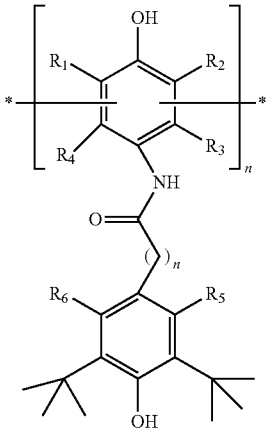

IV

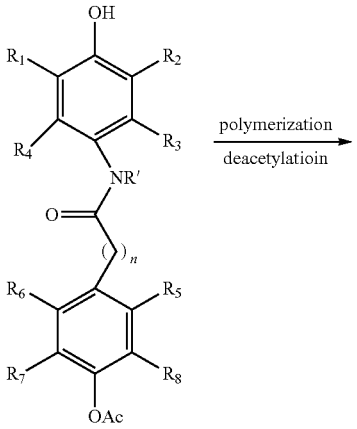

III'

-continued

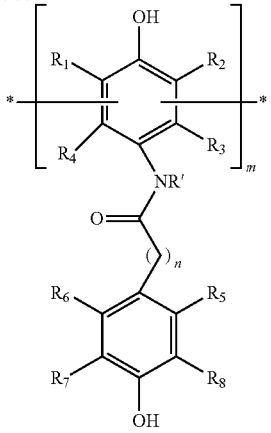

IV'

In III' and IV' each of R, and $R_1$-$R_8$ are independently —H, —OH, or a C1-C10 alkyl group. n is an integer from 0 to 24. m is an integer equal to 2 or greater. R' is —H, optionally substituted C1-C20 alkyl or optionally substituted aryl group. In III and IV the variables are as defined above.

Repeat units of the antioxidant polymers as described immediately above suitable for use in the compositions and methods of the present invention include substituted benzene molecules. These benzene molecules are typically based on phenol or a phenol derivative, such that they have at least one hydroxyl or ether functional group. Preferably, the benzene molecules have a hydroxyl group. The hydroxyl group can be a free hydroxyl group and can be protected or have a cleavable group attached to it (e.g., an ester group). Such cleavable groups can be released under certain conditions (e.g., changes in pH), with a desired shelf life or with a time-controlled release (e.g., measured by the half-life), which allows one to control where and/or when an antioxidant polymer can exert its antioxidant effect. The repeat units can also include analogous thiophenol and aniline derivatives, e.g., where the phenol —OH can be replaced by —SH, —NH—, and the like.

Substituted benzene repeat units of an antioxidant polymer as described immediately above suitable for use in the compositions and methods of the present invention are also typically substituted with a bulky alkyl group or an n-alkoxycarbonyl group. Preferably, the benzene monomers are substituted with a bulky alkyl group. More preferably, the bulky alkyl group is located ortho or meta to a hydroxyl group on the benzene ring, typically ortho. A "bulky alkyl group" is defined herein as an alkyl group that is branched alpha- or beta- to the benzene ring. Preferably, the alkyl group is branched alpha to the benzene ring. More preferably, the alkyl group is branched twice alpha to the benzene ring, such as in a tert-butyl group. Other examples of bulky alkyl groups include isopropyl, 2-butyl, 3-pentyl, 1,1-dimethylpropyl, 1-ethyl-1-methylpropyl and 1,1-diethylpropyl. The bulky alkyl groups are preferably unsubstituted, but they can be substituted with a functional group that does not interfere with the antioxidant activity of the molecule or the polymer. Straight chained alkoxylcarbonyl groups include methoxycarbonyl, ethoxycarbonyl, n-propoxycarbonyl, n-butoxycarbonyl and n-pentoxycarbonyl. n-propoxycarbonyl is a preferred group. Similar to the bulky alkyl groups, n-alkoxycarbonyl groups are optionally substituted with a functional group that does not interfere with the antioxidant activity of the molecule or the polymer.

Antioxidant polymers as described immediately above suitable for use in the compositions and methods of the present invention have two or more repeat units, preferably greater than about five repeat units. The molecular weight of the polymers disclosed herein can be generally selected to be appropriate for the desired application. Typically, the molecular weight can be greater than about 500 atomic mass units (amu) and less than about 2,000,000 amu, greater than about 1000 amu and less than about 100,000, greater than about 2,000 amu and less than about 10,000, or greater than about 2,000 amu and less than about 5,000 amu.

Antioxidant polymers as described immediately above suitable for use in the compositions and methods of the present invention can be either homopolymers or copolymers. A copolymer preferably contains two or more or three or more different repeating monomer units, each of which has varying or identical antioxidant properties. The identity of the repeat units in a copolymer can be chosen to modify the antioxidant properties of the polymer as a whole, thereby giving a polymer with tunable properties. The second, third and/or further repeat units in a copolymer can be either a synthetic or natural antioxidant.

Antioxidant polymers as described immediately above suitable for use in the compositions and methods of the present invention are typically insoluble in aqueous media. The solubility of the antioxidant polymers in non-aqueous media (e.g., oils) depends upon the molecular weight of the polymer, such that high molecular weight polymers are typically sparingly soluble in non-aqueous media. When an antioxidant polymer of the invention can be insoluble in a particular medium or substrate, it can be preferably well-mixed with that medium or substrate.

Antioxidant polymers as described immediately above suitable for use in the compositions and methods of the present invention can be branched or linear, but are preferably linear. Branched antioxidant polymers can only be formed from benzene molecules having three or fewer substituents (e.g., three or more hydrogen atoms).

In another embodiment, the antioxidants which are suitable for use in the compositions and methods of the present invention include macromolecule antioxidants represented by Structural Formula J or J':

J

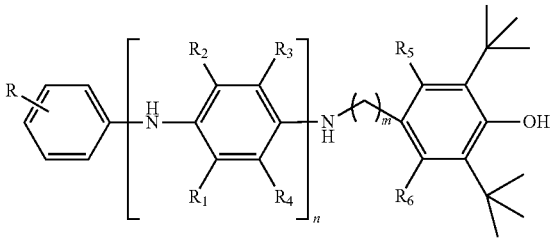

In J, R and $R_1$-$R_6$ are independently —H, —OH, or a C1-C10 optionally substituted linear or branched alkyl group. n is an integer from 0 to 24.

J'

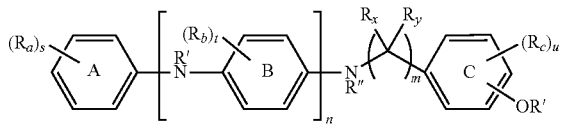

In J' Each $R_a$ is independently an optionally substituted alkyl. Each $R_b$ is independently an optionally substituted alkyl. Each $R_c$ is independently an optionally substituted alkyl or an optionally substituted alkoxycarbonyl. $R_x$ is —H or an optionally substituted alkyl. $R_y$ is —H or an optionally substituted alkyl. Each R' is independently —H or an optionally substituted alkyl. R" is —H, an optionally substituted alkyl, an optionally substituted aryl or an optionally substituted aralkyl. n is an integer from 1 to 10. m is an integer from 1 to 10. s is an integer from 0 to 5. t is an integer from 0 to 4. u is an integer from 1 to 4. With the proviso that when n is 1, then either ring C is not:

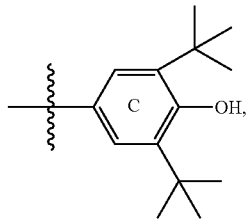

s is not 0, or R" is not —H.

Specific examples of macromolecule antioxidants represented by Structural Formula J which are suitable for use in the compositions and methods of the present invention are represented by one of the following structural formulas:

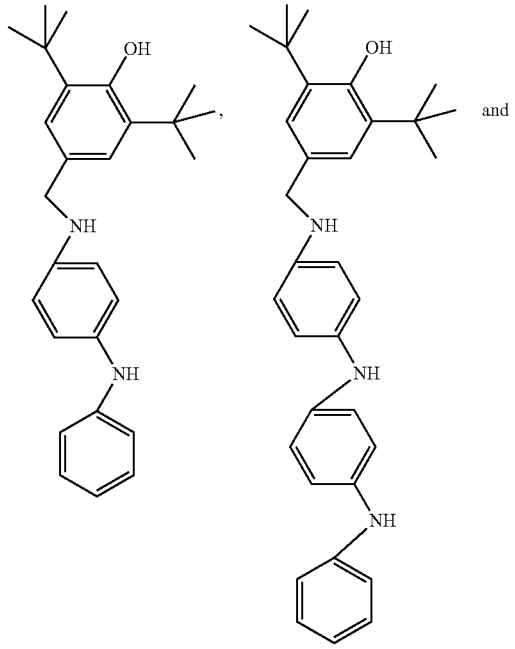

-continued

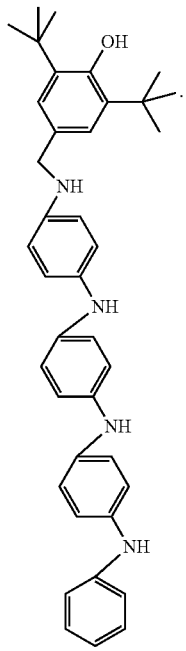

In another embodiment, the antioxidants which are suitable for use in the compositions and methods of the present invention include macromolecular antioxidants represented by structural formula $J^1$:

$J^1$

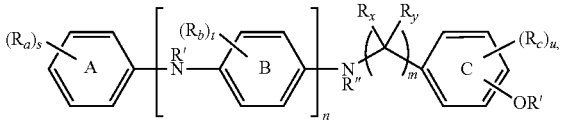

Each $R_a$ is independently an optionally substituted alkyl. Each $R_b$ is independently an optionally substituted alkyl. Each $R_c$ is independently an optionally substituted alkyl or an optionally substituted alkoxycarbonyl. $R_x$ is —H or an optionally substituted alkyl. $R_y$ is —H or an optionally substituted alkyl. Each R' is independently —H or an optionally substituted alkyl. R" is —H, an optionally substituted alkyl, an optionally substituted aryl or an optionally substituted aralkyl. n is an integer from 1 to 10. m is an integer from 1 to 10. s is an integer from 0 to 5. t is an integer from 0 to 4. u is an integer from 1 to 4. With the proviso that when n is 1, then either ring C is not:

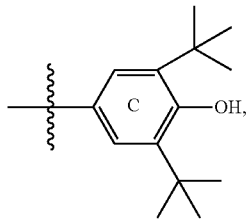

s is not 0, or R" is not —H.

In one embodiment the variables in $J^1$ are as described as follows:

Each $R_a$ is independently an optionally substituted alkyl. In one embodiment, each $R_a$ is independently a C1-C20 alkyl. In another embodiment, each $R_a$ is independently a C1-C10 alkyl. In another embodiment, each $R_a$ is independently selected from the group consisting of:

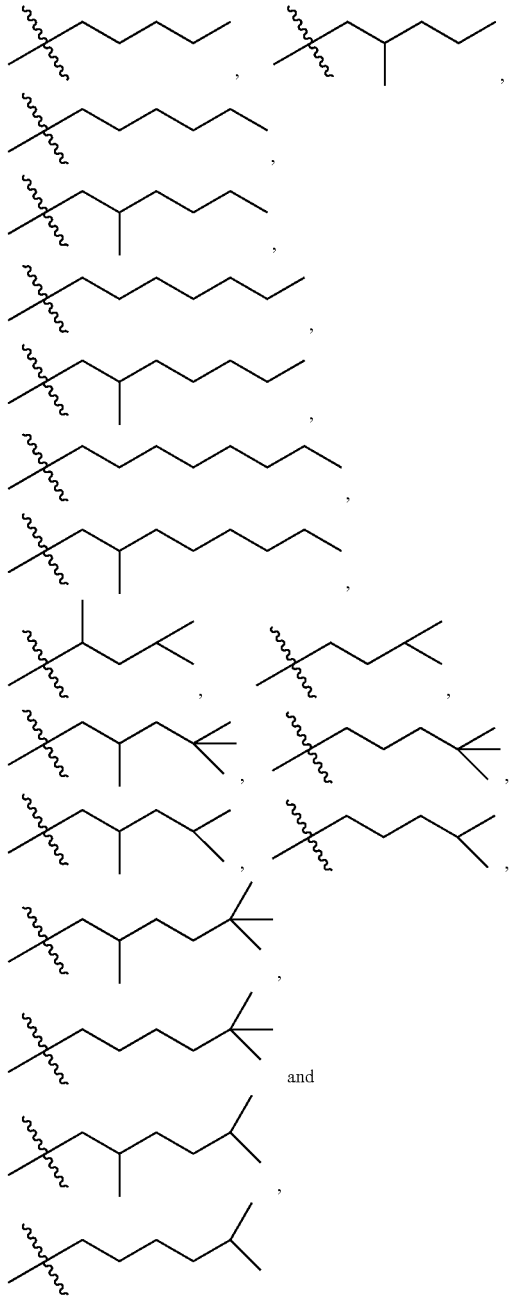

In another embodiment $R_a$ is:

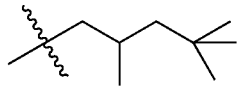

Each $R_b$ is independently an optionally substituted alkyl.

Each $R_c$ is independently an optionally substituted alkyl or an optionally substituted alkoxycarbonyl. In one embodiment, each $R_c$ is independently a C1-C10 alkyl.

$R_x$ is —H or an optionally substituted alkyl. $R_y$ is —H or an optionally substituted alkyl. In one embodiment, $R_x$ and $R_y$ are —H.

Each R' is independently —H or an optionally substituted alkyl. In one embodiment, one R' is —H. In another embodiment, both R' are —H.

R" is —H, an optionally substituted alkyl, an optionally substituted aryl or an optionally substituted aralkyl. In one embodiment, R" is —H, a C1-C20 alkyl or an optionally substituted aralkyl. In another embodiment, R" is —H, a C1-C10 alkyl or a substituted benzyl group. In yet another embodiment, R" is —H. In yet another embodiment, R" is:

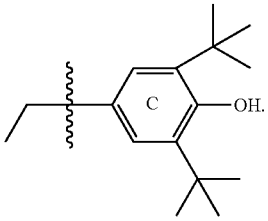

In yet another embodiment R" is selected from the group consisting of:

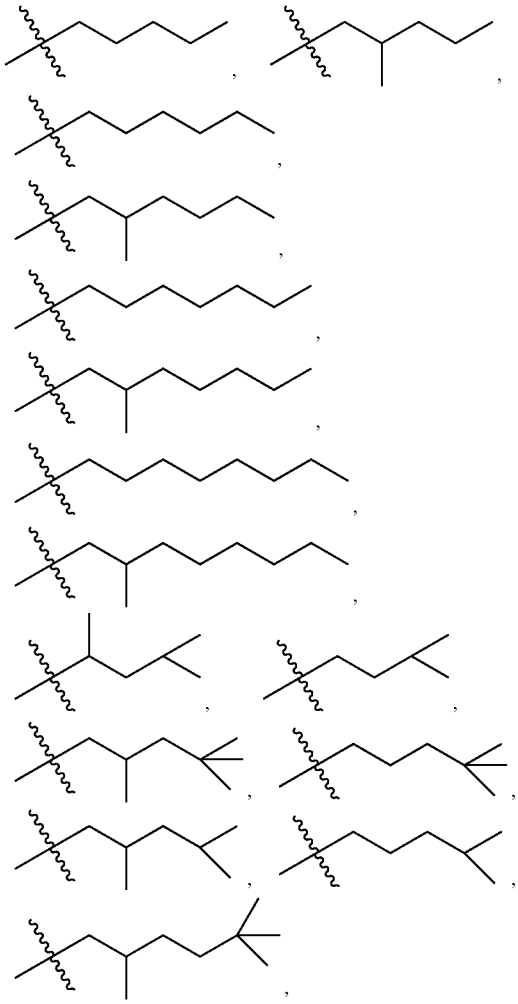

-continued

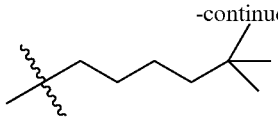

and

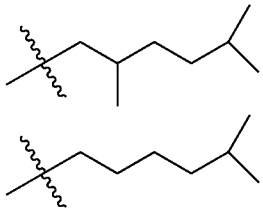

In yet another embodiment R" is:

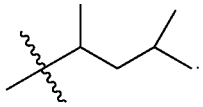

n is an integer from 1 to 10. In one embodiment, n is an integer from 1 to 6. In another embodiment, n is 1. In yet another embodiment, n is 2. In yet another embodiment, n is 3. In yet another embodiment, n is 4.

m is an integer from 1 to 10. In one embodiment, m is 1 or 2. In another embodiment, m is 1.

s is an integer from 0 to 5. In one embodiment, s is 0 or 1. In another embodiment, s is 0.

t is an integer from 0 to 4. In one embodiment, t is 0.

u is an integer from 1 to 4. In one embodiment, u is 1 or 2.

In certain embodiments for antioxidants represented by $J^1$, when n is 1, the either ring C is not:

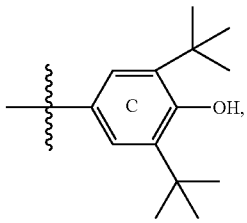

s is not 0, or R" is not —H.

In one embodiment in $J^1$:

Each $R_a$ is independently a C1-C20 alkyl. Each $R_c$ is independently a C1-C10 alkyl. R" is —H, a C1-C20 alkyl or an optionally substituted aralkyl, and the remainder of the variables are as described above for structural formula (I).

In another embodiment in $J^1$: one R' is —H, t is 0, $R_x$ and $R_y$ are —H and the compounds are represented by structural formula $J^2$:

$J^2$

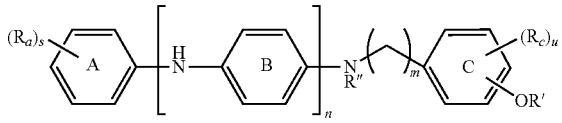

and the remainder of the variables are as described in the immediately preceding paragraph or for structural formula $J^1$ In another embodiment in $J^2$:

m is 1 or 2.

s is 0 or 1.

u is 1 or 2, and the remainder of the variables are as described in the immediately preceding paragraph or for $J^1$.

In another embodiment in $J^2$: both R' are —H and m is 1 and the compounds are represented by structural formula $J^3$:

$J^3$

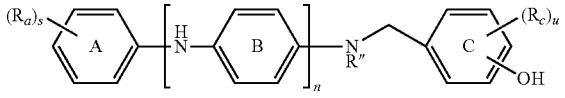

and the remainder of the variables are as described in the immediately preceding paragraph or for structural formula $J^1$ or $J^2$.

In another embodiment in $J^3$:

Each $R_a$ is independently a C1-C10 alkyl.

R" is —H, a C1-C10 alkyl or a substituted benzyl group.

n is an integer from 1 to 6, and the remainder of the variables are as described in the immediately preceding paragraph or for structural formula $J^1$ or $J^2$.

In another embodiment in $J^3$: n is 1, s is 0 and R" is —H and the compounds are represented by structural formula $J^4$:

$J^4$

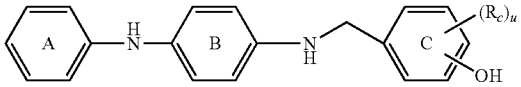

with the proviso that ring C is not:

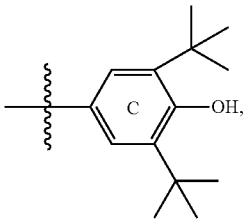

and the remainder of the variables are as described above for structural formula $J^1$, $J^2$, or $J^3$.

In certain embodiments of the present invention the antioxidants which are suitable for use in the compositions and methods of the present invention include structural formula $J^3$ or $J^4$ represented by the following structural formulas:

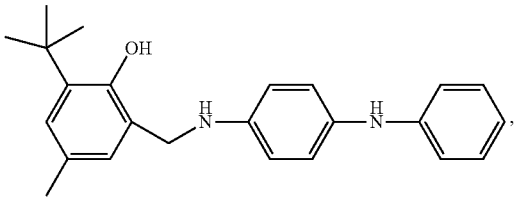

-continued

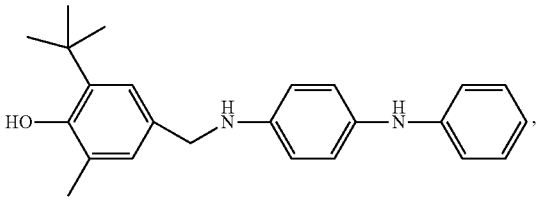

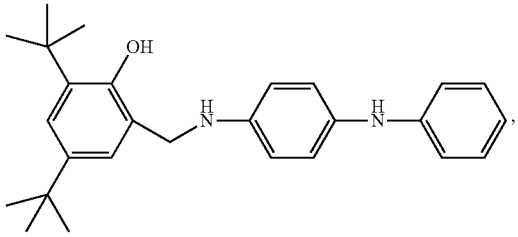

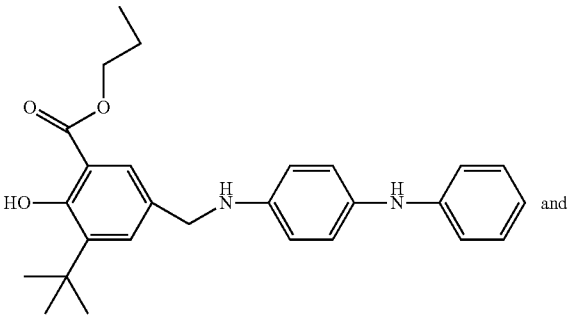

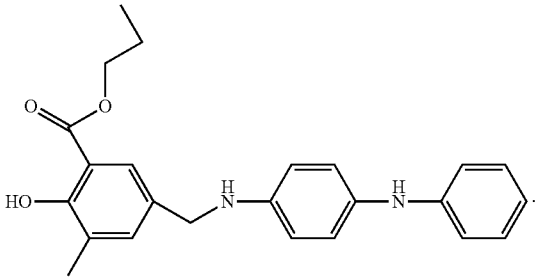

In another embodiment in $J^3$: n is 1 and the compounds are represented by structural formula $J^5$:

$J^5$

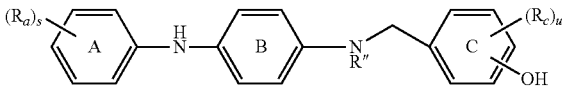

and the remainder of the variables are as described above for structural formula $J^1$, $J^2$, or $J^3$.

In another embodiment of the present invention for compounds represented by structural formula $J^3$: s is 0 and the compounds are represented by structural formula $J^6$.

$J^6$

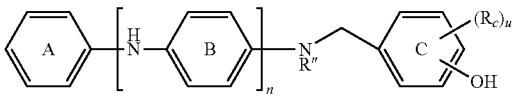

$J^7$

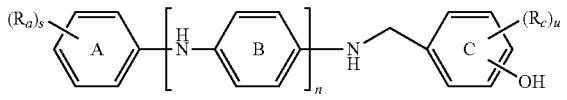

and the remainder of the variables are as described above for structural formula $J^1$, $J^2$, or $J^3$.

In another embodiment of the present invention for compounds represented by structural formula $J^3$: R" is —H and the compounds are represented by structural formula $J^7$:

and the remainder of the variables are as described above for structural formula $J^1$, $J^2$ or $J^3$.

In certain embodiments of the present invention the compounds represented by structural formula $J^3$, $J^5$, $J^6$ or $J^7$ are represented by the following structural formulas:

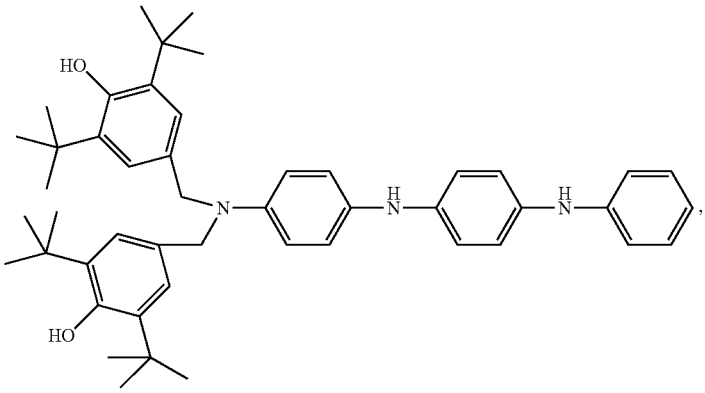

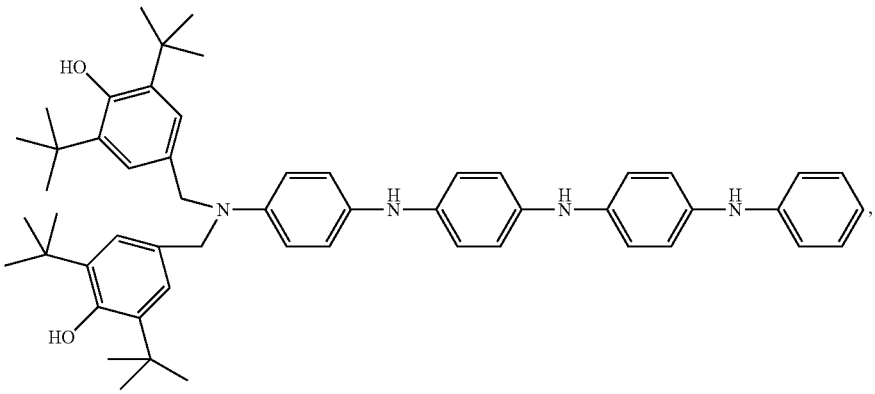

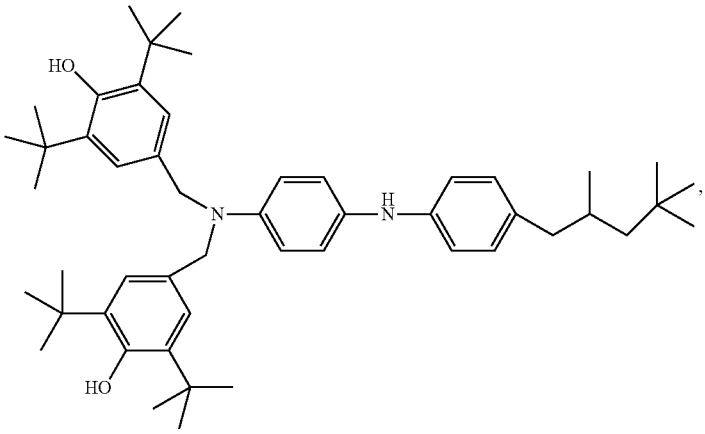

-continued
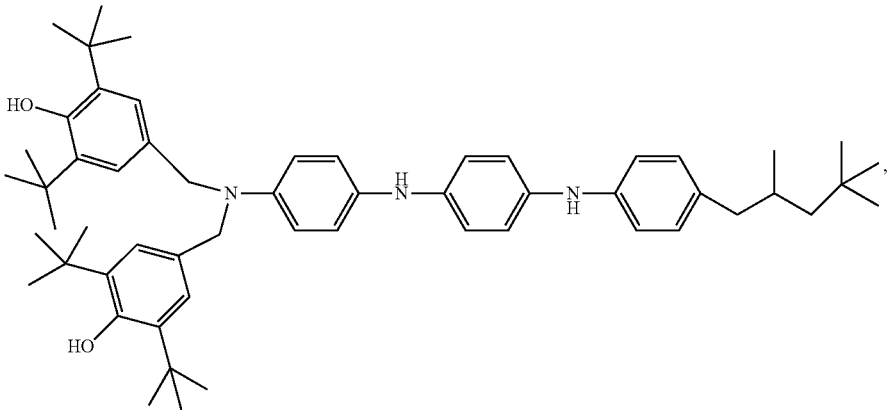
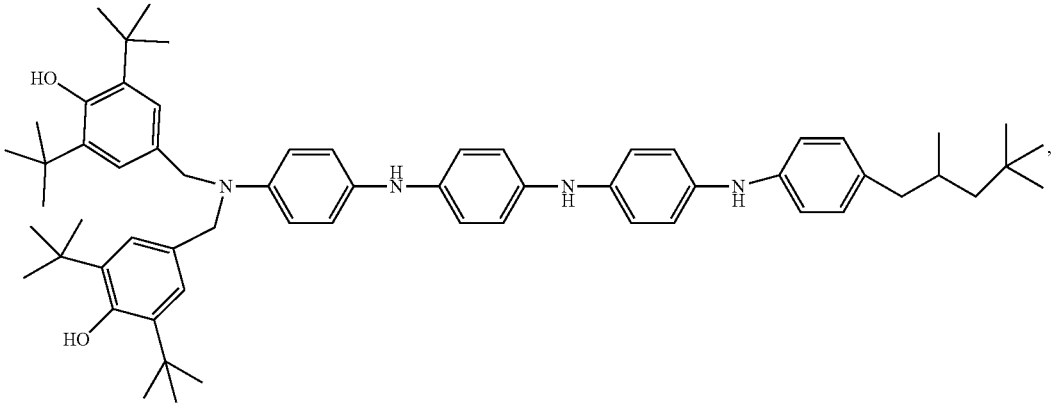
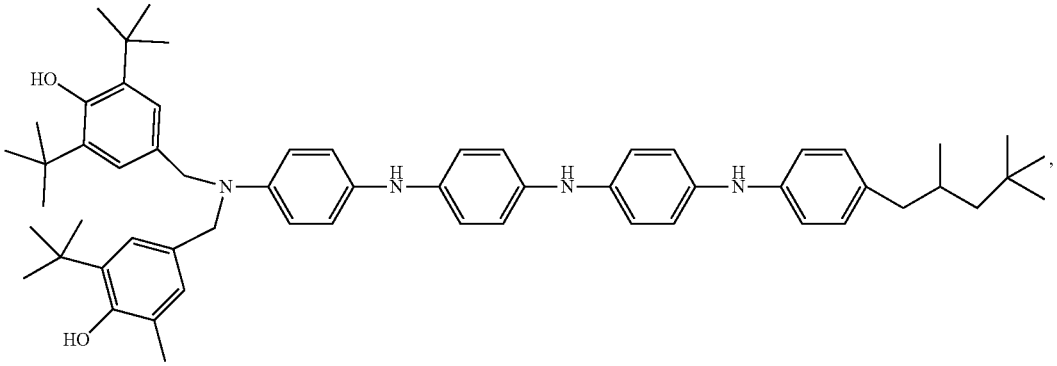
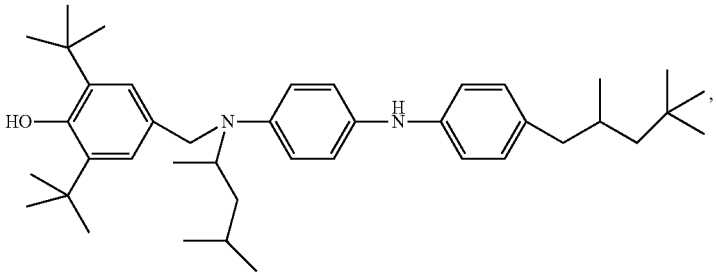

-continued
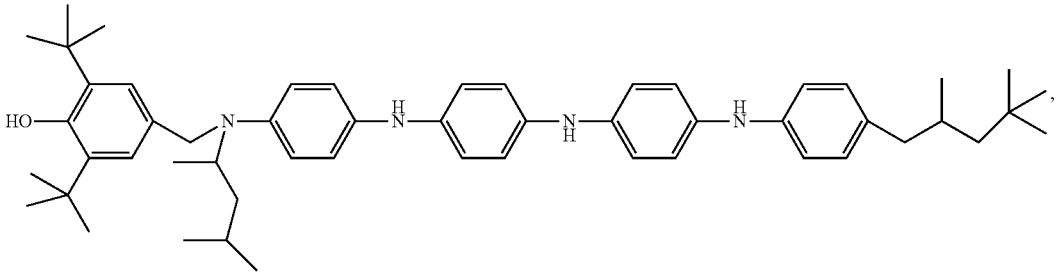
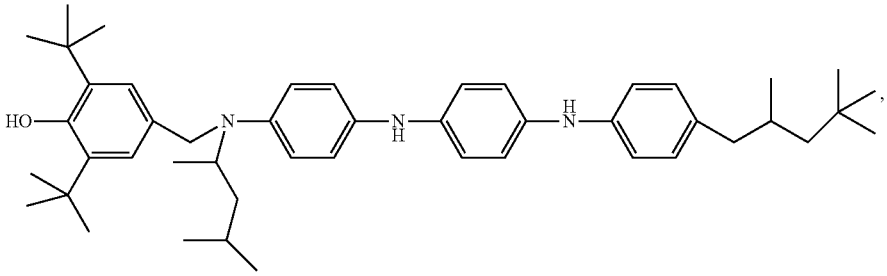
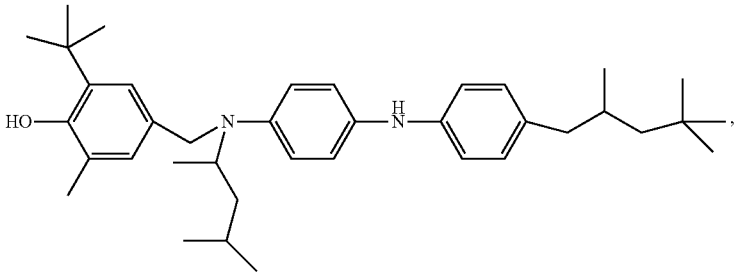
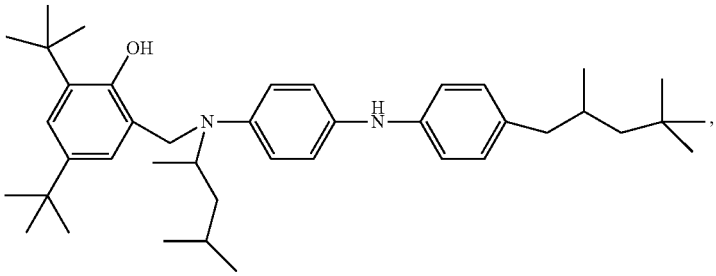
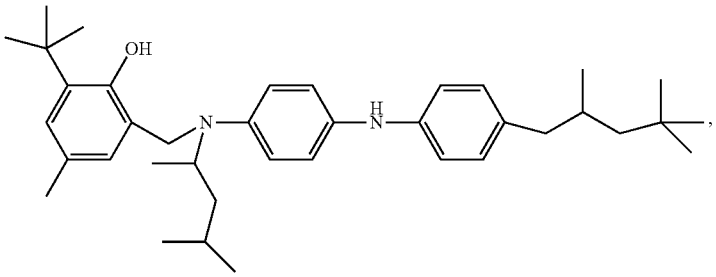
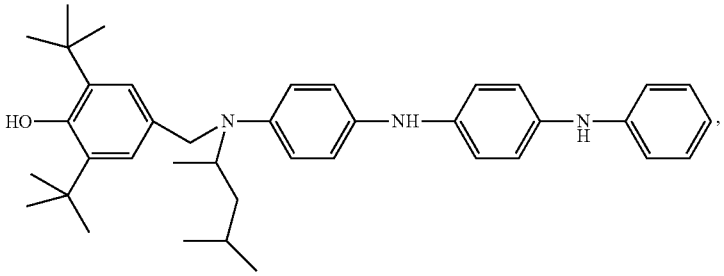

-continued
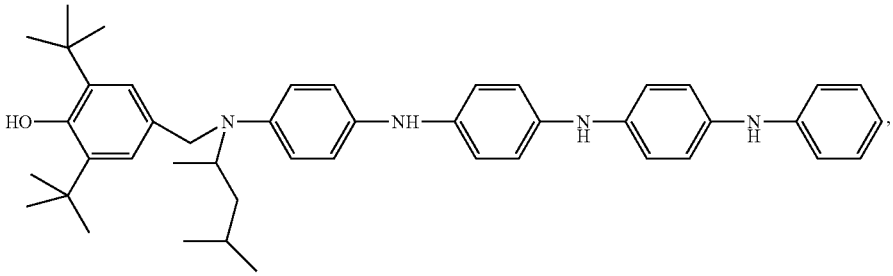
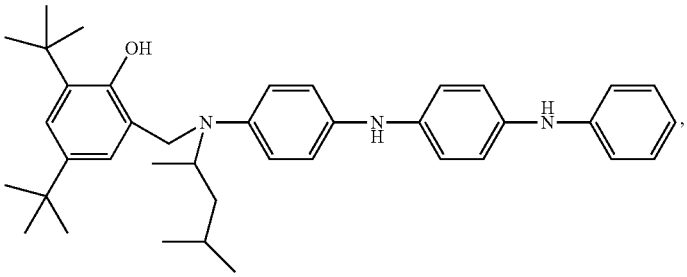
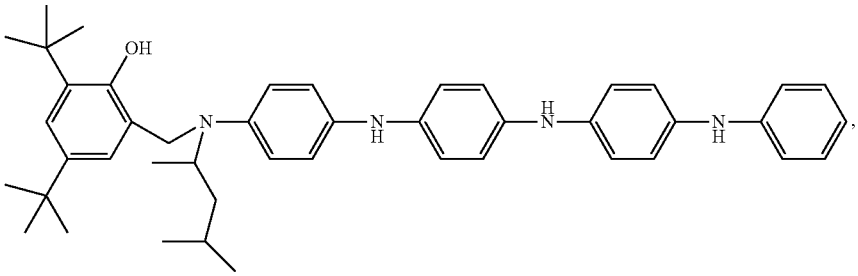
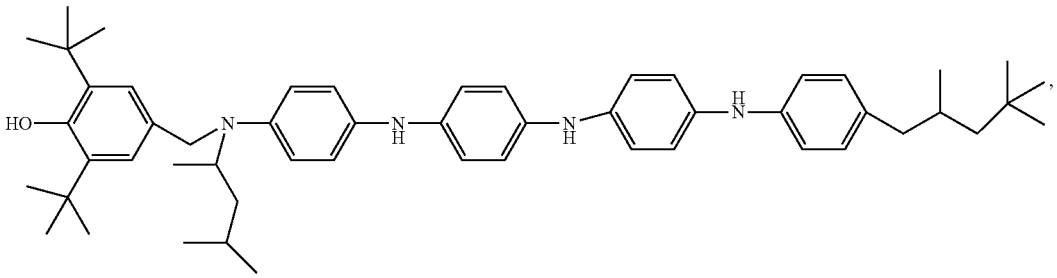
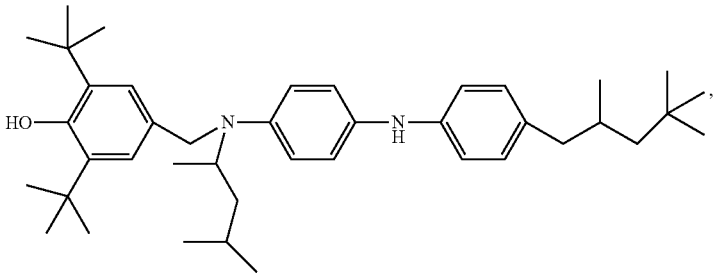
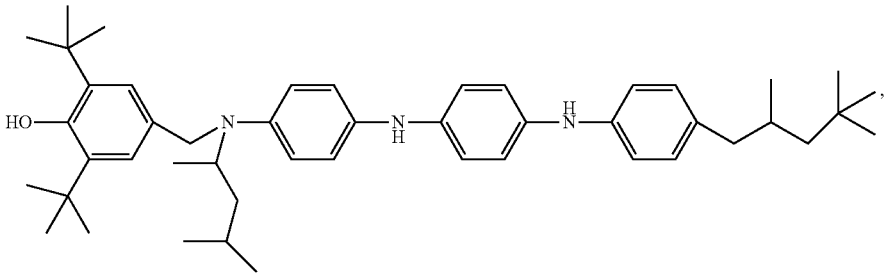

-continued
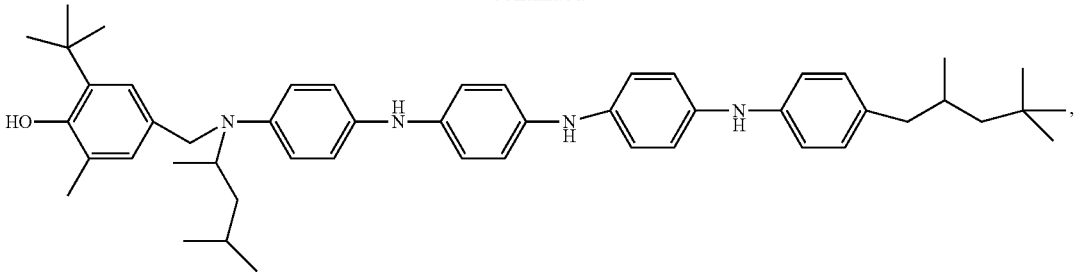
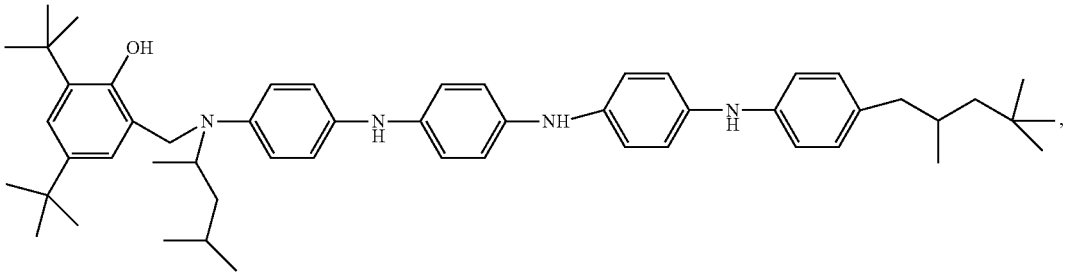
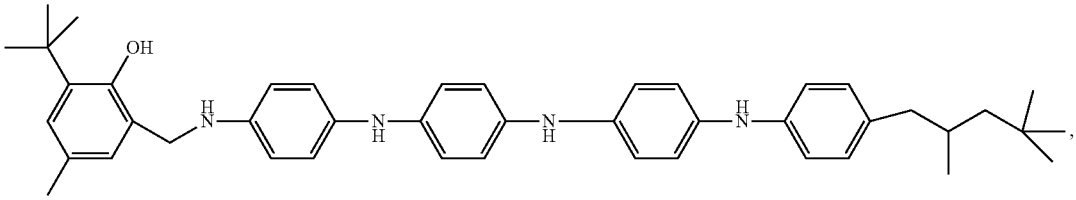
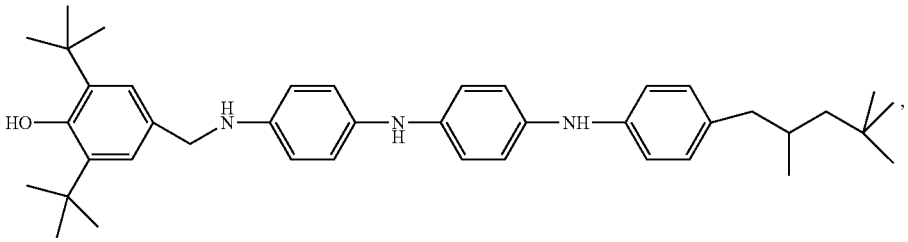
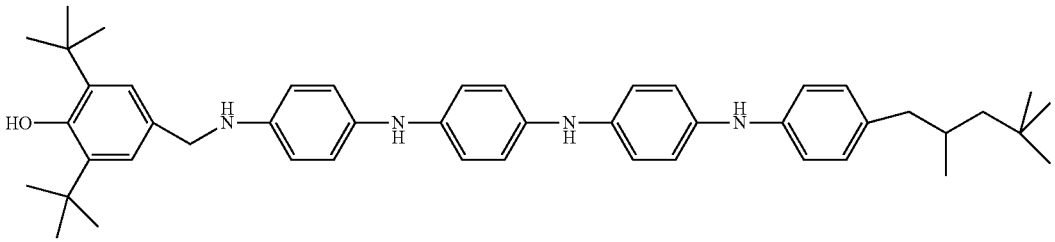
and
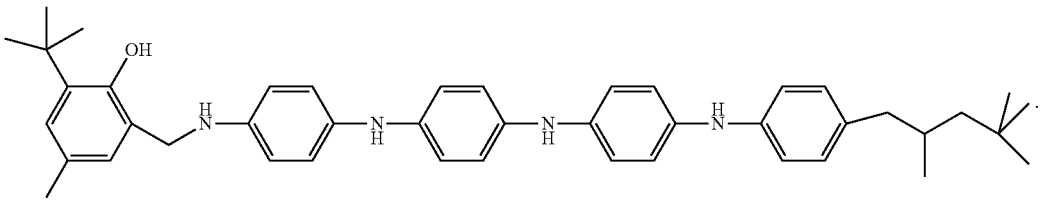

In another embodiment of the present invention for compounds represented by structural formula $J^3$: R" is —H and n is 1 and the compounds are represented by structural formula $J^8$:

$J^8$ 5

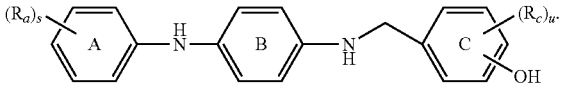

and the remainder of the variables are as described above for structural formula $J^1$, $J^2$ or $J^3$.

In certain embodiments of the present invention the compounds represented by structural formula $J^3$ or $J^8$ are represented by the following structural formulas:

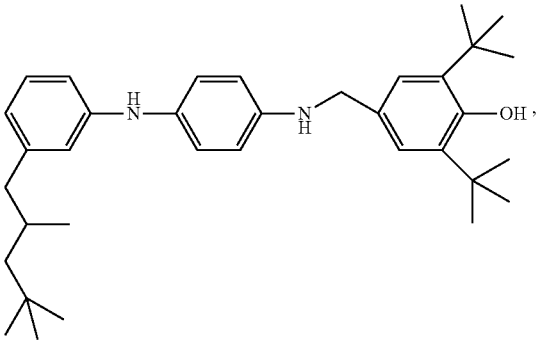

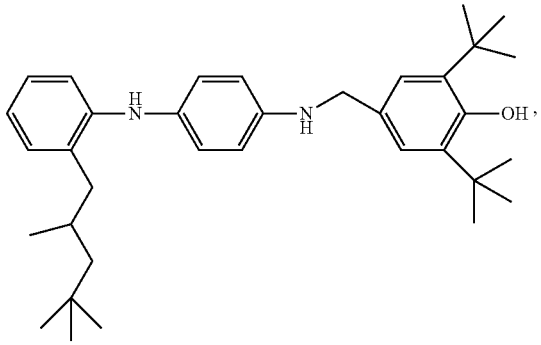

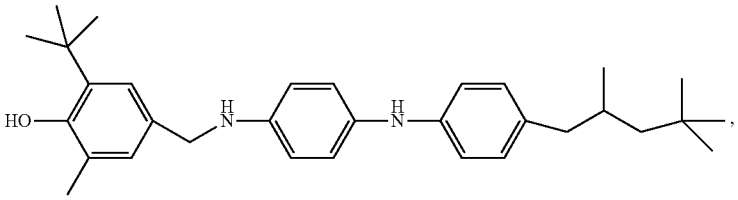

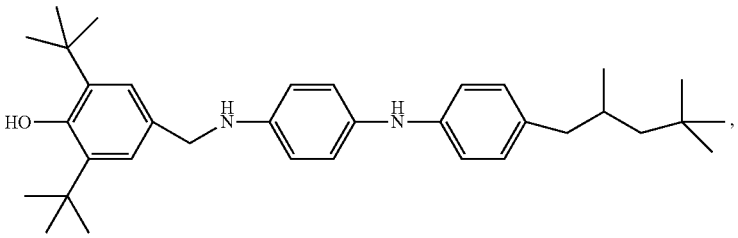

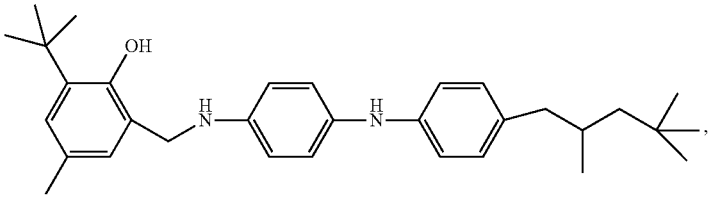

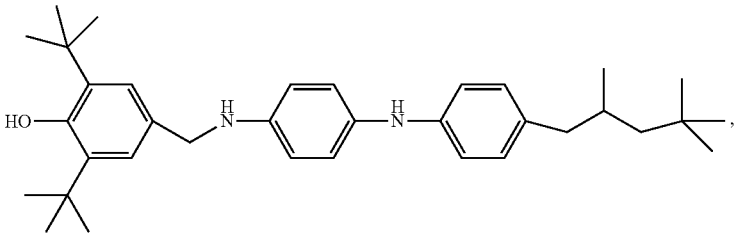

-continued

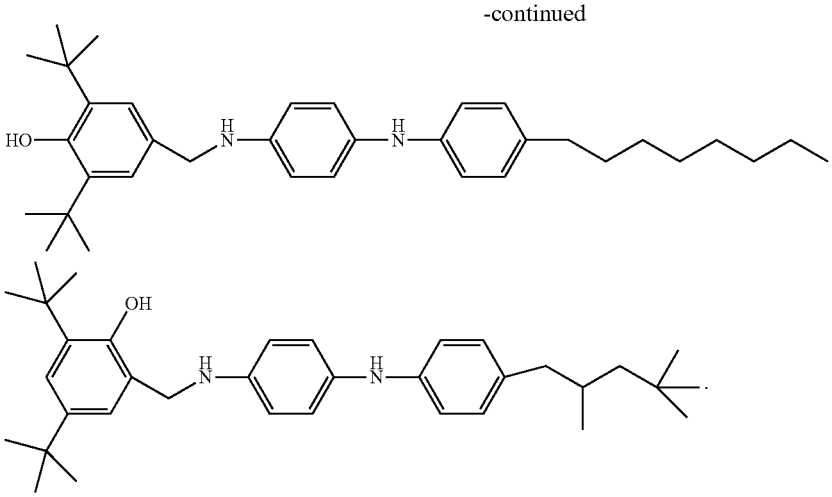

and

In another embodiment of the present invention for compounds represented by structural formula $J^3$: s is 0 and R" is —H and the compounds are represented by structural formula $J^9$:

$J^9$

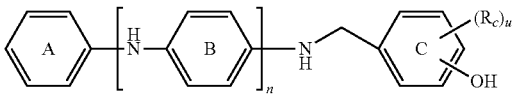

and the remainder of the variables are as described above for structural formula $J^1$, $J^2$ or $J^3$.

In certain embodiments of the present invention the compounds represented by structural formula $J^3$ or $J^9$ are represented by the following structural formulas:

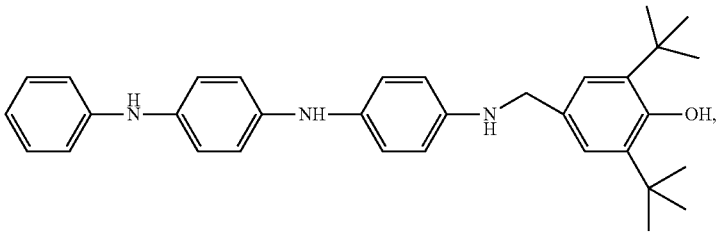

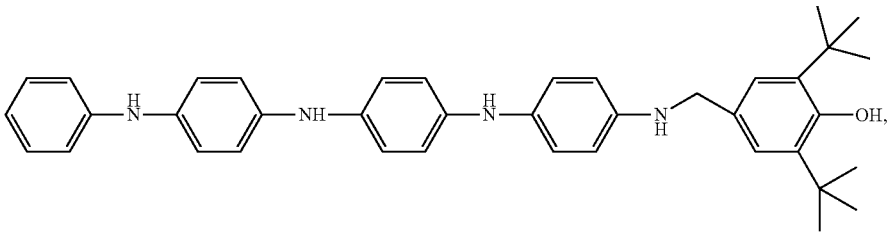

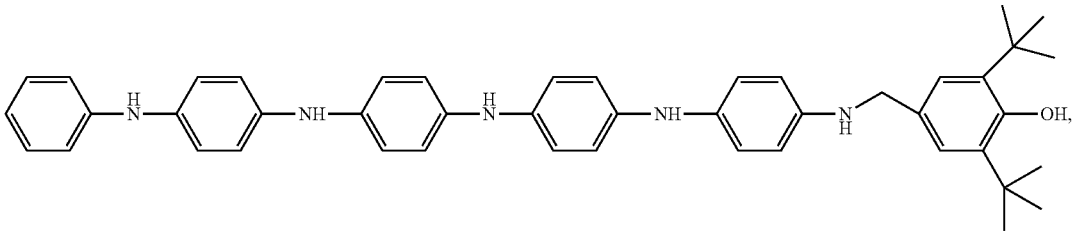

-continued

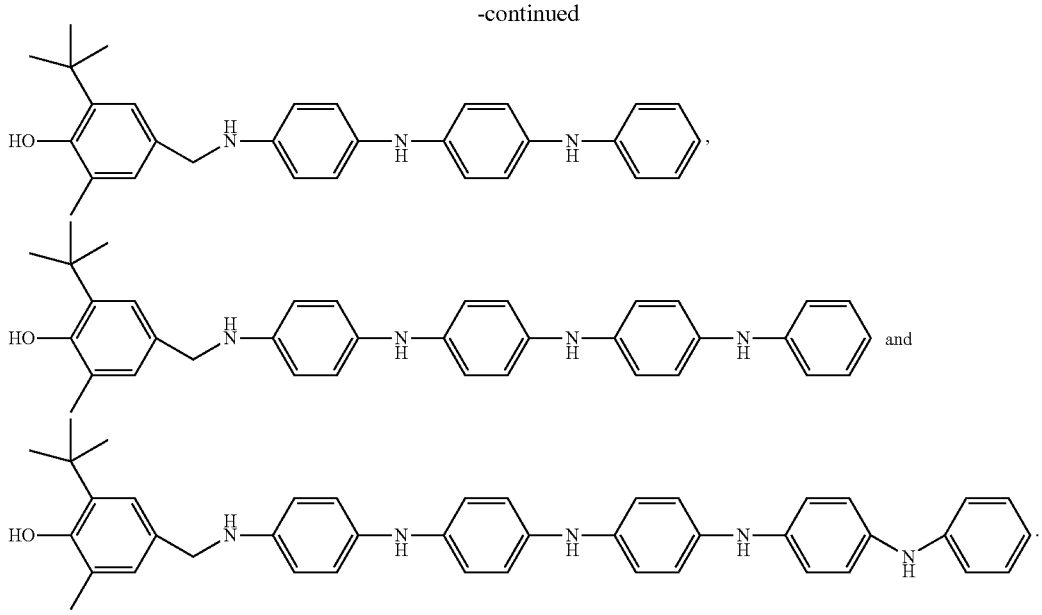

In another embodiment of the present invention for compounds represented by structural formula $J^3$: s is 0 and n is 0 and the compounds are represented by structural formula $J^{10}$ $J^{10}$

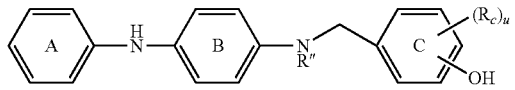

and the remainder of the variables are as described above for structural formula $J^1$, $J^2$ or $J^3$.

In certain embodiments of the present invention the compounds represented by structural formula $J^3$ or $J^{10}$ are represented by the following structural formulas:

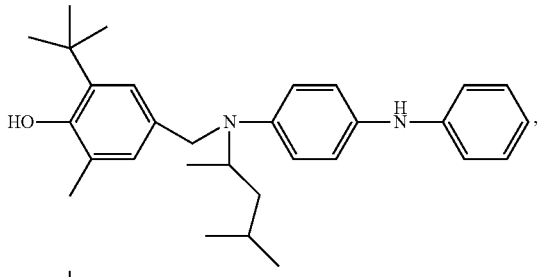

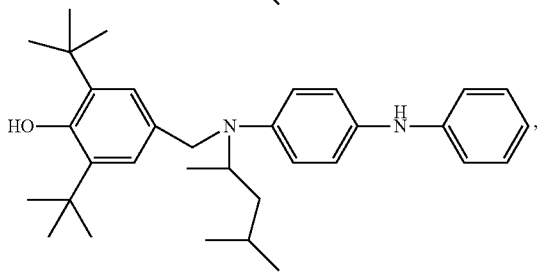

-continued

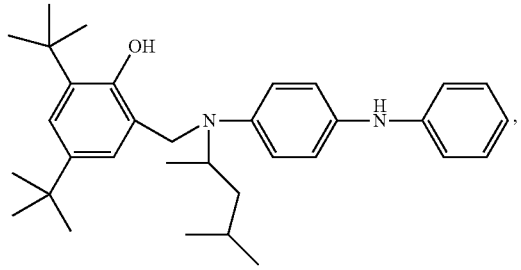

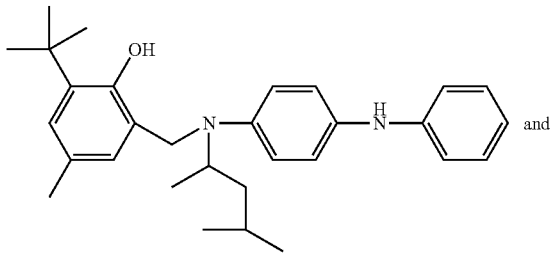

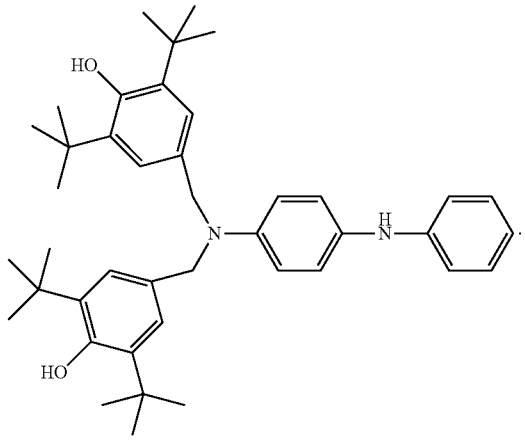

In another embodiment of the present invention the antioxidants which are suitable for use in the compositions and methods of the present invention include compounds represented by the following structural formulas:
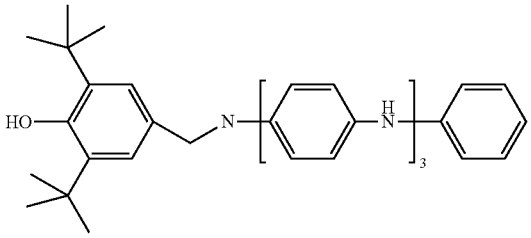
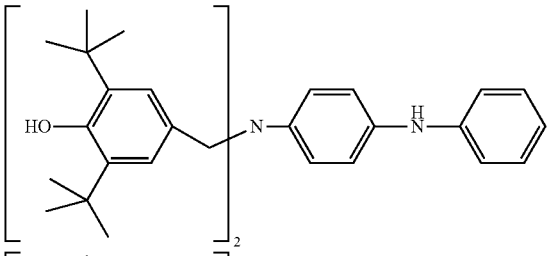
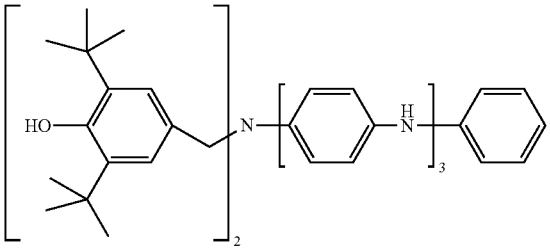
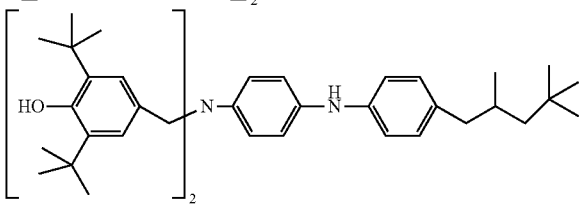
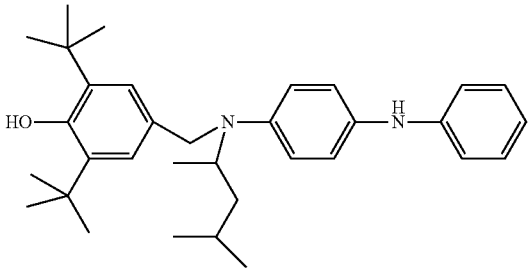
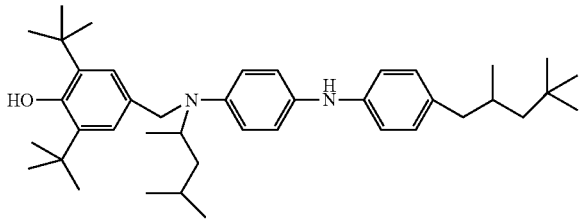
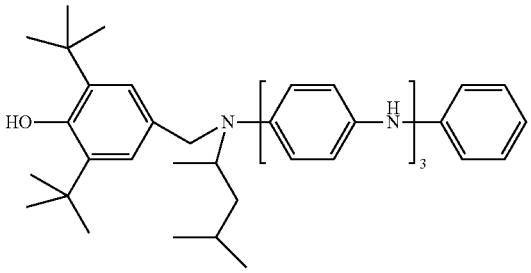
-continued
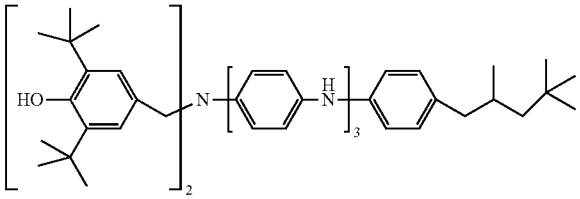
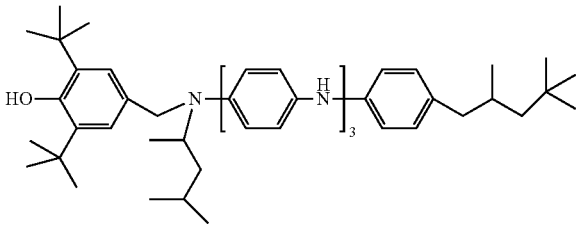
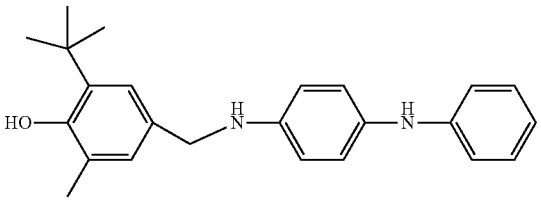
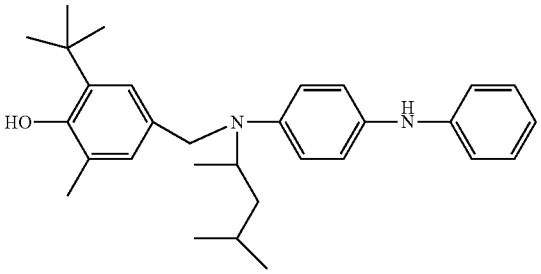
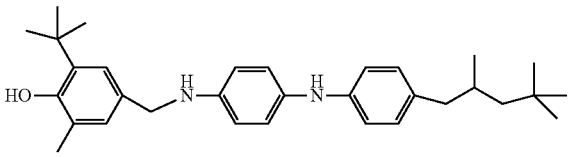
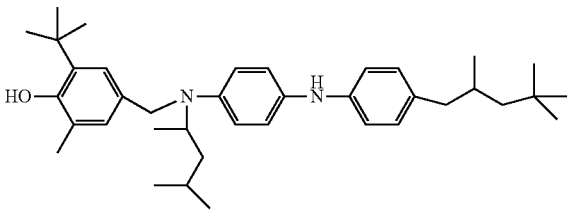
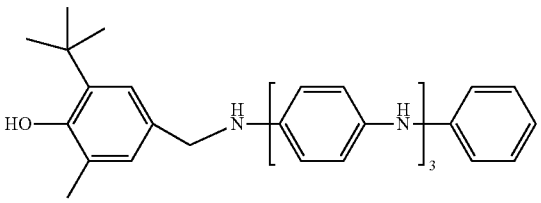
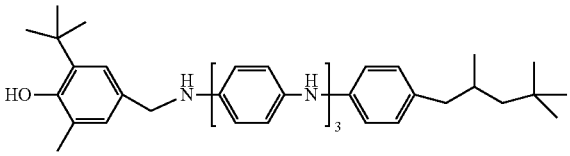

-continued
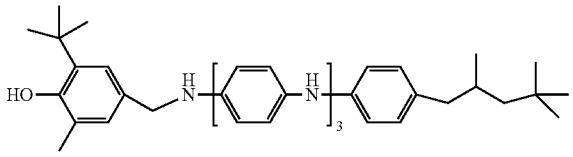
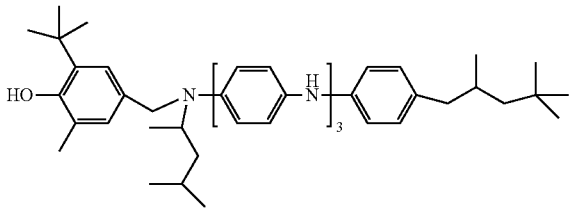
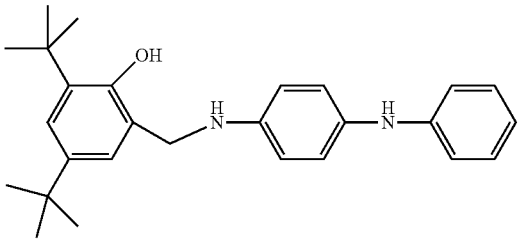
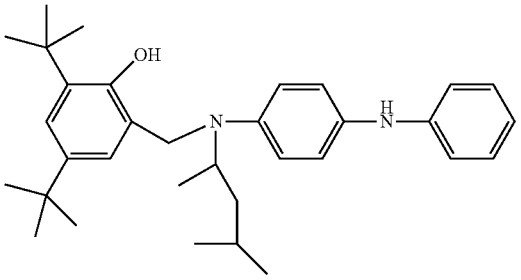
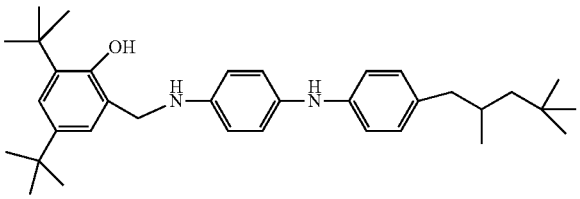
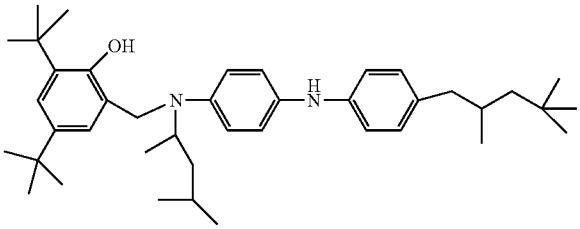
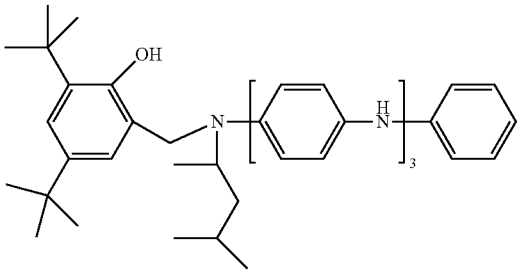
-continued
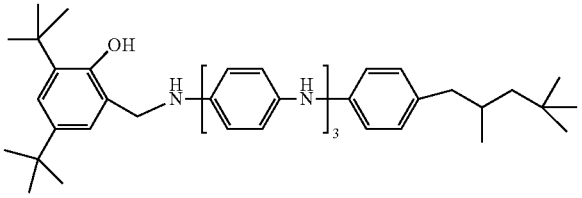
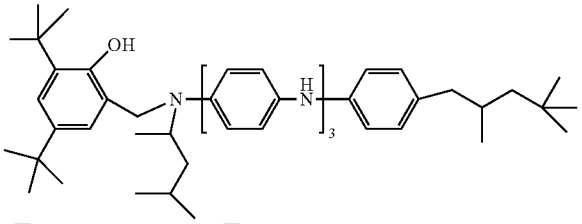
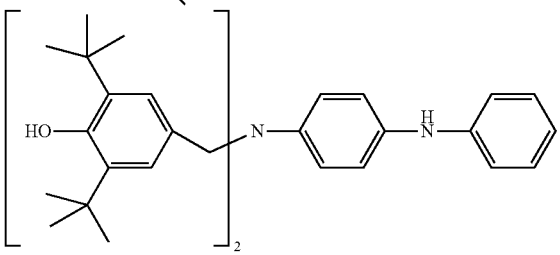
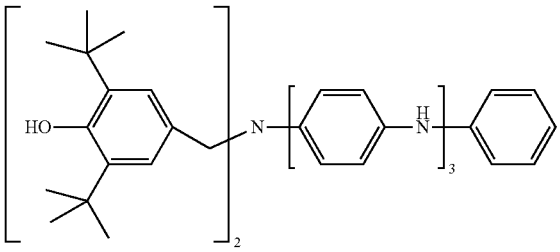
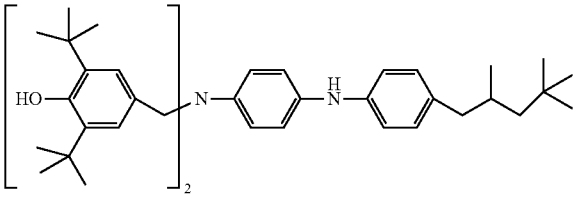
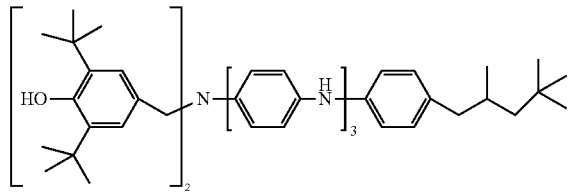
In another embodiment, the first antioxidants which are suitable for use in the compositions and methods of the present invention include alkylated antioxidant macromolecules having formula K:
K
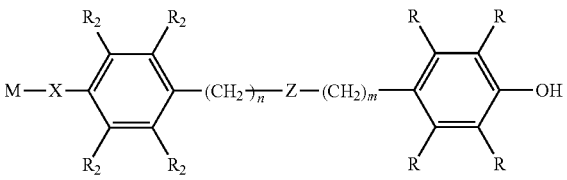

wherein, independently for each occurrence, n and m are integers from 0 to 6, inclusive;

Z is —C(O)O—, —OC(O)—, —C(O)NH—, —NHC(O)—, —NH—, —CH═N—, —C(O)—, —O—, —S—, —C(O)OC(O)—, or a bond;

R is H, $C_{1-6}$ alkyl, —OH, —$NH_2$, —SH, aryl, aralkyl, or

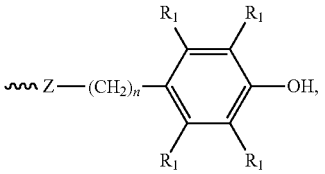

wherein at least one R adjacent to the —OH group is a bulky alkyl group (e.g., butyl, sec-butyl, tert-butyl, 2-propyl, 1,1-dimethylhexyl, and the like);

$R_1$ is H, $C_{1-6}$ alkyl, aryl, alkylaryl, —OH, —$NH_2$, —SH, or C1-C6 alkyl ester wherein at least one $R_1$ adjacent to the —OH group is a bulky alkyl group (e.g., butyl, sec-butyl, tert-butyl, 2-propyl, 1,1-dimethylhexyl, and the like); and $R_2$ is H, $C_{1-6}$ alkyl, aryl, aralkyl, —OH, —$NH_2$, or —SH wherein at least one $R_1$ adjacent to the —OH group is a bulky alkyl group (e.g., butyl, sec-butyl, tert-butyl, 2-propyl, 1,1-dimethylhexyl, and the like);

X is —C(O)O—, —OC(O)—, —C(O)NH—, —NHC(O)—, —NH—, —CH═N—, —C(O)—, —O—, —S—, —C(O)OC(O)—, or a bond;

M is H, aryl, C-1 to C-20 linear or branched alkyl chain with or without any functional group anywhere in the chain, or

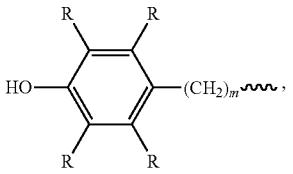

wherein m and each R is independently as described above;

wherein $R_2$ is H, $C_{1-6}$ alkyl, —OH, —$NH_2$, —SH, aryl, ester, or

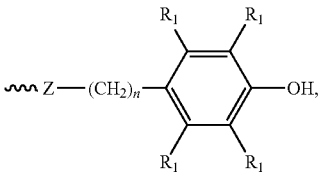

In certain embodiment, at least one $R_2$ is —OH and n, Z, and each $R_1$ are independently as described above.

In various embodiments, for compounds of formula K, Z is —OC(O)—. In another embodiment, Z is —C(O)O—. In another embodiment, Z is —C(O)NH—. In another embodiment, Z is —NHC(O)—. In another embodiment, Z is —NH—. In another embodiment, Z is —CH═N—. In another embodiment, Z is —C(O)—. In another embodiment, Z is —O—. In another embodiment, Z is —C(O)OC(O)—. In another embodiment, Z is a bond.

In another embodiment, for compounds of formula K, both R groups adjacent to —OH are bulky alkyl groups (e.g., butyl, sec-butyl, tert-butyl, 2-propyl, 1,1-dimethylhexyl, and the like). In another embodiment, both R groups are tert-butyl.

In another embodiment, for compounds of formula K, M is

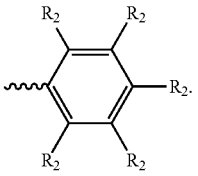

In another embodiment, for compounds of formula K, at least one R is

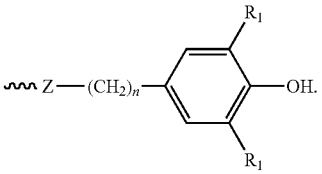

In another embodiment for compounds of formula K, n is 0.

In another embodiment, for compounds of formula K, m is 1.

In another embodiment, for compounds of formula K, n is 0 and m is 1.

In another embodiment, for compounds of formula K, n is 0, m is 1, and Z is —C(O)O—.

In another embodiment, for compounds of formula K, n is 0, m is 1, Z is —C(O)O—, and the two R groups adjacent to the OH are tert-butyl.

In another embodiment, for compounds of formula K, n is 0, m is 1, Z is —C(O)O—, the two R groups adjacent to the OH are t-butyl, and M is

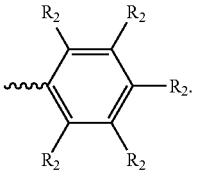

In another embodiment, for compounds of formula K, n is 0, m is 1, Z is —C(O)O—, the two R groups adjacent to the OH are t-butyl, M is

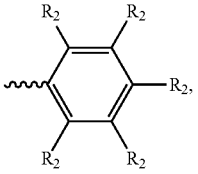

and the $R_2$ in the para position is OH.

In another embodiment, for compounds of formula K, n is 0, m is 1, Z is —C(O)O—, the two R groups adjacent to the OH are t-butyl, M is

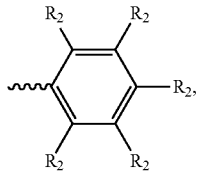

the $R_2$ in the para position is OH, and an adjacent $R_2$ is OH.

In another embodiment, for compounds of formula K, n is 0, m is 1, Z is —C(O)O—, the two R groups adjacent to the OH are t-butyl, M is

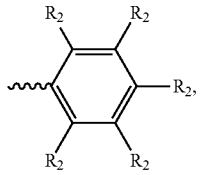

the $R_2$ in the para position is OH, and the two adjacent $R_2$ groups are —OH.

In one embodiment the antioxidant suitable for use in the compounds and methods of the present invention are compounds represented Structural Formula $K^1$:

$K^1$

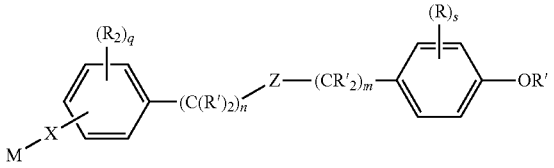

Z is —C(O)NR'—, —NR'C(O)—, —NR'—, —CR'═N—, —C(O)—, —C(O)O—, —OC(O)—, —O—, —S—, —C(O)OC(O)— or a bond. Each R' is independently —H or optionally substituted alkyl. Each R is independently an optionally substituted alkyl, optionally substituted aryl, optionally substituted alkoxycarbonyl, optionally substituted ester, —OH, —$NH_2$, —SH, or

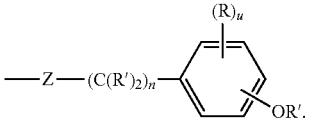

Each $R_1$ is independently an optionally substituted alkyl, optionally substituted aryl, optionally substituted alkoxycarbonyl, optionally substituted ester, —OH, —$NH_2$ or —SH. Each $R_2$ is independently an optionally substituted alkyl, optionally substituted aryl, optionally substituted alkoxycarbonyl, optionally substituted ester, —OH, —$NH_2$ or —SH. X is —C(O)O—, —OC(O)—, —C(O)NR'—, —NR'C(O)—, —NR'—, —CH═N—, —C(O)—, —O—, —S—, —NR'— or —C(O)OC(O)—. M is an alkyl or

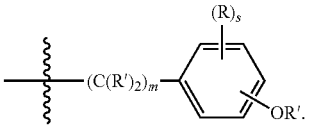

Each n and m are independently integers from 0 to 6. Each s, q and u are independently integers from 0 to 4. In certain embodiments M is not

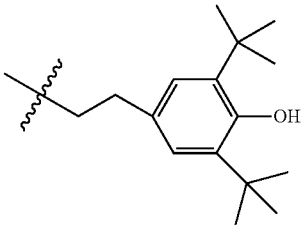

when X is —C(O)O— or —OC(O)—.

In certain embodiments for compounds represented by Structural Formula $K^1$:

Z is —C(O)NR'—, —NR'C(O)—, —NR'—, —CR'═N—, —C(O)—, —C(O)O—, —OC(O)—, —O—, —S—, —C(O)OC(O)— or a bond. In certain other embodiments Z is —C(O)O—, —OC(O)—, —C(O)NH—, —NHC(O)—, —NH—, —O— or —C(O)—. In certain other embodiments, Z is —C(O)NH— or —NHC(O)—. Optionally, Z is not —C(O)O—, —OC(O)—, —O— or —NH—. In various embodiments, the present invention relates to a compound of Structural Formula 1 and the attendant definitions, wherein Z is —OC(O)—. In another embodiment, Z is —C(O)O—. In another embodiment, Z is —C(O)NH—. In another embodiment, Z is —NHC(O)—. In another embodiment, Z is —NH—. In another embodiment, Z is —CH═N—. In another embodiment, Z is —C(O)—. In another embodiment, Z is —O—. In another embodiment, Z is —C(O)OC(O)—. In another embodiment, Z is a bond.

Each R' is independently —H or optionally substituted alkyl. In certain other embodiments R' is —H or an alkyl group. In certain other embodiments R' is —H or a C1-C10 alkyl group. In certain other embodiments R' is —H.

Each R is independently an optionally substituted alkyl, optionally substituted aryl, optionally substituted alkoxycarbonyl, optionally substituted ester, —OH, —$NH_2$, —SH, or

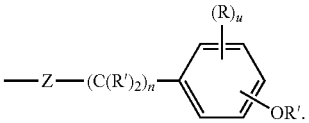

In certain other embodiments, each R is independently an optionally substituted alkyl or optionally substituted alkoxycarbonyl. In certain other embodiment each R is independently an alkyl or alkoxycarbonyl. In certain other embodiments each R is independently a C1-C6 alkyl or a C1-C6 alkoxycarbonyl. In certain other embodiments each R is independently tert-butyl or propoxycarbonyl. In certain other embodiments each R is independently an alkyl group. In certain embodiments each R is independently a bulky alkyl group. Suitable examples of bulky alkyl groups include butyl, sec-butyl, tert-butyl, 2-propyl, 1,1-dimethylhexyl, and the like. In certain embodiments each R is tert-butyl. In certain embodiments at least one R adjacent to the —OH group is a bulky alkyl group (e.g., butyl, sec-butyl, tert-butyl, 2-propyl, 1,1-dimethylhexyl, and the like). In certain other embodiments both R groups adjacent to —OH are bulky alkyl groups (e.g., butyl, sec-butyl, tert-butyl, 2-propyl, 1,1-dimethylhexyl, and the like). In another embodiment, both R groups are tert-butyl. In another embodiment, both R groups are tert-butyl adjacent to the OH group.

Each $R_1$ is independently an optionally substituted alkyl, optionally substituted aryl, optionally substituted alkoxycarbonyl, optionally substituted ester, —OH, —$NH_2$ or —SH. In certain other embodiments, each $R_1$ is independently an optionally substituted alkyl or optionally substituted alkoxycarbonyl. In certain other embodiment each $R_1$ is independently an alkyl or alkoxycarbonyl. In certain other embodiments each $R_1$ is independently a C1-C6 alkyl or a C1-C6 alkoxycarbonyl. In certain other embodiments each $R_1$ is independently tert-butyl or propoxycarbonyl. In certain other embodiments each $R_1$ is independently an alkyl group. In certain embodiments each $R_1$ is independently a bulky alkyl group. Suitable examples of bulky alkyl groups include butyl, sec-butyl, tert-butyl, 2-propyl, 1,1-dimethylhexyl, and the like. In certain embodiments each $R_1$ is tert-butyl. In certain embodiments at least one $R_1$ adjacent to the —OH group is a bulky alkyl group (e.g., butyl, sec-butyl, tert-butyl, 2-propyl, 1,1-dimethylhexyl, and the like). In certain other embodiments both $R_1$ groups adjacent to —OH are bulky alkyl groups (e.g., butyl, sec-butyl, tert-butyl, 2-propyl, 1,1-dimethylhexyl, and the like). In another embodiment, both $R_1$ groups are tert-butyl. In another embodiment, both $R_1$ groups are tert-butyl adjacent to the OH group.

Each $R_2$ is independently an optionally substituted alkyl, optionally substituted aryl, optionally substituted alkoxycarbonyl, optionally substituted ester, —OH, —$NH_2$ or —SH. In certain other embodiments, each $R_2$ is independently an optionally substituted alkyl or optionally substituted alkoxycarbonyl. In certain other embodiment each $R_2$ is independently an alkyl or alkoxycarbonyl. In certain other embodiments, each $R_2$ is independently an optionally substituted alkyl. In certain other embodiment each $R_2$ is independently an alkyl. In certain other embodiments each $R_2$ is independently a C1-C10 alkyl. In certain other embodiments each $R_2$ is independently a C1-C6 alkyl. In certain other embodiments each $R_2$ is independently a bulky alkyl group or a straight chained alkyl group. In certain other embodiments each $R_2$ is independently methyl, ethyl, propyl, butyl, sec-butyl, tert-butyl, 2-propyl or 1,1-dimethylhexyl. In certain embodiments each $R_2$ is methyl or tert-butyl.

X is —C(O)O—, —OC(O)—, —C(O)NR'—, —NR'C(O)—, —NR'—, —CH═N—, —C(O)—, —O—, —S—, —NR'— or —C(O)OC(O)—. In certain embodiments X is —NH—, —S— or —O—. In certain embodiments X is —O—. Optionally X is a bond.

M is an alkyl or

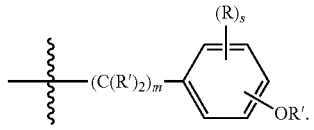

In certain embodiment M is alkyl. In certain other embodiments M is a C1-C20 linear or branched chain alkyl. In certain other embodiments M is a C5-C20 linear or branched chain alkyl. In certain other embodiments M is decane.

Each n and m are independently integers from 0 to 6. In certain embodiments each n and m are independently integers from 0 to 2.

In another embodiment, the antioxidant suitable for use in the compositions and methods of the present invention is represented by a compound of Structural Formula $K^1$ wherein n is 0.

In another embodiment, the antioxidant suitable for use in the compositions and methods of the present invention is represented by a compound of Structural Formula $K^1$ wherein m is 1.

In another embodiment, the antioxidant suitable for use in the compositions and methods of the present invention is represented by a compound of Structural Formula $K^1$ and the attendant definitions, wherein n is 0 and m is 1.

In another embodiment, the antioxidant suitable for use in the compositions and methods of the present invention is represented by a compound of Structural Formula $K^1$ wherein n is 0, m is 1, and Z is —C(O)O—.

In another embodiment, the antioxidant suitable for use in the compositions and methods of the present invention is represented by a compound of Structural Formula $K^1$ wherein n is 0, m is 1, Z is —C(O)O—, and the two R groups adjacent to the OH are tert-butyl.

Each s, q and u are independently integers from 0 to 4. In certain embodiments, each s and q are independently integers from 0 to 2. In certain embodiments, s is 2.

In certain embodiments for compounds represented by Structural Formula $K^1$ M is not

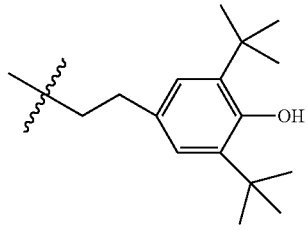

when X is —C(O)O— or —OC(O)—.

In a sixth embodiment of the present invention directed to a compound represented by Structural Formula $K^1$, the compound is represented by a Structural Formula selected from:

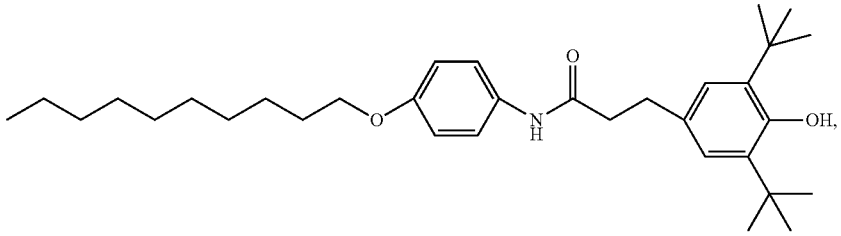

-continued
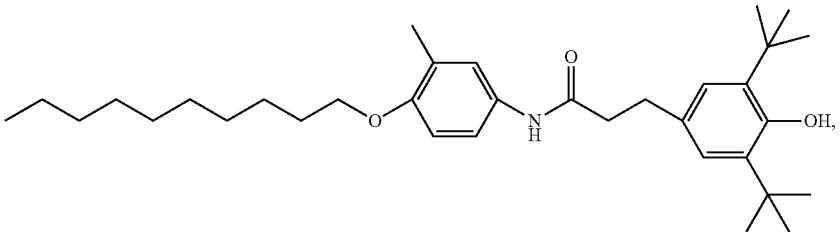
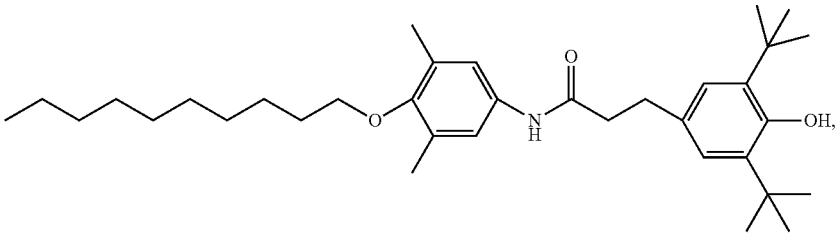
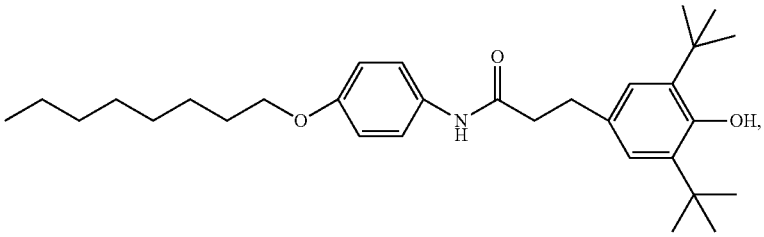
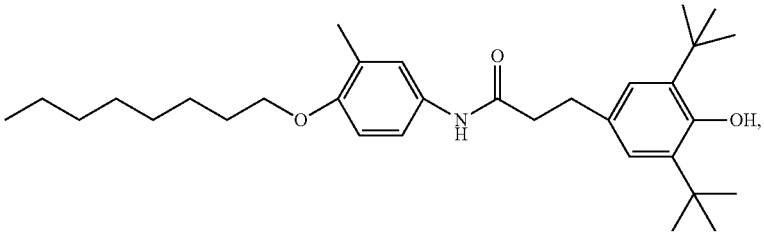
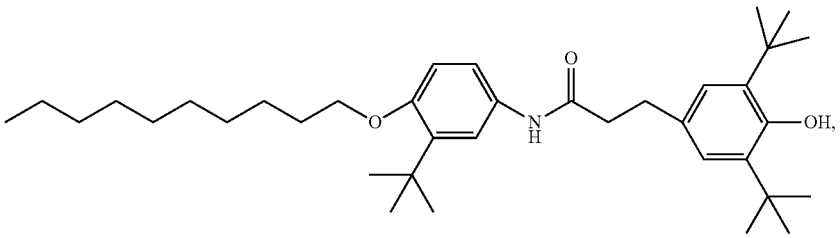
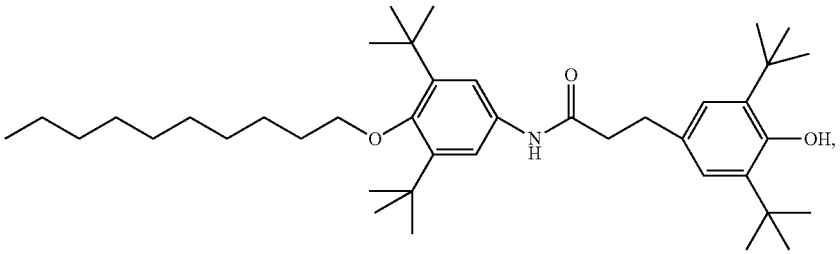
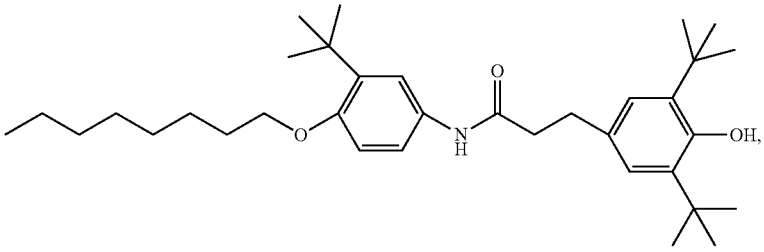

-continued
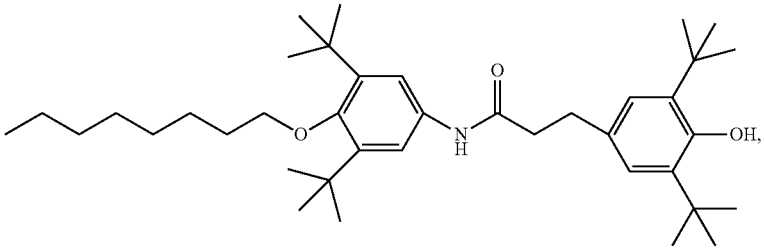
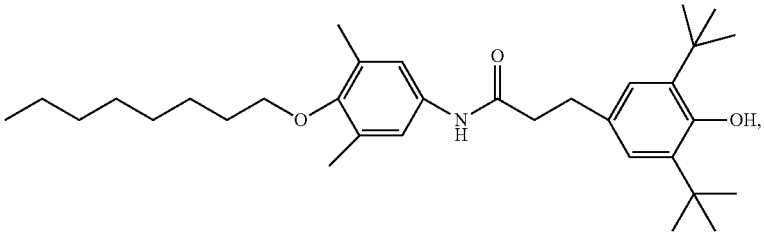
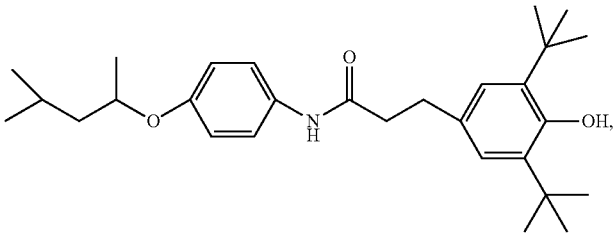
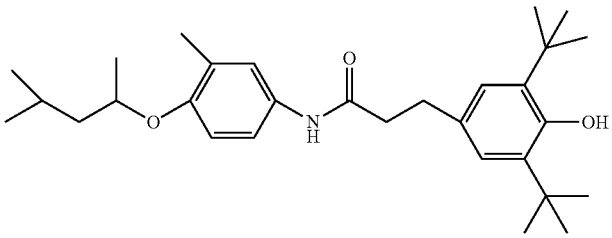
or
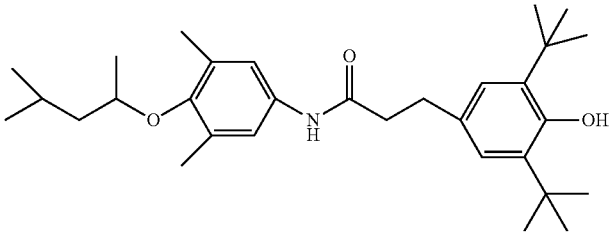

In another embodiment, the antioxidants which are suitable for use in the compositions and methods of the present invention include alkylated antioxidant macromolecules having formula L.

L

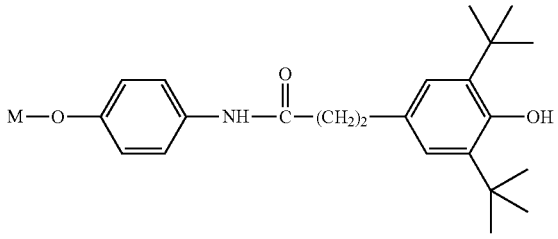

where M is C1 to C20-linear or branched alkyl chains.

In another embodiment the antioxidants which are suitable for use in the compositions and methods of the present invention are alkylated antioxidant macromolecules having formula A:

A

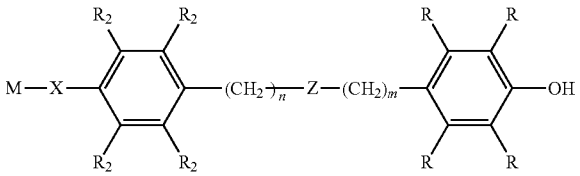

wherein, independently for each occurrence:

n and m are integers from 0 to 6, inclusive;

Z is —C(O)O—, —OC(O)—, —C(O)NH—, —NHC(O)—, —NH—, —CH═N—, —C(O)—, —O—, —S—, —C(O)OC(O)—, or a bond;

R is H, $C_{1-6}$ alkyl, —OH, —$NH_2$, —SH, aryl, ester, or

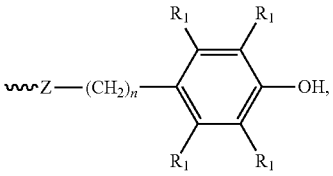

wherein at least one R adjacent to the —OH group is a bulky alkyl group (e.g., butyl, sec-butyl, tert-butyl, 2-propyl, 1,1-dimethylhexyl, and the like);

$R_1$ is H, $C_{1-6}$ alkyl, aryl, aralkyl, —OH, —$NH_2$, —SH, or C1-C6 alkyl ester wherein at least one $R_1$ adjacent to the —OH group is a bulky alkyl group (e.g., butyl, sec-butyl, tert-butyl, 2-propyl, 1,1-dimethylhexyl, and the like); and $R_2$ is H, $C_{1-6}$ alkyl, aryl, aralkyl, —OH, —$NH_2$, —SH, or ester, wherein at least one $R_1$ adjacent to the —OH group is a bulky alkyl group (e.g., butyl, sec-butyl, tert-butyl, 2-propyl, 1,1-dimethylhexyl, and the like);

X is —C(O)O—, —OC(O)—, —C(O)NH—, —NHC(O)—, —NH—, —CH═N—, —C(O)—, —O—, —S—, —C(O)OC(O)—, or a bond;

M is H, aryl, C-1 to C-20 linear or branched alkyl chain with or without any functional group anywhere in the chain, or

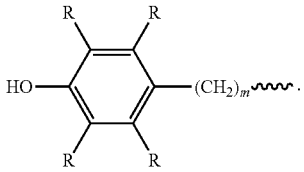

In one embodiment, the first antioxidants which are suitable for use in the compositions and methods of the present invention are sterically hindered phenol and phosphite based compounds, represented by a formula selected from I-III:

Specific examples of compounds which are suitable for use in the compositions and methods of the present invention are represented by one of the following structural formulas:

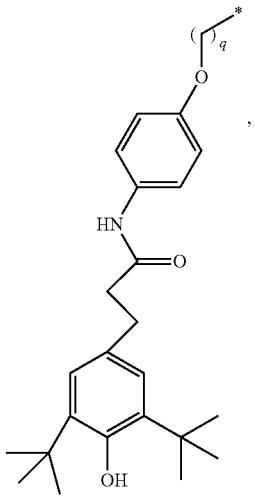

and

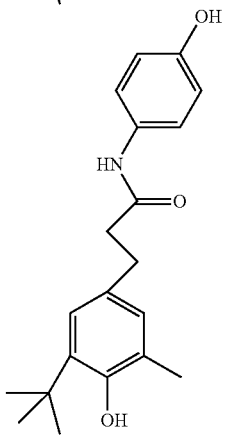

-continued

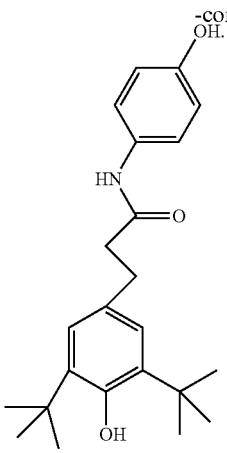

In one embodiment, the first antioxidants which are suitable for use in the compositions and methods of the present invention are sterically hindered phenol and phosphate based compounds, represented by a formula selected from O, P and Q.

O

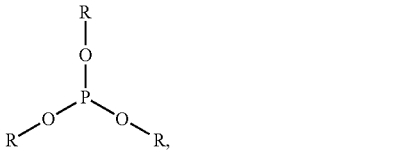

P

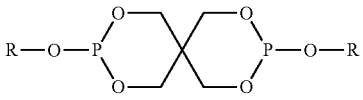

Q

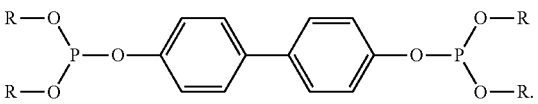

R is:

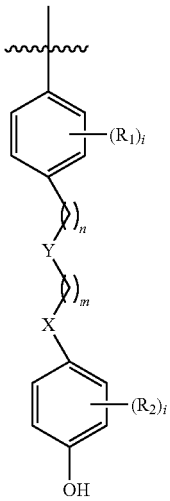

or

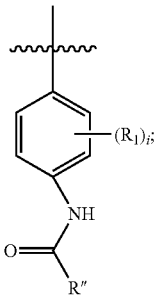

$R_1$ and $R_2$ in each occurrence, independently is an optionally substituted alkyl, optionally substituted aryl or optionally substituted aralkyl. In one embodiment, each $R_1$ and $R_2$ are independently an optionally substituted alkyl. In another embodiment, each $R_1$ and $R_2$ are independently a linear or branched C1-C6 alkyl.

In one embodiment R is:

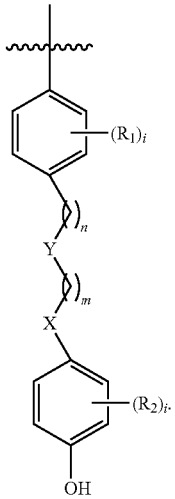

In another embodiment R is:

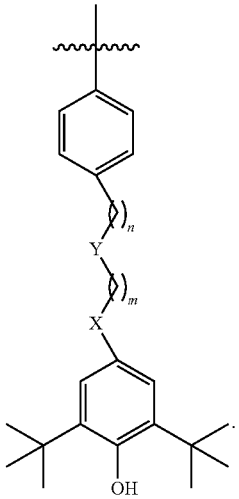

In yet another embodiment R is:

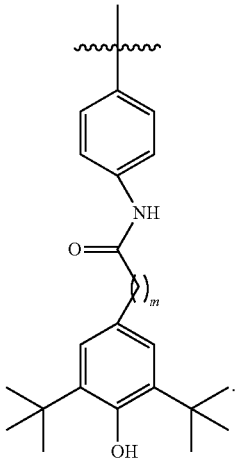

X and Y in each occurrence independently is a bond, —O—, —NH—, —C(O)NH—, —NHC(O)—, —C(O)O—, —OC(O)— or —$CH_2$—. In one embodiment, X and Y in each occurrence independently is a bond or —$CH_2$—. In another embodiment. X and Y in each occurrence independently is a bond, —O— or —$CH_2$—. In yet another embodiment, X and Y in each occurrence independently is a bond, —NH— or —$CH_2$—. In yet another embodiment, X and Y in each occurrence independently is a bond, —C(O)NH— or —$CH_2$—. In yet another embodiment, X and Y in each occurrence independently is a bond, —NHC(O)—, or —$CH_2$—. In yet another embodiment, X and Y in each occurrence independently is a bond, —C(O)O— or —$CH_2$—. In yet another embodiment, X and Y in each occurrence independently is a bond, —OC(O)— or —$CH_2$—.

n and m in each occurrence independently is 0 or a positive integer. In one embodiment, n and m in each occurrence independently is 0 to 18. In another embodiment, n and m in each occurrence independently is 0 to 12. In yet another embodiment, n and m are in each occurrence independently is 0 to 6.

i and j in each occurrence independently is 0, 1, 2, 3 or 4. In one embodiment i and j in each occurrence independently is 0, 1 or 2. In a particular embodiment, i is 0. In another particular embodiment j is 2.

R" is an optionally substituted alkyl. In one embodiment R" is C1-C6 alkyl.

In a particular embodiment, for compounds represented by structural formulas O, P and Q, R is:

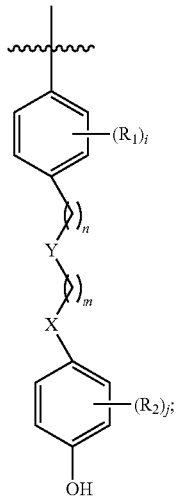

and n and m in each occurrence independently is 0 to 12, and the remainder of the variables are as described above for structural formulas O, P and Q.

In another particular embodiment, for compounds represented by structural formulas O, P and Q, R, n and m are as described immediately above, and $R_1$ and $R_2$ in each occurrence, independently is an optionally substituted alkyl; i and j in each occurrence independently is 0, 1 or 2; and the remainder of the variables are as described above for structural formulas O, P and Q.

In yet another particular embodiment, for compounds represented by structural formulas O, P and Q, $R_1$, $R_2$, i and j are as described immediately above, and R is:

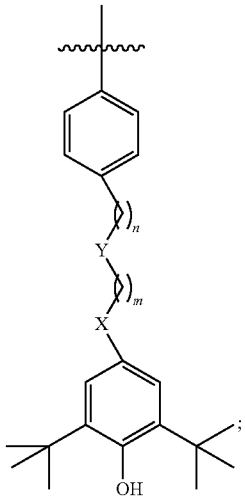

n and m in each occurrence, independently is 0 to 6; and the remainder of the variables are as described above for structural formulas O, P and Q.

In another particular embodiment, for compounds represented by structural formulas O, P and Q, $R_1$, $R_2$, i, j, R, n and m are as described immediately above, and X and Y in each occurrence, independently is a bond or —$CH_2$—; and the remainder of the variables are as described above for structural formulas O, P and Q.

In another particular embodiment, for compounds represented by structural formulas O, P and Q, $R_1$, $R_2$, i, j, R, n and m are as described immediately above, and X and Y in each occurrence, independently is a bond, —O— or —$CH_2$—; and the remainder of the variables are as described above for structural formulas O, P and Q.

In another particular embodiment, for compounds represented by structural formulas O, P and Q, $R_1$, $R_2$, i, j, R, n and m are as described immediately above, and X and Y in each occurrence, independently is a bond, —NH— or —$CH_2$—; and the remainder of the variables are as described above for structural formulas O, P and Q.

In another particular embodiment, for compounds represented by structural formulas O, P and Q, $R_1$, $R_2$, i, j, R, n and m are as described immediately above, and X and Y in each occurrence, independently is a bond, —C(O)NH— or —$CH_2$—; and the remainder of the variables are as described above for structural formulas O, P and Q.

In another particular embodiment, for compounds represented by structural formulas O, P and Q, $R_1$, $R_2$, i, j, R, n and m are as described immediately above, and X and Y in each occurrence, independently is a bond, —NHC(O)—, or —$CH_2$—; and the remainder of the variables are as described above for structural formulas O, P and Q.

In another particular embodiment, for compounds of the present invention represented by structural formulas O, P and Q, $R_1$, $R_2$, i, j, R, n and m are as described immediately above, and X and Y in each occurrence, independently is a bond, —C(O)O— or —$CH_2$—; and the remainder of the variables are as described above for structural formulas O, P and Q.

In another particular embodiment, for compounds of the present invention represented by structural formulas O, P and Q, $R_1$, $R_2$, i, j, R, n and m are as described immediately above, and X and Y in each occurrence, independently is a bond, —OC(O)— or —$CH_2$—; and the remainder of the variables are as described above for structural formulas O, P and Q.

In an additional embodiment, for formulas O, P and Q R is:

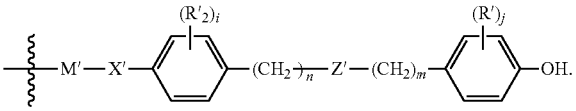

n and m in each occurrence, independently is 0 or a positive integer. In one embodiment, n and m in each occurrence, independently is 0 to 18. In another embodiment, n and m in each occurrence, independently is 0 to 12. In yet another embodiment, n and m in each occurrence, independently is 0 to 6.

i and j in each occurrence, independently is 0, 1, 2, 3 or 4. In one embodiment, i and j in each occurrence, independently is 0, 1 or 2. In a particular embodiment, i is 0. In another particular embodiment, j is 2.

Z' is —C(O)O—, —OC(O)—, —C(O)NH—, —NHC(O)—, —NH—, —CH═N—, —C(O)—, —O—, —S—, —C(O)OC(O)— or a bond. In one embodiment, Z' is —C(O)O—. In another embodiment, Z' is —OC(O)—. In yet another embodiment, Z' is —C(O)NH—. In yet another embodiment, Z' is —NHC(O)—. In yet another embodiment, Z' is —NH—. In yet another embodiment, Z' is —CH═N—. In yet another embodiment, Z' is —C(O)—. In yet another embodiment, Z' is —O—. In yet another embodiment, Z' is —S—. In yet another embodiment, Z' is —C(O)OC(O)—. In yet another embodiment, Z' is a bond.

R' is an optionally substituted C1-C6 alkyl, —OH, —$NH_2$, —SH, an optionally substituted aryl, an ester or

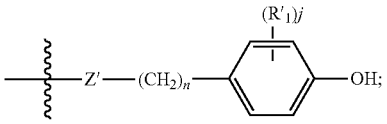

wherein at least one R' adjacent to the —OH group is an optionally substituted bulky alkyl group (e.g., butyl, sec-butyl, tert-butyl, 2-propyl, 1,1-dimethylhexyl, and the like).

$R'_1$ is an optionally substituted C1-C6 alkyl, an optionally substituted aryl, an optionally substituted aralkyl, —OH, —$NH_2$, —SH, or C1-C6 alkyl ester wherein at least one $R_1$ adjacent to the —OH group is a bulky alkyl group (e.g., butyl, sec-butyl, tert-butyl, 2-propyl, 1,1-dimethylhexyl, and the like).).

$R'_2$ is an optionally substituted C1-C6 alkyl, an optionally substituted aryl, an optionally substituted aralkyl, —OH, —$NH_2$, —SH, or ester.

X' is —C(O)O—, —OC(O)—, —C(O)NH—, —NHC(O)—, —NH—, —CH═N—, —C(O)—, —O—, —S—, —C(O)OC(O)— or a bond. In one embodiment X' is —C(O)O—. In another embodiment X' is —OC(O)—. In yet another embodiment X' is —C(O)NH—. In yet another embodiment X' is —NHC(O)—. In yet another embodiment X' is —NH—. In yet another embodiment X' is —CH═N—. In yet another embodiment X' is —C(O)—. In yet another embodiment X' is —O—. In yet another embodiment X' is —S—. In yet another embodiment X' is —C(O)OC(O)—. In yet another embodiment X' is a bond.

M' is H, an optionally substituted aryl, an optionally substituted C1-C20 linear or branched alkyl chain with or without any functional group anywhere in the chain, or

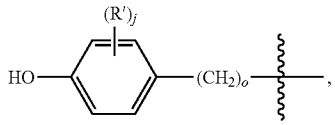

o is 0 or a positive integer. Preferably o is 0 to 18. More preferably o is 0 to 12. Even more preferably o is 0 to 6.

In yet another embodiment, for formulas 0, P and Q R is:

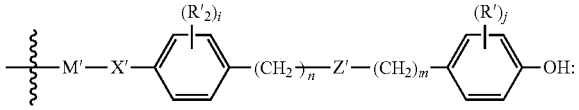

$R'_2$ is C1-C6 alkyl, —OH, —$NH_2$, —SH, aryl, ester, aralkyl or

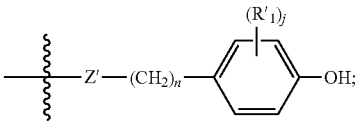

wherein at least one $R'_2$ is —OH, and the values and preferred values for the remainder of the variables for R are as described immediately above.

In yet another embodiment, the present invention relates to a compound of formula O, P and Q, wherein M is

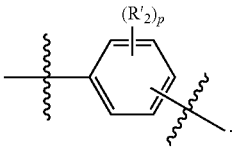

Wherein p is 0, 1, 2, 3 or 4; and the values and preferred values for the remainder of the variables are as described above for formulas O, P and Q.

Specific examples of compounds which are suitable for use in the compositions and methods of the present invention are represented by one of the following structural formulas:

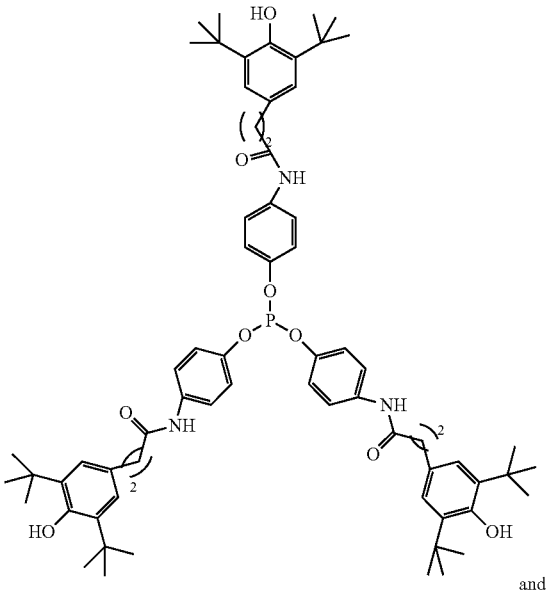
and
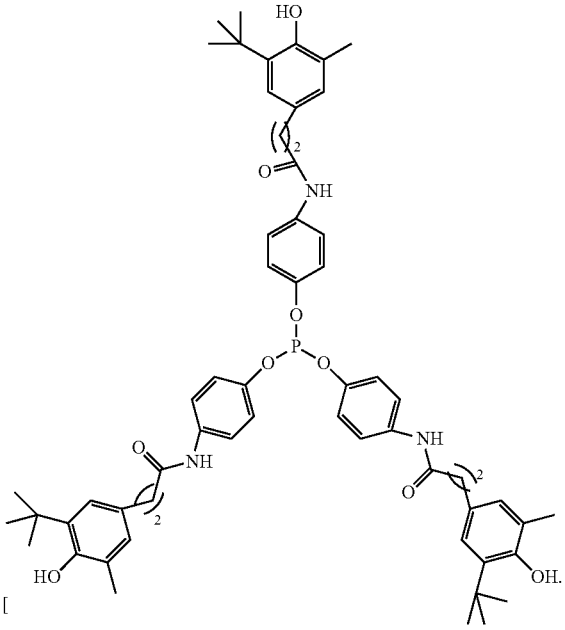
[
In another embodiment, the first antioxidants which are suitable for use in the compositions and methods of the present invention are represented by a structural formula selected from 1-6:
1
i.
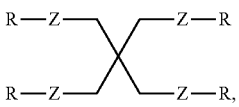
-continued
2
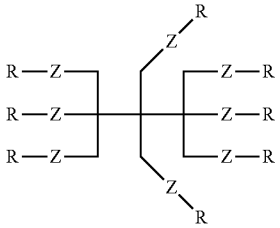
3
ii.
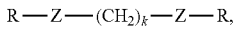
4
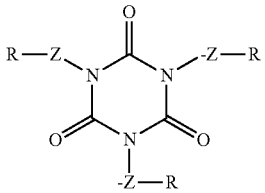
5
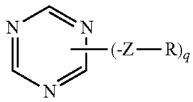
and
6
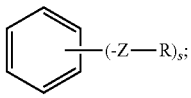
R is:
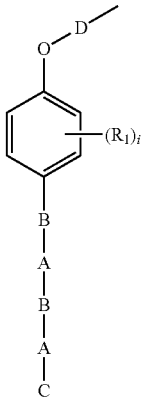
A in each occurrence, independently is a bond, —O—, —NH—, —S—, —C(O)—, —C(O)NH—, —NHC(O)—, —C(O)O—, —OC(O)—, —CH═N— or —N═CH—. In certain particular embodiments, A in each occurrence, independently is —C(O)NH— or —NHC(O)—.

B in each occurrence, independently is a bond or an optionally substituted alkylene group. In certain particular embodiments B is a C1-C6 alkyl.

C in each occurrence, independently is —H, an optionally substituted alkyl group or

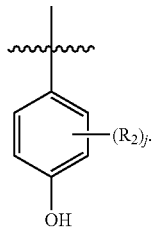

In a particular embodiment, C is:

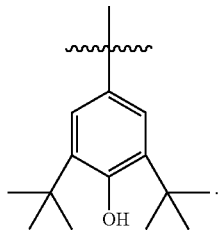

In a particular embodiment R is:

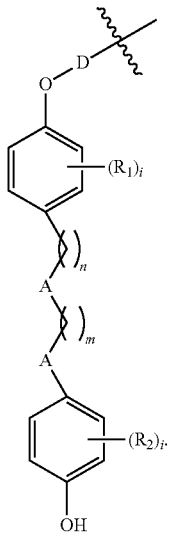

In another particular embodiment R is:

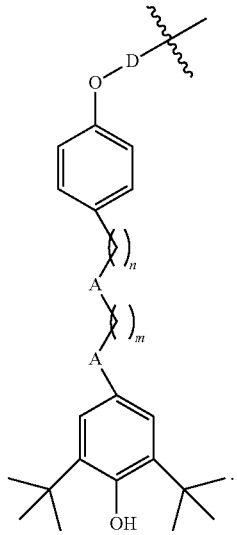

In yet another particular embodiment R is:

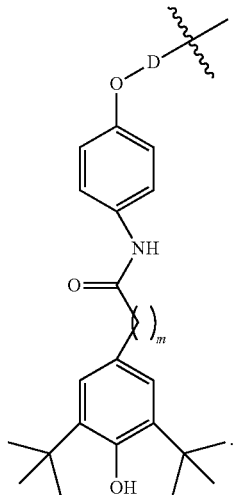

$R_1$ and $R_2$ in each occurrence, independently is an optionally substituted alkyl, optionally substituted aryl or optionally substituted aralkyl. In one embodiment, each $R_1$ and $R_2$ in each occurrence, independently is an optionally substituted alkyl. In another embodiment, each $R_1$ and $R_2$ in each occurrence, independently is a C1-C6 alkyl.

D in each occurrence, independently is a bond, an optionally substituted alkylene group, —$(CH_2)_1C(O)O(CH_2)_l$—, —$(CH_2)_lNHC(O)(CH_2)_l$—, —$(CH_2)_1C(O)NH(CH_2)_l$—, —$(CH_2)_1C(O)O(CH_2)_l$—, —$(CH_2)_lOC(O)(CH_2)_l$—, —$(CH_2)_lCH{=}N(CH_2)_l$—, —$(CH_2)_1N{=}CH(CH_2)_l$—, —$(CH_2)_1NH(CH_2)_l$—, —$(CH_2)_1S$—$(CH_2)_l$—, —$(CH_2)_lO(CH_2)_l$— or —$(CH_2)_1C(O)(CH_2)_l$—.

Z in each occurrence, independently is a bond, an optionally substituted alkylene group, —S—, —O— or —NH—.

i and j in each occurrence, independently is 0, 1, 2, 3 or 4. In one embodiment i and j in each occurrence, independently is 0, 1 or 2. In a particular embodiment, i is 0. In another particular embodiment, j is 2.

k is a positive integer from 1 to 20. In one embodiment, k is a positive integer from 1 to 12. In another embodiment, k is a positive integer from 1 to 6.

l is 0 or a positive integer from 1 to 20. In one embodiment, 1 is 0 or a positive integer from 1 to 12. In another embodiment, 1 is 0 or a positive integer from 1 to 6.

n and m in each occurrence independently is 0 or a positive integer. In one embodiment, n and m in each occurrence independently is 0 to 18. In another embodiment, n and m in each occurrence independently is 0 to 12. In yet another embodiment, n and m are in each occurrence independently is 0 to 6.

s is a positive integer from 1 to 6.

q is a positive integer from 1 to 3.

D in each occurrence, independently is a bond, an optionally substituted alkylene group, —$(CH_2)_lC(O)O(CH_2)_h$—, —$(CH_2)_lNHC(O)(CH_2)_h$—, —$(CH_2)_lC(O)NH(CH_2)_h$—, —$(CH_2)_lC(O)O(CH_2)_h$—, —$(CH_2)_lOC(O)(CH_2)_h$—, —$(CH_2)_lCH{=}N(CH_2)_h$—, —$(CH_2)_lN{=}CH(CH_2)_h$—, —$(CH_2)_lNH(CH_2)_h$—, —$(CH_2)_lS$—$(CH_2)_h$—, —$(CH_2)_lO(CH_2)_h$— or —$(CH_2)_lC(O)(CH_2)_h$—.

Z in each occurrence, independently is a bond, an optionally substituted alkylene group, —S—, —O— or —NH—. In a particular embodiment, Z is a single bond.

i and j in each occurrence, independently is 0, 1, 2, 3 or 4. In one embodiment i and j in each occurrence, independently is 0, 1 or 2. In a particular embodiment, i is 0. In another particular embodiment, j is 2.

k is a positive integer from 1 to 20. In one embodiment, k is a positive integer from 1 to 12. In another embodiment, k is a positive integer from 1 to 6.

l is 0 or a positive integer from 1 to 20, and when D is —$(CH_2)_lNHC(O)(CH_2)_h$—, —$(CH_2)_lOC(O)(CH_2)_h$—, —$(CH_2)_lS$—$(CH_2)_h$—, or —$(CH_2)_l O(CH_2)_h$—, l is not 0. In one embodiment, l is 0 or a positive integer from 1 to 12. In another embodiment, l is 0 or a positive integer from 1 to 6.

h is 0 or a positive integer from 1 to 20, When Z is not a bond and D is —$(CH_2)_lC(O)O(CH_2)_h$—, —$(CH_2)_lC(O)NH(CH_2)_h$—, —$(CH_2)_lC(O)O(CH_2)_h$—, —$(CH_2)_lNH(CH_2)_h$—, —$(CH_2)_lS$—$(CH_2)_h$—, or —$(CH_2)_l O(CH_2)_h$—, h is not 0. In one embodiment, h is 0 or a positive integer from 1 to 12. In another embodiment, h is 0 or a positive integer from 1 to 6. In another embodiment, h is 0.

In certain other embodiments R is:

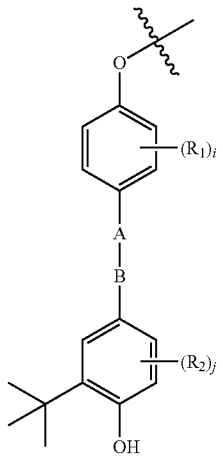

$R_1$ and $R_2$ in each occurrence, independently is —H, —OH, a C1-C10 alkyl group or a tert-butyl group; A is —NHC(O)— or —C(O)O— and B is a bond or a C1-C24 alkylene, and i and j are 0, 1, 2, 3 or 4.

In other certain embodiments, the present invention is directed to macromolecular antioxidants represented by a structural formula selected from Structural Formulas 1-6, wherein R is:

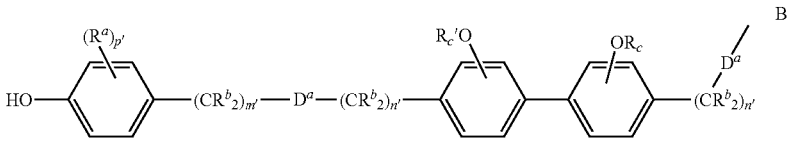

wherein:

$D^a$, for each occurrence, is independently —$C(O)NR_d$—, —$NR_dC(O)$—, —$NR_d$—, —$CR_d{=}N$—, —C(O)—, —C(O)O—, —OC(O)—, —O—, —S—, —C(O)OC(O)— or a bond. In certain other embodiments $D^a$ is —C(O)O—, —OC(O)—, —C(O)NH—, —NHC(O)—, —NH—, —O— or —C(O)—. In certain other embodiments, $D^a$ is —NH—, —C(O)NH— or —NHC(O)—. Optionally, $D^a$ is not —C(O)O—, —OC(O)—, —O— or —NH—. In various embodiments, the present invention relates to a compound of Structural Formula I and the attendant definitions, wherein $D^a$ is —OC(O)—. In another embodiment, $D^a$ is —C(O)O—. In another embodiment, $D^a$ is —C(O)NH—. In another embodiment, $D^a$ is —NHC(O)—. In another embodiment, $D^a$ is —NH—. In another embodiment, $D^a$ is —CH═N—. In another embodiment, $D^a$ is —C(O)—. In another embodiment, $D^a$ is —O—. In another embodiment, $D^a$ is —C(O)OC(O)—. In another embodiment, $D^a$ is a bond.

Each $R_d$ is independently —H or optionally substituted alkyl. In certain other embodiments $R_d$ is —H or an alkyl group. In certain other embodiments $R_d$ is —H or a C1-C10 alkyl group. In certain other embodiments $R_d$ is —H.

$R_c$ and $R_c$' are independently H or an optionally substituted alkyl. In one embodiment, $R_c$ and are H. In another embodiment, one of R, and is H and the other is an optionally substituted alkyl. More specifically, the alkyl is a C1-C10 alkyl. Even more specifically, the alkyl is a C10 alkyl.

$R^a$, for each occurrence, is independently an optionally substituted alkyl, optionally substituted aryl, optionally substituted alkoxycarbonyl, optionally substituted ester, —OH, —$NH_2$, or —SH. In certain other embodiments, each $R^a$ is independently an optionally substituted alkyl or optionally substituted alkoxycarbonyl. In certain other embodiment each $R^a$ is independently an alkyl or alkoxycarbonyl. In certain other embodiments each $R^a$ is independently a $C_1$-$C_6$ alkyl or a $C_1$-$C_6$ alkoxycarbonyl. In certain other embodiments each $R^a$ is independently tert-butyl or propoxycarbonyl. In certain other embodiments each $R^a$ is independently an alkyl group. In certain embodiments each $R^a$ is independently a bulky alkyl group. Suitable examples of bulky alkyl groups include butyl, sec-butyl, tert-butyl, 2-propyl, 1,1-dimethylhexyl, and the like. In certain embodiments each $R^a$ is tert-butyl. In certain embodiments at least one $R^a$ adjacent to the —OH group is a bulky alkyl group (e.g., butyl, sec-butyl, tert-butyl, 2-propyl, 1,1-dimethylhexyl, and the like). In certain other embodiments both $R^a$ groups adjacent to —OH are bulky alkyl groups (e.g., butyl, sec-butyl, tert-butyl, 2-propyl, 1,1-dimethylhexyl, and the like). In another embodiment, both $R^a$ groups are tert-butyl. In another embodiment, both $R^a$ groups are tert-butyl adjacent to the OH group.

$R^b$, for each occurrence, is independently H or optionally substituted alkyl. In certain embodiment, $R^b$ is H.

Each n' and m' are independently integers from 0 to 18. In another embodiment, n' and m' in each occurrence, independently is 0 to 12. In yet another embodiment, n' and m' in each occurrence, independently is 0 to 6. In certain embodiments each n' and m' are independently integers from 0 to 2. In a specific embodiment, n' is 0. In another specific embodiment, m is an integer from 0 to 2. In another specific embodiment, n' is 0 and m' is 2.

Each p' is independently an integer from 0 to 4. In certain embodiments, each p' is independently an integer from 0 to 2. In certain embodiments, p' is 2.

In one embodiment the first antioxidants which are suitable for use in the compositions and methods of the present invention are represented by:

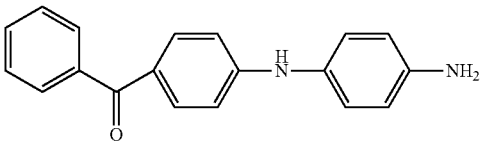

or

-continued

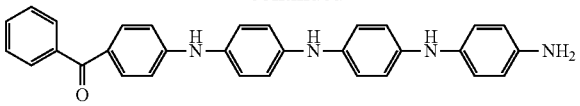

In an additional embodiment, for formulas 1-6 R is:

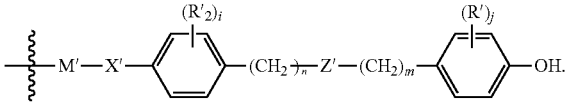

n and m in each occurrence, independently is 0 or a positive integer. In one embodiment, n and m in each occurrence, independently is 0 to 18. In another embodiment, n and m in each occurrence, independently is 0 to 12. In yet another embodiment, n and m in each occurrence, independently is 0 to 6.

i and j in each occurrence, independently is 0, 1, 2, 3 or 4. In one embodiment, i and j in each occurrence, independently is 0, 1 or 2. In a particular embodiment, i is 0. In another particular embodiment, j is 2.

Z' in each occurrence, independently is —C(O)O—, —OC(O)—, —C(O)NH—, —NHC(O)—, —NH—, —CH═N—, —C(O)—, —O—, —S—, —C(O)OC(O)— or a bond. In one embodiment, Z' is —C(O)O—. In another embodiment, Z' is —OC(O)—. In yet another embodiment, Z' is —C(O)NH—. In yet another embodiment, Z' is —NHC(O)—. In yet another embodiment, Z' is —NH—. In yet another embodiment, Z' is —CH═N—. In yet another embodiment, Z' is —C(O)—. In yet another embodiment, Z' is —O—. In yet another embodiment, Z' is —S—. In yet another embodiment, Z' is —C(O)OC(O)—. In yet another embodiment, Z' is a bond.

R' in each occurrence, independently is C1-C6 alkyl, —OH, —$NH_2$, —SH, an optionally substituted aryl, an ester or

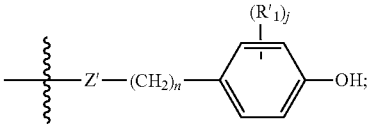

wherein at least one R' adjacent to the —OH group is an optionally substituted bulky alkyl group (e.g., butyl, sec-butyl, tert-butyl, 2-propyl, 1,1-dimethylhexyl, and the like).

$R'_1$ in each occurrence, independently is C1-C6 alkyl, an optionally substituted aryl, an optionally substituted aralkyl, —OH, —$NH_2$, —SH, or C1-C6 alkyl ester wherein at least one $R_1$ adjacent to the —OH group is a bulky alkyl group (e.g., butyl, sec-butyl, tert-butyl, 2-propyl, 1,1-dimethylhexyl, and the like).).

$R'_2$ in each occurrence, independently is C1-C6 alkyl, an optionally substituted aryl, an optionally substituted aralkyl, —OH, —$NH_2$, —SH, or ester.

X' in each occurrence, independently is —C(O)O—, —OC(O)—, —C(O)NH—, —NHC(O)—, —NH—, —CH═N—, —C(O)—, —O—, —S—, —C(O)OC(O)— or a bond. In one embodiment X' is —C(O)O—. In another embodiment X' is —OC(O)—. In yet another embodiment X' is —C(O)NH—. In yet another embodiment X' is —NHC(O)—. In yet another embodiment X' is —NH—. In yet another embodiment X' is —CH═N—. In yet another embodiment X' is —C(O)—. In yet another embodiment X' is —O—. In yet another embodiment X' is —S—. In yet another embodiment X' is —C(O)OC(O)—. In yet another embodiment X' is a bond.

M' is H, an optionally substituted aryl, C1-C20 linear or branched alkyl chain with or without any functional group anywhere in the chain, or

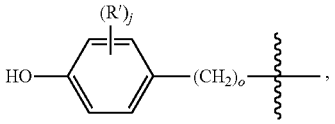

o is 0 or a positive integer. Preferably o is 0 to 18. More preferably o is 0 to 12. Even more preferably o is 0 to 6.

In yet another embodiment, for formulas 1-6 R is:

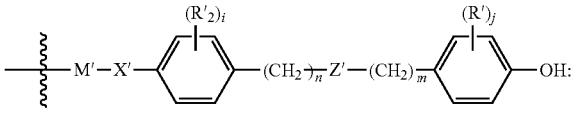

$R'_2$ is C1-C6 alkyl, —OH, —$NH_2$, —SH, aryl, aralkyl, ester, or

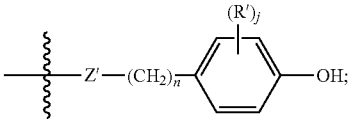

wherein at least one $R'_2$ is —OH, and the values and preferred values for the remainder of the variables for R are as described immediately above.

In yet another embodiment, the present invention relates to a compound of formula 1-6, wherein M is

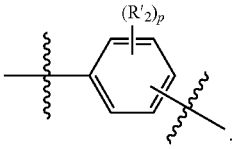

Wherein p is 0, 1, 2, 3 or 4; and the values and preferred values for the remainder of the variables are as described above for formulas 1-6.

Specific examples of first macromolecular antioxidants which are suitable for use in the compositions and methods of the present invention, for example, high molecular weight dimers, and tetramers etc., are shown below.

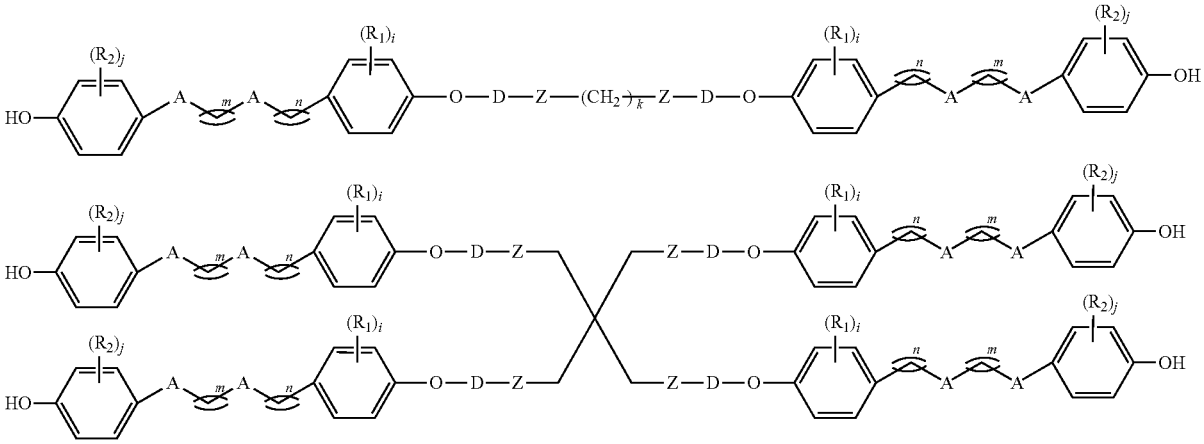

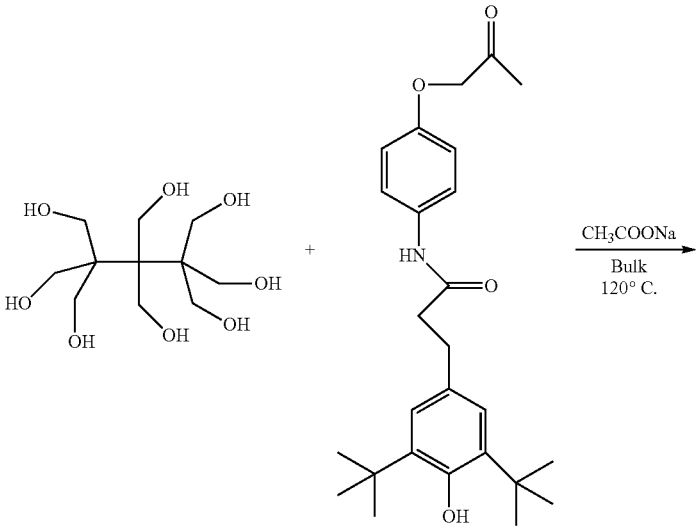

-continued
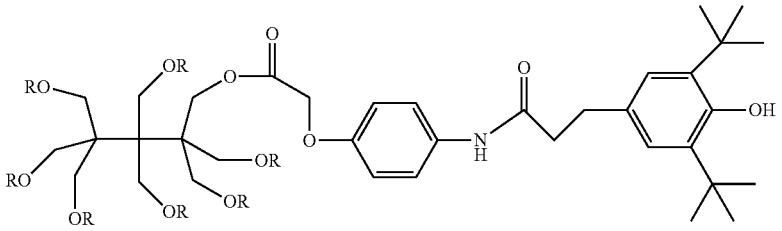
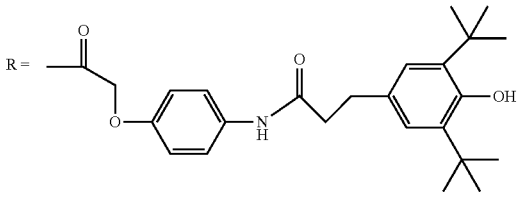
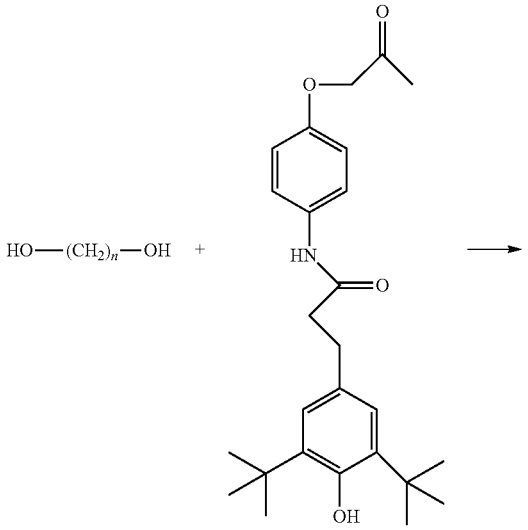
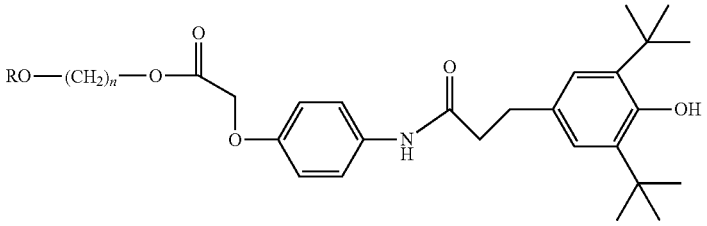
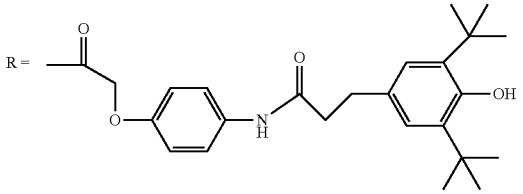

-continued
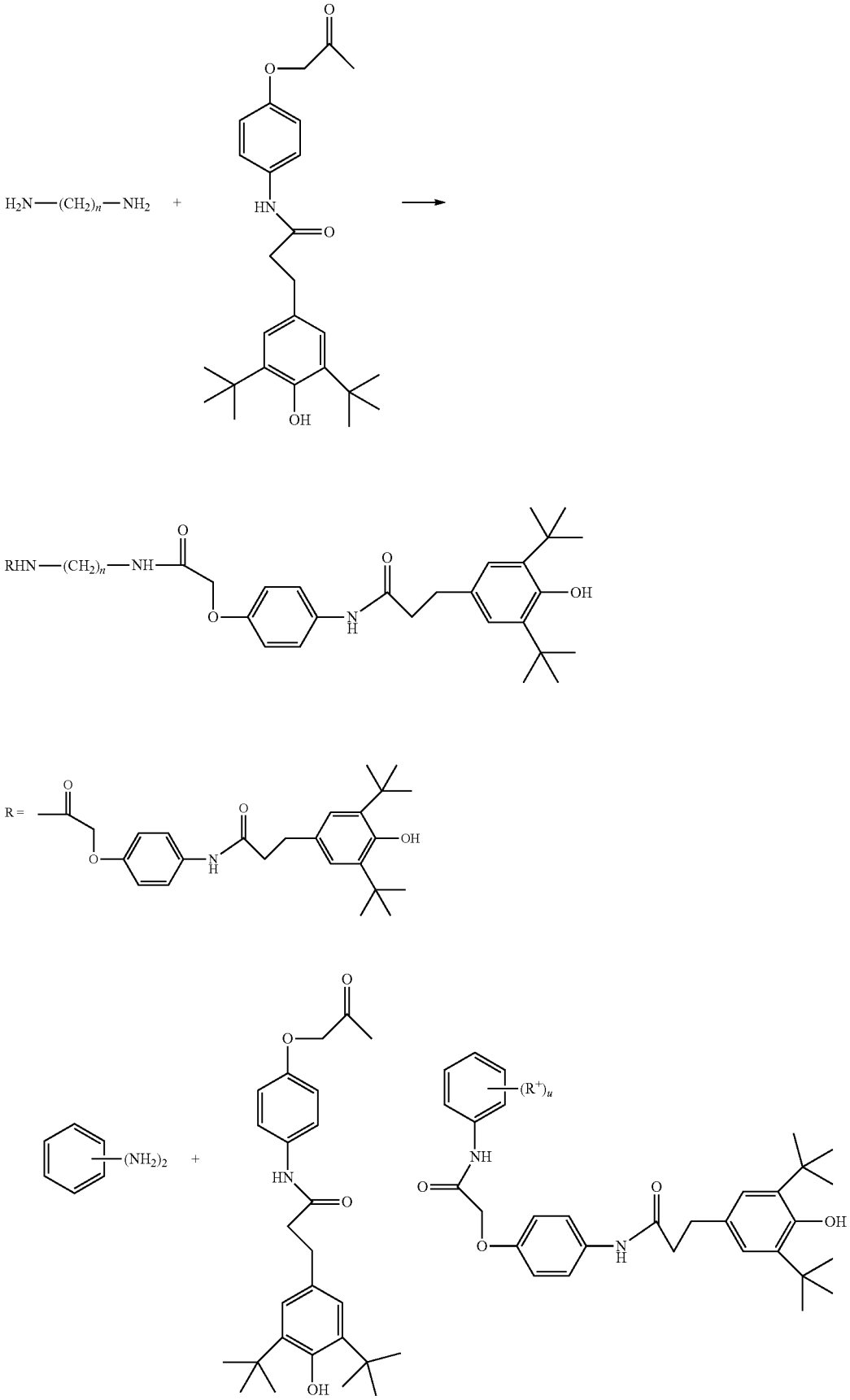

-continued
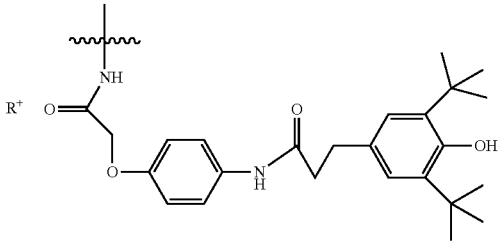
u is 1, 2, 3, 4 or 5
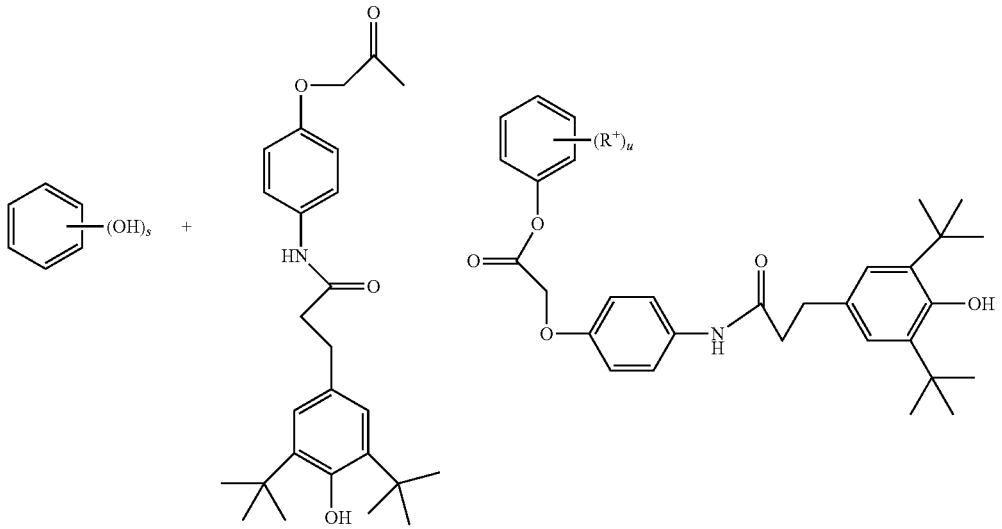
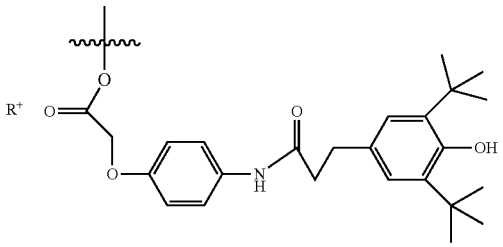
u is 1, 2, 3, 4 or 5
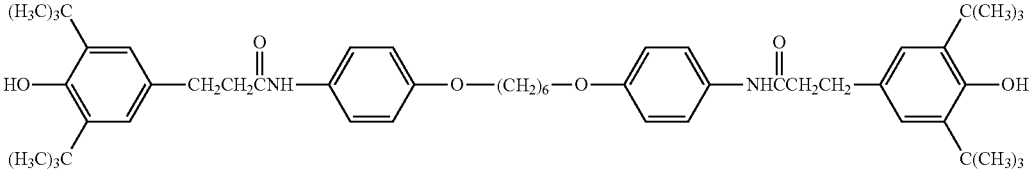

The values and preferred values for the variables are as described above.

In another embodiment, the first antioxidants which are suitable for use in the compositions and methods of the present invention are represented by a structural formula selected from 7a, 7b, 8a and 8b:

7a

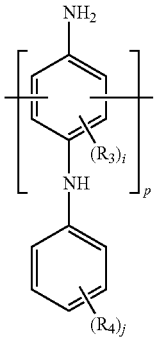

7b

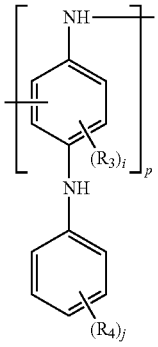

8a

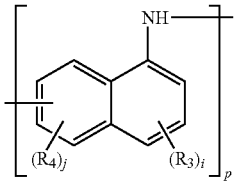

and

-continued

8b

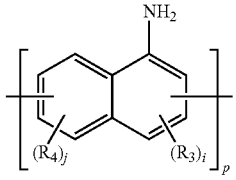

$R_3$ and $R_4$ in each occurrence, independently is C1-C16 alkyl, —O—(C1-C16 alkyl), —NH(aryl), —$NH_2$, —OH, or —SH.

p in each occurrence, independently is an integer equal to or greater than 2.

Specific examples of polymers which are useful in the compositions methods of the present invention include:

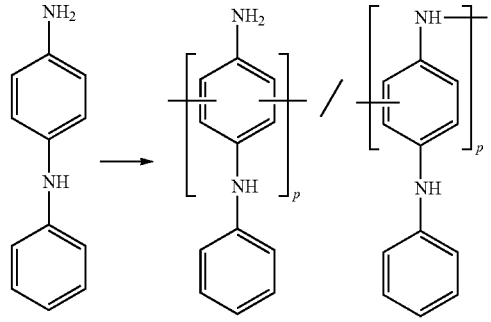

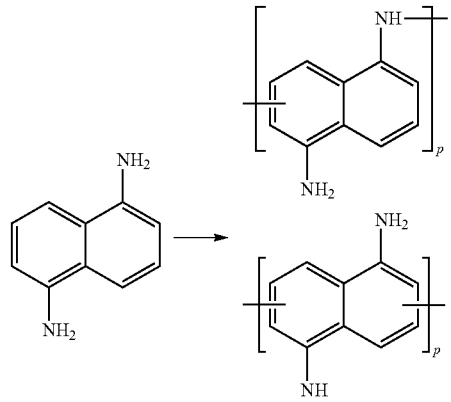

In one embodiment antioxidants suitable for use in the methods and compositions of the present invention include compounds represented by Structural Formula I:

I

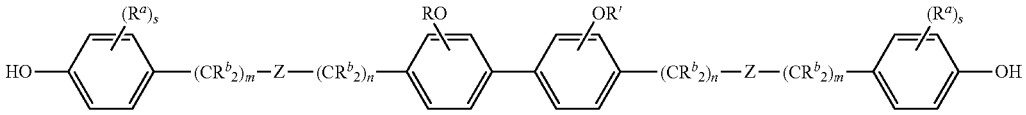

wherein:

R and R' are independently H or optionally substituted alkyl and at least one of R and R' is H;

Z is —C(O)NR$^c$—, —NR$^c$(O)—, —NR$^c$—, —CR$^c$=N—, —C(O)—, —C(O)O—, —OC(O)—, —O—, —S—, —C(O)OC(O)— or a bond;

R$^c$ is independently H or optionally substituted alkyl;

R$^a$, for each occurrence, is independently an optionally substituted alkyl, optionally substituted aryl, optionally substituted alkoxycarbonyl, optionally substituted ester, —OH, —NH$_2$, —SH;

R$^b$, for each occurrence, is independently H or optionally substituted alkyl;

s, for each occurrence, is independently an integer from 0 to 4; and m and n, for each occurrence, are independently integers from 0 to 6.

In one embodiment antioxidants suitable for use in the methods and compositions of the present invention include compounds represented by Structural Formula II:

II

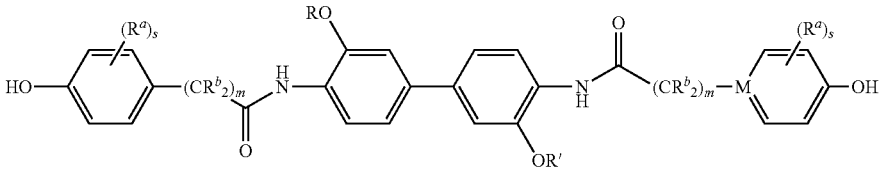

wherein:

R and R' are independently H or optionally substituted alkyl and at least one of R and R' is H;

R$^a$, for each occurrence, is independently an optionally substituted alkyl, optionally substituted aryl, optionally substituted alkoxycarbonyl, optionally substituted ester, —OH, —NH$_2$, or —SH;

R$^b$, for each occurrence, is independently H or optionally substituted alkyl.

s, for each occurrence, is independently an integer from 0 to 4; and m, for each occurrence, is independently an integer from 0 to 6.

In one embodiment antioxidants suitable for use in the methods and compositions of the present invention include compounds represented by Structural Formula III:

III

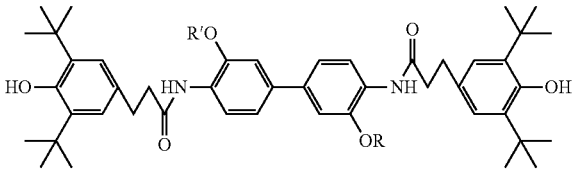

wherein R and R' are independently H or optionally substituted alkyl and at least one of R and R' is H.

In one embodiment antioxidants suitable for use in the methods and compositions of the present invention include a compound A represented by the following structural formula:

(A)

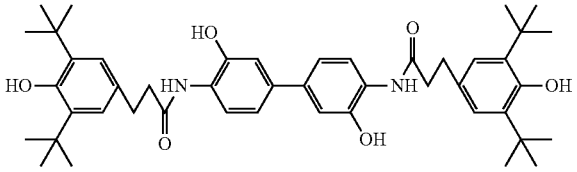

In one embodiment antioxidants suitable for use in the methods and compositions of the present invention include a compound B represented by the following structural formula:

(B)

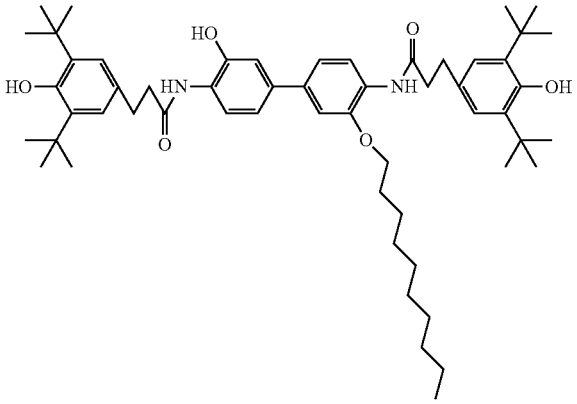

In one embodiment, the first antioxidants which are suitable for use in the compositions and methods of the present invention include antioxidant polymers which comprises at least one repeat unit selected from:

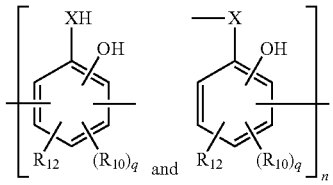

X is —O—, —NH— or —S—. Each $R_{10}$ is independently an optionally substituted C1-C10 alkyl group, an optionally substituted aryl group, and optionally substituted alkoxy group, an optionally substituted carbonyl group, an optionally substituted alkoxycarbonyl group, an optionally substituted aryloxycarbonyl group, —OH, —SH or —$NH_2$ or two $R_{10}$ groups on adjacent carbon atoms join together to form an optionally substituted aromatic ring or an optionally substituted carbocyclic or heterocyclic non-aromatic ring. q is an integer from 0 to 2. $R_{12}$ is a bulky alkyl group substituent bonded to a ring carbon atom adjacent (ortho) to a ring carbon atom substituted with an —OH, —SH or —$NH_2$ group. In certain embodiments, $R_{12}$ is a bulky alkyl group substituent bonded to a ring carbon atom meta or para to a ring carbon atom substituted with an —OH, —SH or —$NH_2$ group.

In certain embodiments, the first antioxidants which are suitable for use in the compositions and methods of the present invention include antioxidant polymers which comprises at least one repeat unit selected from:

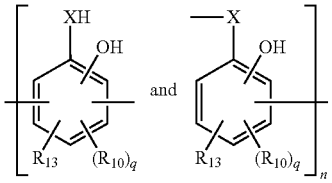

$R_{13}$ is an aryl group. In certain embodiments, the aryl group is adjacent (or ortho) to an —OH, —SH or —$NH_2$ group. In certain embodiments, the aryl group is adjacent (or ortho) to an —OH group. In certain embodiments, the aryl group is meta or para to an —OH, —SH or —$NH_2$ group. Each $R_{10}$ is independently an optionally substituted C1-C10 alkyl group, an optionally substituted aryl group, and optionally substituted alkoxy group, an optionally substituted carbonyl group, an optionally substituted alkoxycarbonyl group, an optionally substituted aryloxycarbonyl group, —OH, —SH or —$NH_2$ or two $R_{10}$ groups on adjacent carbon atoms join together to form an optionally substituted aromatic ring or an optionally substituted carbocyclic or heterocyclic non-aromatic ring. q is an integer from 0 to 2. $R_{12}$ is a bulky alkyl group substituent bonded to a ring carbon atom adjacent (ortho) to a ring carbon atom substituted with an —OH group.

In certain embodiments, the —OH groups in the structures in the two immediately preceding paragraphs may be replaced with —SH or —$NH_2$.

In one embodiment, the first antioxidants which are suitable for use in the compositions and methods of the present invention include a macromonomer represented by the following structural formula:

I

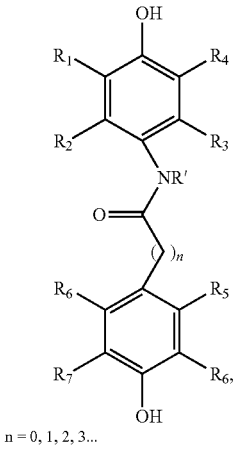

Each of R and $R_1$-$R_8$ are independently —H, —OH, or a C1-C10 alkyl group. n is an integer from 0 to 24. R' is —H, optionally substituted C1-C20 alkyl or optionally substituted aryl group.

Stabilized Lubricant Oil Compositions

Lubricants, lubricant oils, mixtures thereof and compositions comprising lubricants and lubricant oils can be improved by the methods of the present invention, by contacting the lubricant, lubricant oil, mixtures thereof or composition comprising the lubricant or lubricant oil or mixtures thereof with antioxidants, additives and mixtures thereof as described herein.

As used here, the terms "lubricants" and "lubricant oils" can be used interchangeably. Examples of lubricants suitable for use in the compositions and methods of the present invention include, but are not limited to: i) petroleum based oils (Group I, II and III), ii) synthetic oils (Group IV) and iii) biolubricant oils (vegetable oils such as canola, soybean, corn oil etc.,). Group I oils, as defined herein are solvent refined base oils. Group II oils, as defined herein are modern conventional base oils made by hydrocracking and early wax isomerization, or hydroisomerization technologies and have significantly lower levels of impurities than Group I oils. Group III oils, as defined herein are unconventional base oils. Groups I-III differ in impurities, and viscosity index as is shown in Kramer et al. "The Evolution of Base Oil Technology" *Turbine Lubrication in the 21st Century* ASTM STP #1407 W. R. Herguth and T. M. Wayne, Eds., American Society for Testing and Materials, West Conshohocken, Pa., 2001 the entire contents of which are incorporated herein by reference. Group IV oils as defined herein are "synthetic" lubricant oils, including for example, poly-alpha olefins (PAOs). Biolubricants as defined herein are lubricants which contain at least 51% biomaterial (see Scott Fields, Environmental Health Perspectives, volume 111, number 12, September 2003, the entire contents of which are incorporated herein by reference). Other examples of lubricant oils cane be found in Melvyn F. Askew "Biolubricants-Market Data Sheet" IENICA, August 2004 (as part of the IENICA workstream of the IENICA-INFORRM project); Taylor et al. "Engine lubricant Trends Since 1990" paper accepted for publication in the Proceedings I. Mech. E. Part J, Journal of Engineering Tribology, 2005 (Vol. 219 p 1-16); and Desplanches et al. "Formulating Tomorrow's Lubricants" page 49-52 of The Paths to Sustainable Development, part of special report published in October 2003 by Total; the entire contents of each of which are incorporated herein by reference. Biolubricants are often but not necessarily, based on vegetable oils. Vegetable derived, for example, from rapeseed, sunflower, palm and coconut can be used as biolubricants. They can also be synthetic esters which may be partly derived from renewable resources. They can be made from a wider variety of natural sources including solid fats and low grade or waste materials such as tallows. Biolubricants in general offer rapid biodegradability and low environmental toxicity.

Additives

Examples of first additives suitable for use in the compositions and methods of the present invention, include but are not limited to, surface additives, performance enhancing additives and lubricant protective additives.

Surface additives: In certain embodiments of the present invention, surface additives can protect the surfaces that are lubricated from wear, corrosion, rust, and frictions. Examples of these surface additives suitable for use in the compositions and methods of the present invention include, but are not limited to: (a) rust inhibitors, (b) corrosion inhibitors, (c) extreme pressure agents, (d) tackiness agents, (e) antiwear agents, (f) detergents and dispersants, (g) compounded oil (like fat or vegetable oil to reduce the coefficient of friction without affecting the viscosity), (h) antimisting, (i) seal swelling agents and (j) biocides.

Performance Enhancing Additives: In certain embodiments of the present invention, performance enhancing additives improve the performance of lubricants. Examples of these performance enhancing additives suitable for use in the Compositions and methods of the present invention include, but are not limited to: (a) pour-point depressants, (b) viscosity index modifiers (c) emulsifiers, and (d) demulsifiers.

Lubricant Protective Additives: In certain embodiments of the present invention, lubricant protective additives maintain the quality of oil from oxidation and other thermal degradation processes. Examples of these lubricant protective additives suitable for use in the compositions and methods of the present invention include, but are not limited to: (a) oxidation inhibitors and (b) foam inhibitors.

Other Lubricant Additives

In certain embodiments, a second additive can be used in the compositions and methods of the present invention in combination with the first antioxidant and the first additive as described above. Examples of second additives suitable for use in the compositions and methods of the present invention include, include but are not limited to, for example, dispersants, detergents, corrosion inhibitors, rust inhibitors, metal deactivators, antiwear and extreme pressure agents, antifoam agents, friction modifiers, seal swell agents, demulsifiers, viscosity index improvers, pour point depressants, and the like. See, for example, U.S. Pat. No. 5,498,809 for a description of useful lubricating oil composition additives, the disclosure of which is incorporated herein by reference in its entirety.

Dispersants: Examples of dispersants suitable for use in the compositions and methods of the present invention include, but are not limited to: polybutenylsuccinic acid-amides, -imides, or -esters, polybutenylphosphonic acid derivatives, Mannich Base ashless dispersants, and the like.

Detergents: Examples of detergents suitable for use in the compositions and methods of the present invention include, but are not limited to: metallic phenolates, metallic sulfonates, metallic salicylates, metallic phosphonates, metallic thiophosphonates, metallic thiopyrophosphonates, and the like.

Corrosion Inhibitors: Examples of corrosion inhibitors suitable for use in the compositions and methods of the present invention include, but are not limited to: phosphosulfurized hydrocarbons and their reaction products with an alkaline earth metal oxide or hydroxide, hydrocarbyl-thio-substituted derivatives of 1,3,4-thiadiazole, thiadiazole polysulphides and their derivatives and polymers thereof, thio and polythio sulphenamides of thiadiazoles such as those described in U.K. Patent Specification 1,560,830, and the like.

Rust Inhibitors: Examples of rust inhibitors suitable for use in the compositions and methods of the present invention include, but are not limited to: nonionic surfactants such as polyoxyalkylene polyols and esters thereof, anionic surfactants such as salts of alkyl sulfonic acids, and other compounds such as alkoxylated fatty amines, amides, alcohols and the like, including alkoxylated fatty acid derivatives treated with C9 to C16 alkyl-substituted phenols (such as the mono- and di-heptyl, octyl, nonyl, decyl, undecyl, dodecyl and tridecyl phenols).

Metal Deactivators: Metal deactivators as used herein, are the additives which form an inactive film on metal surfaces by complexing with metallic ions and reducing, for example, the catalytic effect on metal gum formation and other oxidation. Examples of metal deactivators suitable for use in the compositions and methods of the present invention include, but are not limited to: N,N-disubstituted aminomethyl-1,2,4-triazoles, N,N-disubstituted aminomethyl-benzotriazoles, mixtures thereof, and the like.

Antiwear and Extreme Pressure Additives: Antiwear and extreme pressure additives, as used herein, react with metal surfaces to form a layer with lower shear strength then metal, thereby preventing metal to metal contact and reducing friction and wear. Examples of antiwear additives suitable for use in the compositions and methods of the present invention include, but are not limited to: sulfurized olefins, sulfurized esters, sulfurized animal and vegetable oils, phosphate esters, organophosphites, dialkyl alkylphosphonates, acid phosphates, zinc dialkyldithiophosphates, zinc diaryldithiophosphates, organic dithiophosphates, organic phosphorothiolates, organic thiophosphates, organic dithiocarbamates, dimercaptothiadiazole derivatives, mercaptobenzothiazole derivatives, amine phosphates, amine thiophosphates, amine dithiophosphates, organic borates, chlorinated paraffins, and the like.

Antifoam Agents: Examples of antifoam agents suitable for use in the compositions and methods of the present invention include, but are not limited to: polysiloxanes and the like.

Friction Modifiers: Examples of friction modifiers suitable for use in the compositions and methods of the present invention include, but are not limited to: fatty acid esters and amides, organic molybdenum compounds, molybdenum dialkylthiocarbamates, molybdenum dialkyl dithiophosphates, molybdenum dithiolates, copper oleate, copper salicylate, copper dialkyldithiophosphates, molybdenum disulfide, graphite, polytetrafluoroethylene, and the like.

Seal Swell Agents: Seaswell agents, as used herein, react chemically with elastomers to cause slight swell thus improving low temperature performance especially in, for example, aircraft hydraulic oil. Examples of seal swell agents suitable for use in the compositions and methods of the present invention include, but are not limited to: dioctyl sebacate, dioctyl adipate, dialkyl phthalates, and the like.

Demulsifiers: Demulsifiers, as used herein promote separation of oil and water in lubricants exposed to water. Examples of demulsifiers suitable for use in the compositions and methods of the present invention include, but are not limited to: the esters described in U.S. Pat. Nos. 3,098,827 and 2,674,619 incorporated herein by reference.

Viscosity Index Improvers: Examples of viscosity index improvers suitable for use in the compositions and methods of the present invention include, but are not limited to: olefin copolymers, dispersant olefin copolymers, polymethacrylates, vinylpyrrolidone/methacrylate-copolymers, polyvinylpyrrolidones, polybutanes, styrene/-acrylate-copolymers, polyethers, and the like.

Pour Point Depressants: Pour point depressants as used herein reduce the size and cohesiveness of crystal structure resulting in low pour point and increased flow at low-temperatures. Examples of pour point depressants suitable for use in the compositions and methods of the present invention include, but are not limited to: polymethacrylates, alkylated naphthalene derivatives, and the like.

Other Antioxidants and Stabilizers

In certain embodiments, a second antioxidant or a stabilizer can be used in the compositions and methods of the present invention in combination with the first antioxidant and the first additive and optionally the second additive as described above. Examples of second antioxidants suitable for use in the compositions and methods of the present invention include, include but are not limited to:

1. Amine Antioxidants 1.1. Alkylated Diphenylamines, for example octylated diphenylamine; styrenated diphenylamine; mixtures of mono- and dialkylated tert-butyl-tert-octyldiphenylamines; and 4,4'-dicumyldiphenylamine.

1.2. Phenyl Naphthylamines, for example N-phenyl-1-naphthylamine; N-phenyl-2-naphthylamine; tert-octylated N-phenyl-1-naphthylamine.

1.3. Derivatives of para-Phenylenediamine, for example N,N'-diisopropyl-p-phenylenediamine; N,N'-di-sec-butyl-p-phenylenediamine; N,N'-bis(1,4-dimethylpentyl)-p-phenylenediamine; N,N'-bis(1-ethyl-3-methylpentyl)-p-phenylenediamine; N,N'-bis(1-methylheptyl)-p-phenylenediamine; N,N'-diphenyl-p-phenylenediamine; N,N'-di-(naphthyl-2)-p-phenylenediamine: N-isopropyl-N'-phenyl-p-phenylenediamine; N-(1,3-dimethylbutyl)-N'-phenyl-p-phenylenediamine; N-(1-methylheptyl)-N'-phenyl-p-phenylenediamine; N-cyclohexyl-N'-phenyl-p-phenylenediamine; N,N'-dimethyl-N,N'-di-sec-butyl-p-phenylenediamine.

1.4. Phenothiazines, for example phenothiazine; 2-methylphenothiazine; 3-octylphenothiazine; 2,8-dimethylphenothiazine; 3,7-dimethylphenothiazine; 3,7-dimethylphenothiazine; 3,7-dibutylphenothiazine; 3,7-dioctylphenothiazine; 2,8-dioctylphenothiazine.

1.5. Dihydroquinolines, for example 2,2,4-trimethyl-1,2-dihydroquinoline or a polymer thereof.

2. Phenolic Antioxidants 2.1. Alkylated monophenols, for example 2,6-di-tert-butyl-4-methylphenol; 2,6-di-tert-butylphenol; 2-tert-butyl-4,6-dimethylphenol, 2,6-di-tert-butyl-4-ethylphenol; 2,6-di-tert-butyl-4-n-butylphenol; 2,6-di-tert-butyl-4-isobutylphenol; 2,6-di-tert-butyl-4-sec-butylphenol; 2,6-di-tert-butyl-4-octadecylphenol; 2,6-di-tert-butyl-4-nonylphenol; 2,6-dicyclopentyl-4-methylphenol; 2-(α-methylcyclohexyl)-4,6-dimethylphenol; 2,6-dioctadecyl-4-methylphenol; 2,4,6-tricyclohexylphenol; 2,6-di-tert-butyl-4-methoxymethylphenol; 2,6-di-tert-butyl-4-dimethylaminomethylphenol; o-tert-butylphenol.

2.2. Alkylated hydroquinones, for example 2,6-di-tert-butyl-4-methoxyphenol; 2,5-di-tert-butylhydroquinone; 2,5-di-tert-amylhydroquinone; 2,6-di-phenyl-4-octadecyloxyphenol.

2.3. Hydroxylated thiodiphenyl ethers, for example 2,2'-thiobis(6-tert-butyl-4-methyl-phenol); 2,2'-thiobis(4-octylphenol); 4,4'-thiobis(6-tert-butyl-3-methylphenol); 4,4-thiobis(6-tert-butyl-2-methylphenol).

2.4. Alkylidenebisphenols, for example 2,2'-methylenebis(6-tert-butyl-4-methylphenol); 2,2'-methylenebis(6-tert-butyl-4-ethylphenol); 2,2'-methylenebis(4-methyl-6-(α-methylcyclohexyl)phenol); 2,2'-methylenebis(4-methyl-6-cyclohexylphenol); 2,2'-methylenebis(6-nonyl-4-methylphenol); 2,2'-methylenebis(4,6-di-tert-butylphenol); 2,2'-ethylidenebis(6-tert-butyl-4-isobutylphenol); 2,2'-methylenebis[6-α-methylbenzyl)-4-nonylphenol]; 2,2'-mnethylenebis[6-(α,α-dimethylbenzyl)-4-nonylphenol]; 4,4'-methylenebis(2,6-di-tert-butylphenol); 4,4'-methylenebis(6-tert-butyl-2-methylphenol); 1,1-bis(5-tert-butyl-4-hydroxy-2-methylphenyl)butane; 2,6-di(3-tert-butyl-5-methyl-2-hydroxybenzyl)-4-methylphenol; 1,1,3-tris(5-tert-butyl-4-hydroxy-2-methylphenyl)-3-n-dodecylmercaptobutane; ethylene glycol bis[3,3-bis(3'-tert-butyl-4'-hydroxylphenyl)butyrate]; di(3-tert-butyl-4-hydroxy-5-methylphenyl) dicyclopentadiene; di[2-(3'-tert-butyl-2'-hydroxy-5'-methylbenzyl)-6-tert-butyl-4-methylphenyl] terephthalate.

2.5. Benzyl compounds, for example 1,3,5-tris(3,5-di-tert-butyl-4-hydroxybenzyl)-2,4,6-trimethylbenzene; di(3,5-di-tert-butyl-4-hydroxybenzyl)sulfide; 3,5-di-tert-butyl-4-hydroxybenzylmercaptoacetic acid isooctyl ester; bis (4-tert-butyl-3-hydroxy-2,6-dimethyl-benzyl) dithioterephthalate; 1,3,5-tris(3,5-di-tert-butyl-4-hydroxybenzyl)isocyanurate; 1,3,5-tris(4-tert-butyl-3-hydroxy-2,6-dimethylbenzyl)isocyanurate; 3,5-di-tert-butyl-4-hydroxybenzylphosphonic acid dioctadecyl ester; 3,5-di-tert-butyl-4-hydroxybenzylphosphonic acid monoethyl ester calcium salt.

2.6. Acylaminophenols, for example 4-hydroxylauric acid anilide; 4-hydroxystearic acid anilide; 2,4-bis-octylmercapto-6-(3,5-di-tert-butyl-4-hydroxyaniline)-s-triazine; N-(3,5-di-tert-butyl-4-hydroxyphenyl)carbamic acid octyl ester.

2.7. Esters of β-(3,5-di-tert-butyl-4-hydroxyphenyl)propionic acid with mono- or polyhydric alcohols, e.g. with methanol; octadecanol; 1,6-hexanediol; neopentyl glycol; thiodiethylene glycol; diethylene glycol; triethylene glycol; pentaerythritol; tris(hydroxyethyl)isocyanurate; and di(hydroxyethyl)oxalic acid diamide.

2.8. Esters of β-(5-tert-butyl-4-hydroxy-3-methylphenyl) propionic acid with mono- or polyhydric alcohols. e.g. with methanol; octadecanol; 1,6-hexanediol; neopentyl glycol; thiodiethylene glycol; diethylene glycol; triethylene glycol; pentaerythritol; tris(hydroxyethyl)isocyanurate; and di(hydroxyethyl)oxalic acid diamide.

2.9. Amides of β-(3,5-di-tert-butyl-4-hydroxyphenyl)propionic acid, e.g., N,N'-di(3,5-di-tert-butyl-4-hydroxyphenyl-propionyl)hexamethylenediamine N,N'-di(3,5-di-tert-butyl-4-hydroxyphenylpropionyl)trimethylenediamine; N,N'-di-(3,5-di-tert-butyl-4-hydroxyphenylpropionyl)hydrazine.

3. Sulfurized organic compounds, for example aromatic, alkyl, or alkenyl sulfides and polysulfines; sulfurized olefins; sulfurized fatty acid esters; sulfurized ester olefins; sulfurized oils; esters of β-thiodipropionic acid;

sulfurized Diels-Alder adducts; sulfurized terpene compounds; and mixtures thereof.

4. Organo-borate compounds, for example alkyl- and aryl- (and mixed alkyl, aryl) substituted borates.
5. Phosphite and phosphate antioxidants, for example alkyl- and aryl- (and mixed alkyl, aryl) substituted phosphites, and alkyl- and aryl- (and mixed alkyl, aryl) substituted dithiophosphates such as O,O,S-trialkyl dithiophosphates, O,O,S-triaryldithiophosphates and dithiophosphates having mixed substitution by alkyl and aryl groups, phosphorothionyl sulfide, phosphorus-containing silane, polyphenylene sulfide, amine salts of phosphinic acid and quinone phosphates.
6. Copper compounds, for example copper dihydrocarbyl thio- or dithiophosphates, copper salts of synthetic or natural carboxylic acids, copper salts of alkenyl carboxylic acids or anhydrides such as succinic acids or anhydrides, copper dithiocarbamates, copper sulphonates, phenates, and acetylacetonates. The copper may be in cuprous ($Cu^{I}$) or cupric ($Cu^{II}$) form.
7. Zinc dithiodiphosphates, for example zinc dialkyldithiophosphates, diphenyldialkyldithiophosphates, and di(alkylphenyl)dithiophosphates.

In one embodiment, the compositions for use in the methods of the present invention, include but are not limited to:

a. a first antioxidant (in the concentration range, from about 0.0001% to about 50%, from about 0.0005% to about 20%, from about 0.005% to about 10%, from about 0.05% to about 5% or from about 0.01% to about 1%) with a first additive selected from the group comprising a surface additive, a performance enhancing additive and a lubricant performance additive, for example, in amounts of from about 0.0005% to about 50%, from about 0.0001% to about 20%, from about 0.005% to about 10%, from about 0.05% to about 5% or from about 0.01% to about 1% by weight, based on the weight of lubricant to be stabilized.

b. the first antioxidant and the first additive as described in a. and a second additive, for example, in concentrations of from about 0.0001% to about 50% by weight, about 0.0005% to about 20% by weight, about 0.001% to about 10% by weight, from about 0.01% to about 5% by weight, from about 0.05% to about 1% by weight from about 0.1% to about 1% by weight based on the overall weight of the lubricant to be stabilized.

c. the first antioxidant and the first additive as described in a. and optionally the second additive as described in b. and a second antioxidant, for example, Irganox® 1010, Irganox® 1330, Irganox® 1076, Irganox® 5057 and Irganox® 1135 in the concentration range, from about 0.0001% to about 50%, from about 0.0005% to about 20%, from about 0.005% to about 10%, from about 0.05% to about 5% or from about 0.01% to about 1%) by weight, based on the weight of lubricant to be stabilized.

The term "alkyl" as used herein means a saturated straight-chain, branched or cyclic hydrocarbon. When straight-chained or branched, an alkyl group is typically C1-C8, more typically C1-C6; when cyclic, an alkyl group is typically C3-C12, more typically C3-C7 alkyl ester. Examples of alkyl groups include methyl, ethyl, n-propyl, iso-propyl, n-butyl, sec-butyl and tert-butyl and 1,1-dimethylhexyl.

The term "alkoxy" as used herein is represented by —OR, wherein R is an alkyl group as defined above.

The term "carbonyl" as used herein is represented by —C(═O)R, wherein R is an alkyl group as defined above.

The term "alkoxycarbonyl" as used herein is represented by —C(═O)OR, wherein R is an alkyl group as defined above.

The term "aromatic group" includes carbocyclic aromatic rings and heteroaryl rings. The term "aromatic group" may be used interchangeably with the terms "aryl", "aryl ring" "aromatic ring", "aryl group" and "aromatic group".

Carbocyclic aromatic ring groups have only carbon ring atoms (typically six to fourteen) and include monocyclic aromatic rings such as phenyl and fused polycyclic aromatic ring systems in which a carbocyclic aromatic ring is fused to one or more aromatic rings (carbocyclic aromatic or heteroaromatic)r. Examples include 1-naphthyl, 2-naphthyl, 1-anthracyl and 2-anthracyl. Also included within the scope of the term "carbocyclic aromatic ring", as it is used herein, is a group in which an aromatic ring is fused to one or more non-aromatic rings (carbocyclic or heterocyclic), such as in an indanyl, phthalimidyl, naphthimidyl, phenanthridinyl, or tetrahydronaphthyl, where the radical or point of attachment is on the aromatic ring.

The term "heteroaryl", "heteroaromatic", "heteroaryl ring", "heteroaryl group" and "heteroaromatic group", used alone or as part of a larger moiety as in "heteroaralkyl" refers to heteroaromatic ring groups having five to fourteen members, including monocyclic heteroaromatic rings and polycyclic aromatic rings in which a monocyclic aromatic ring is fused to one or more other aromatic ring (carbocyclic or heterocyclic). Heteroaryl groups have one or more ring heteroatoms. Examples of heteroaryl groups include 2-furanyl, 3-furanyl, N-imidazolyl, 2-imidazolyl, 4-imidazolyl, 5-imidazolyl, 3-isoxazolyl, 4-isoxazolyl, 5-isoxazolyl, oxadiazolyl, oxadiazolyl, 2-oxazolyl, 4-oxazolyl, 5-oxazolyl, N-pyrazolyl, 3-pyrazolyl, 4-pyrazolyl, 5-pyrazolyl, N-pyrrolyl, 2-pyrrolyl, 3-pyrrolyl, 2-pyridyl, 3-pyridyl, 4-pyridyl, 2-pyrimidinyl, 4-pyrimidinyl, 5-pyrimidinyl, 3-pyridazinyl, 4-pyridazinyl, 2-thiazolyl, 4-thiazolyl, 5-thiazolyl, triazolyl, tetrazolyl, 2-thienyl, 3-thienyl, carbazolyl, benzothienyl, benzofuranyl, indolyl, quinolinyl, benzothiazole, benzooxazole, benzimidazolyl, isoquinolinyl and isoindolyl. Also included within the scope of the term "heteroaryl", as it is used herein, is a group in which an aromatic ring is fused to one or more non-aromatic rings (carbocyclic or heterocyclic), where the radical or point of attachment is on the aromatic ring.

The term non-aromatic heterocyclic group used alone or as part of a larger moiety refers to non-aromatic heterocyclic ring groups having three to fourteen members, including monocyclic heterocylic rings and polycyclic rings in which a monocyclic ring is fused to one or more other non-aromatic carbocyclic or heterocyclic ring or aromatic ring (carbocyclic or heterocyclic). Heterocyclic groups have one or more ring heteroatoms, and can be saturated or unsaturated. Examples of heterocyclic groups include piperidinyl, piperizinyl, pyrrolidinyl, pyrazolidinyl, imidazolidinyl, tetrahydroquinolinyl, inodolinyl, isoindolinyl, tetrahydrofuranyl, oxazolidinyl, thiazolidinyl, dioxolanyl, dithiolanyl, tetrahydropyranyl, dihydropyranyl, azepanyl and azetidinyl The term "heteroatom" means nitrogen, oxygen, or sulfur and includes any oxidized form of nitrogen and sulfur, and the quaternized form of any basic nitrogen. Also the term "nitrogen" includes a substitutable nitrogen of a heteroaryl or non-aromatic heterocyclic group. As an example, in a saturated or partially unsaturated ring having 0-3 heteroatoms selected from oxygen, sulfur or nitrogen, the nitrogen may be N (as in 3,4-dihydro-2H-pyrrolyl), NH (as in pyrrolidinyl) or NR" (as in N-substituted pyrrolidinyl), wherein R" is a suitable substituent for the nitrogen atom in the ring of a non-aromatic nitrogen-containing heterocyclic group, as defined below.

As used herein the term non-aromatic carbocyclic ring as used alone or as part of a larger moiety refers to a non-aromatic carbon containing ring which can be saturated or unsaturated having three to fourteen atoms including monocyclic and polycyclic rings in which the carbocyclic ring can be fused to one or more non-aromatic carbocyclic or heterocyclic rings or one or more aromatic (carbocyclic or heterocyclic) rings An optionally substituted aryl group as defined herein may contain one or more substitutable ring atoms, such as carbon or nitrogen ring atoms. Examples of suitable substituents on a substitutable ring carbon atom of an aryl group include halogen (e.g., —Br, Cl, I and F), —OH, C1-C4 alkyl, C1-C4 haloalkyl, —$NO_2$, C1-C4 alkoxy, C1-C4 haloalkoxy, —CN, —$NH_2$, C1-C4 alkylamino, C1-C4 dialkylamino, —C(O)$NH_2$, —C(O)NH(C1-C4 alkyl), —C(O)(C1-C4 alkyl), —OC(O)(C1-C4 alkyl), —OC(O)(aryl), —OC(O)(substituted aryl), —OC(O)(aralkyl), —OC(O)(substituted aralkyl), —NHC(O)H, —NHC(O)(C1-C4 alkyl), —C(O)N(C1-C4 alkyl)$_2$, —NHC(O)O—(C1-C4 alkyl), —C(O)OH, —C(O)O—(C1-C4 alkyl), —NHC(O)$NH_2$, —NHC(O)NH(C1-C4 alkyl), —NHC(O)N(C1-C4 alkyl)$_2$, —NH—C(═NH)$NH_2$, —$SO_2NH_2$—$SO_2$NH(C1-C3alkyl), —$SO_2$N(C1-C3alkyl)$_2$, NH$SO_2$H, NH$SO_2$(C1-C4 alkyl) and optionally substituted aryl. Preferred substituents on aryl groups are as defined throughout the specification. In certain embodiments aryl groups are unsubstituted.

Examples of suitable substituents on a substitutable ring nitrogen atom of an aryl group include C1-C4 alkyl, $NH_2$, C1-C4 alkylamino, C1-C4 dialkylamino, —C(O)$NH_2$, —C(O)NH(C1-C4 alkyl), —C(O)(C1-C4 alkyl), —$CO_2$R, —C(O)C(O)R, —C(O)$CH_3$, —C(O)OH, —C(O)O—(C1-C4 alkyl), —$SO_2NH_2$—$SO_2$NH(C1-C3alkyl), —$SO_2$N(C1-C3alkyl)$_2$, NH$SO_2$H, NH$SO_2$(C1-C4 alkyl), —C(═S)$NH_2$, —C(═S)NH(C1-C4 alkyl), —C(═S)N(C1-C4 alkyl)$_2$, —C(═NH)—N(H)$_2$, —C(═NH)—NH(C1-C4 alkyl) and —C(═NH)—N(C1-C4 alkyl)$_2$, An optionally substituted alkyl group or non-aromatic carbocyclic or heterocyclic group as defined herein may contain one or more substituents. Examples of suitable substituents for an alkyl group include those listed above for a substitutable carbon of an aryl and the following: ═O, ═S, ═NNHR, ═NN(R)$_2$, ═NNHC(O)R, ═NNH$CO_2$ (alkyl), ═NNH$SO_2$ (alkyl), ═NR, spiro cycloalkyl group or fused cycloalkyl group. R** in each occurrence, independently is —H or C1-C6 alkyl. Preferred substituents on alkyl groups are as defined throughout the specification. In certain embodiments optionally substituted alkyl groups are unsubstituted.

A "spiro cycloalkyl" group is a cycloalkyl group which shares one ring carbon atom with a carbon atom in an alkylene group or alkyl group, wherein the carbon atom being shared in the alkyl group is not a terminal carbon atom.

Without wishing to be bound by any theory or limited to any mechanism it is believed that macromolecular antioxidants and polymeric macromolecular antioxidants of the present invention exploit the differences in activities (ks, equilibrium constant) of, for example, homo- or hetero-type antioxidant moieties. Antioxidant moieties include, for example, hindered phenolic groups, unhindered phenolic groups, aminic groups and thioester groups, etc. of which there can be one or more present in each macromolecular antioxidant molecule. As used herein a homo-type antioxidant macromolecule comprises antioxidant moieties which are all same, for example, hindered phenolic, —OH groups. As used herein a hetero-type antioxidant macromolecule comprises at least one different type of moiety, for example, hindered phenolic and aminic groups in the one macromolecule.

This difference in activities can be the result of, for example, the substitutions on neighboring carbons or the local chemical or physical environment (for example, due to electrochemical or stereochemical factors) which can be due in part to the macromolecular nature of molecules.

In one embodiment of the present invention, a series of macromolecular antioxidant moieties of the present invention with different chemical structures can be represented by W1H, W2H, W3H, . . . to WnH. In one embodiment of the present invention, two types of antioxidant moieties of the present invention can be represented by: W1H and W2H. In certain embodiments W1H and W2H can have rate constants of k1 and k2 respectively. The reactions involving these moieties and peroxyl radicals can be represented as:

$$\text{ROO}\bullet + \text{W1H} \xrightarrow{k1} \text{ROOH} + \text{W1}\bullet \quad (1)$$

$$\text{ROO}\bullet + \text{W2H} \xrightarrow{k2} \text{ROOH} + \text{W2}\bullet \quad (2)$$

where ROO. is a peroxyl radical resulting from, for example, initiation steps involving oxidation activity, for example:

$$\text{RH} \rightarrow \text{R.} + \text{H.} \quad (3)$$

$$\text{R.} + \text{O2} \rightarrow \text{ROO.} \quad (4)$$

In one particular embodiment of the present invention k1>>k2 in equations (1) and (2). As a result, the reactions would take place in such a way that there is a decrease in concentration of W1. free radicals due their participation in the regeneration of active moiety W2H in the molecule according equation (5):

$$\text{W1.} + \text{W2H} \rightarrow \text{W1H} + \text{W2.} \quad (5)\ \text{(transfer equilibrium)}$$

This transfer mechanism may take place either in intra- or inter-molecular macromolecules. The transfer mechanism (5) could take place between moieties residing on the same macromolecule (intra-type) or residing on different macromolecules (inter-type).

In certain embodiments of the present invention, the antioxidant properties described immediately above (equation 5) of the macromolecular antioxidants and polymeric macromolecular antioxidants of the present invention result in advantages including, but not limited to:

a) Consumption of free radicals W1. according to equation (5) can result in a decrease of reactions of W1. with hydroperoxides and hydrocarbons (RH).
b) The regeneration of W1H provides extended protection of materials. This is a generous benefit to sacrificial type of antioxidants that are used today. Regeneration of W1H assists in combating the oxidation process The increase in the concentration of antioxidant moieties W1H (according to equation 5) extends the shelf life of materials.

In certain embodiments of the present invention, the following items are of significant interest for enhanced antioxidant activity in the design of the macromolecular antioxidants and polymeric macromolecular antioxidants of the present invention:

a) The activity of proposed macromolecular antioxidant is dependent on the regeneration of W1H in equation (5)

either through inter- or intra-molecular activities involving homo- or hetero-type antioxidant moieties.

b) Depending on the rates constants of W1H and W2H it is possible to achieve performance enhancements by many multiples and not just incremental improvements.

In certain embodiments of the present invention, more than two types of antioxidant moieties with different rate constants are used in the methods of the present invention.

In certain embodiments, the present invention pertains to the use of the disclosed compositions to improve materials, such as lubricants, lubricant oils, compositions comprising lubricants and lubricant oils and mixtures thereof.

In certain embodiments, as defined herein improving a material means inhibiting oxidation of an oxidizable material.

For purposes of the present invention, a method of "inhibiting oxidation" is a method that inhibits the propagation of a free radical-mediated process. Free radicals can be generated by heat, light, ionizing radiation, metal ions and some proteins and enzymes. Inhibiting oxidation also includes inhibiting reactions caused by the presence of oxygen, ozone or another compound capable of generating these gases or reactive equivalents of these gases.

As used herein the term "oxidizable material" is any material which is subject to oxidation by free-radicals or oxidative reaction caused by the presence of oxygen, ozone or another compound capable of generating these gases or reactive equivalents thereof. In particular the oxidizable material is a lubricant or a mixture of lubricants.

In certain other embodiments, as defined herein improving a material means inhibiting oxidation, as well as improving performance and/or increasing the quality of a material, such as, a lubricant, lubricant oil, composition comprising a lubricant or lubricant oil or mixtures thereof. Increasing the quality of a material includes reducing friction and wear, increasing viscosity, resistance to corrosion, aging or contamination, etc. In certain embodiments, improving means that the lubricant is more resistant to degradation due to the presence of oxygen, temperature, pressure, water, metal species and other contributing factors to degradation. In certain embodiments, additive as described herein help to promote the shelf life of these oils. In certain embodiments the stability of the lubricants is directly related to their performance. That is the lubricant will not perform well if the lubricant has been degraded. In certain embodiments the performance of the lubricants is related to the additives. That is if antioxidant and additives are used they will result in an improvement in the stability and performance of the lubricants.

A lubricant, as defined herein is a substance (usually a liquid) introduced between two moving surfaces to reduce the friction and wear between them. Lubricant can be used in, for example, automotive engines, hydraulic fluids with transmission oils and the like. In addition to automotive and industrial applications, lubricants are used for many other purposes, including bio-medical applications (e.g. lubricants for artificial joints), grease, aviation lubricants, turbine engine lubricants, compressor oils, power transformer oils, automatic transmission fluids, metal working fluids, gear oils, sexual lubricants and others.

Non-liquid lubricants include grease, powders (dry graphite, PTFE, Molybdenum disulfide, etc.), teflon tape used in plumbing, air cushion and others.

The entire teachings of each of the following applications are incorporated herein by reference:

Provisional Patent Application No. 60/632,893, filed Dec. 3, 2004, Title: Process For The Synthesis Of Polyalkylphenol Antioxidants, by Suizhou Yang, et al;

PCT Application No. PCT/US2005/044021, filed Dec. 2, 2005, Title: Process For The Synthesis Of Polyalkylphenol Antioxidants, by Suizhou Yang, et al;

Provisional Patent Application No. 60/633,197, filed Dec. 3, 2004, Title: Synthesis Of Sterically Hindered Phenol Based Macromolecular Antioxidants, by Ashish Dhawan, et al.;

PCT Application No. PCT/US2005/044022, filed Dec. 2, 2005, Title: Synthesis Of Sterically Hindered Phenol Based Macromolecular Antioxidants, by Ashish Dhawan, et al.;

Provisional Patent Application No. 60/633,252, filed Dec. 3, 2004, Title: One Pot Process For Making Polymeric Antioxidants, by Vijayendra Kumar, et al.;

PCT Application No. PCT/US2005/044023, filed Dec. 2, 2005, Title: One Pot Process For Making Polymeric Antioxidants, by Vijayendra Kumar, et al.;

Provisional Patent Application No. 60/633,196, filed Dec. 3, 2004, Title: Synthesis Of Aniline And Phenol-Based Macromonomers And Corresponding Polymers, by Rajesh Kumar, et al.;

PCT Application No. PCT/US2005/044019, filed Dec. 2, 2005, Title: Synthesis Of Aniline And Phenol-Based Macromonomers And Corresponding Polymers, by Rajesh Kumar, et al.;

Patent application Ser. No. 11/184,724, filed Jul. 19, 2005, Title: Anti-Oxidant Macromonomers And Polymers And Methods Of Making And Using The Same, by Ashok L. Cholli;

Patent application Ser. No. 11/184,716, filed Jul. 19, 2005, Title: Anti-Oxidant Macromonomers And Polymers And Methods Of Making And Using The Same, by Ashok L. Cholli;

Provisional Patent Application No. 60/655,169, filed Feb. 22, 2005, Title: Nitrogen And Hindered Phenol Containing Dual Functional Macromolecules: Synthesis And Their Antioxidant Performances In Organic Materials, by Rajesh Kumar, et al.

Provisional Patent Application No. 60/655,638, filed Mar. 25, 2005, Title: Alkylated Macromolecular Antioxidants And Methods Of Making, And Using The Same, by Rajesh Kumar, et al.

Provisional Patent Application No. 60/731,125, filed Oct. 27, 2005, Title: Macromolecular Antioxidants And Polymeric Macromolecular Antioxidants, by Ashok L. Cholli, et al.

Provisional Patent Application No. 60/731,021, filed Oct. 27, 2005, Title: Title: Macromolecular Antioxidants Based On Sterically Hindered Phenols And Phosphites, by Ashok L. Cholli, et al.

Provisional Patent Application No. 60/731,325, filed Oct. 27, 2005, Title: Title: Stabilized Polyolefin Composition, by Kumar, Rajesh, et al.

Patent application Ser. No. 11/040,193, filed Jan. 21, 2005, Title: Post-Coupling Synthetic Approach For Polymeric Antioxidants, by Ashok L. Choll, et al.;

Patent Application No. PCT/US2005/001948, filed Jan. 21, 2005, Title: Post-Coupling Synthetic Approach For Polymeric Antioxidants, by Ashok L. Cholli et al.;

Patent Application No. PCT/US2005/001946, filed Jan. 21, 2005, Title: Polymeric Antioxidants, by Ashok L. Choll, et al.;

Patent Application No. PCT/US03/10782, filed Apr. 4, 2003, Title: Polymeric Antioxidants, by Ashok L. Choll, et al.;

Patent application Ser. No. 10/761,933, filed Jan. 21, 2004, Title: Polymeric Antioxidants, by Ashish Dhawan, et al.;

Patent application Ser. No. 10/408,679, filed Apr. 4, 2003, Title: Polymeric Antioxidants, by Ashok L. Choll, et al.;

Tertiary Butoxy Derivatives of Phenol. (Jan Pospisil and Ludek Taimr). (1964), 2 pp. CS 111291

A New Synthesis of aryl tert-butyl Ethers. Masada, Hiromitsu; Oishi, Yutaka. Fac. Eng., Kanazawa Univ., Kanazawa, Japan. Chemistry Letters (1978), (1), 57-8.

Simple Synthesis of the tert-butyl Ether of Phenol. Ol'dekop, Yu. A.; Maier, N. A.; Erdman, A. A.; Shirokii, V. L.; Zubreichuk, Z. P.; Beresnevich, L. B. Inst. Fiz.-Org. Khim., Minsk, USSR. Zhurnal Obshchei Khimii (1980), 50(2), 475-6.

New Method for the Williamson Ether Synthesis Using tert-alkyl Halides in Nonpolar Solvents. Masada, Hiromitsu; Mikuchi, Fumio; Doi, Yasuo; Hayashi, Akira Dep. Chem. Chem. Eng., Kanazawa Univ., Kanazawa, Japan. Nippon Kagaku Kaishi (1995), (2), 164-6.

New Heterogeneous Williamson Synthesis of Ethers Using tert-alkyl Substrates. Masada, Hiromitsu; Doi, Yasuo; Mikuchi, Fumio; Keiko, Kigoshi. Faculty Eng., Kanazawa Univ., Kanazawa, Japan. Nippon Kagaku Kaishi (1996), (3), 275-82.

Preparation of Aromatic Tertiary Ethers. Tanaka, Masato; Reddy, Nagaveri Prabacal. (Agency of Industrial Sciences and Technology, Japan). Jpn. Kokai Tokkyo Koho (1999), 3 pp. JP 080063.

Preparation of Aromatic Ethers. Watanabe, Makoto; Koie, Yasuyuki. (Tosoh Corp., Japan). Jpn. Kokai Tokkyo Koho (1999), 10 pp. JP 11158103.

o-Alkylated phenols. Firth, Bruce E.; Rosen, Terry J. (UOP Inc., USA). U.S. Pat. No. 4,447,657 (1984), 4 pp.

2-Tert-Butyl-4-alkoxy- and -4-hydroxyphenols. Firth, Bruce E.; Rosen, Terry J. (UOP Inc., USA). U.S. Pat. No. 4,465,871 (1984), 4 pp.

Conversion of Alkyl Phenyl Ether to Alkylphenol. Klicker, James D. (Borg-Warner Corp., USA). U.S. Pat. No. 4,283,572 (1981), 3 pp.

O. N. Tsevktov, K. D. Kovenev, *Int. J. Chem. Eng.* 6 (1966), 328.

Sartori Giovanni, Franca Bigi et al., *Chem. Ind.* (London), 1985 (22) 762-763.

V. A. Koshchii, Ya. B Kozlikovskii, A. A Matyusha, Zh. *Org. Khim.* 24(7), 1988, 1508-1512.

Gokul K. Chandra, M. M. Sharma, *Catal. Lett.* 19(4), 1993, 309-317.

Sakthivel, Ayyamperumal; Saritha, Nellutla; Selvam, Parasuraman, *Catal. Lett.* 72(3), 2001, 225-228.

V. Quaschning, J. Deutsch, P. Druska, H. J. Niclas and E. Kemnitz. *J. Catal.* 177 (1998), p. 164.

S. K. Badamali, S. Sakthivel and P. Selvam. *Catal. Today* 63 (2000), p. 291.

A. Heidekum, M. A. Hamm and F. Hoelderich. *J. Catal.* 188 (1999), p. 230.

Y. Kamitori, M. Hojo, R. Matsuda, T. Izumi and S. Tsukamoto. *J. Org. Chem.* 49 (1984), p. 4165.

E. Armengol, A. Corma, H. Garcia and J. Primo. *Appl. Catal. A* 149 (1997), p. 411.

J. M. Lalancette, M. J. Fournier and R. Thiffault. *Can. J. Chem.* 52 (1974), p. 589.

Japanese Patent No. JP 145002980, 1970.

Japanese Patent No. 44028850, 1969.

Japanese Patent No. 44024274, 1969.

EXEMPLIFICATION

Example 1

A commercial lubricant oil (example Castrol GTX 5W30) which comprises additives, was added to a known amount of a first antioxidant as described above.

The commercial lubricant oil alone was tested versus the commercial lubricant oil with the added antioxidant, using Passenger Car Motor Oil (PMCO) TEOST MHT test (ASTM D78097-05 test) performed at SWRI, Antonio Tex.

Test conditions include 285° C. for 24 hours, airflow, the deposit on the rod was then tested.

The deposit on the metal strip for the control sample was 46 mg, while for the sample containing the antioxidant was 18 mg. The difference of 28.1 mg was due to 1% of the antioxidant. The smaller deposit on the metal strip indicates the superior performance of the lubricant oil in combination with an antioxidant While this invention has been particularly shown and described with references to preferred embodiments thereof, it will be understood by those skilled in the art that various changes in form and details may be made therein without departing from the scope of the invention encompassed by the appended claims.

What is claimed is:

1. A lubricant composition, consisting essentially of:

a) a lubricant or a mixture of lubricants;

b) an antioxidant component include a first antioxidant represented by the following structural formula:

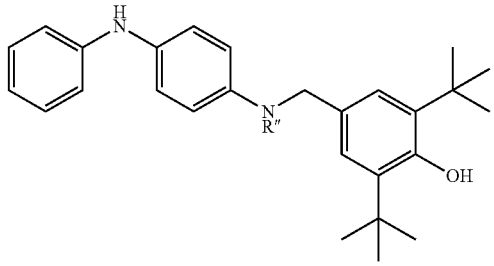

wherein R" is a C1-C10 alkyl; and c) at least one first additive selected from the group consisting of:

i) a surface additive;

ii) a performance enhancing additive; and iii) a lubricant protective additive;

wherein the concentration of the first antioxidant is between about 0.05% to about 5% by weight of the lubricant composition and the concentration of the first additive is between about 0.05% and about 5% by weight of the lubricant composition.

2. The lubricant composition of claim 1, wherein the first additive is a surface additive selected from the group consisting of (a) rust inhibitors, (b) corrosion inhibitors, (c) extreme pressure agents, (d) tackiness agents, (e) antiwear agents, (f) detergents and dispersants and (g) compounded oil.

3. The lubricant composition of claim 1, wherein the first additive is a performance enhancing additive selected from the group consisting of (a) pour-point depressants, (b) viscosity index modifiers, (c) emulsifiers, and (d) demulsifiers.

4. The lubricant composition of claim 1, wherein the first additive is a lubricant protective additive selected from the group consisting of (a) oxidation inhibitors and (b) foam inhibitors.

5. The lubricant composition of claim 1, wherein the composition further includes a second antioxidant selected from the group consisting of: amine antioxidants, phenolic antioxidants, sulfurized organic compounds, organo-borate compounds, phosphite and phosphate antioxidants, copper compounds and zinc dithiodiphosphates.

6. The lubricant composition of claim 1, wherein the lubricant is selected from the group consisting of petroleum based oils, synthetic oils and biolubricant oils.

7. A method of forming a lubricant composition, comprising the step of combining a lubricant or mixture of lubricants to form a lubricant composition consisting essentially of:

a) an antioxidant component including a first antioxidant represented by the following structural formula:

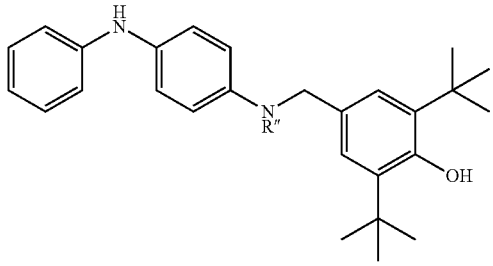

wherein R" is a C1-C10 alkyl; and b) at least one first additive selected from the group consisting of:

i) a surface additive;

ii) a performance enhancing additive; and iii) a lubricant protective additive, to thereby form a lubricant composition, wherein the concentration of the first antioxidant is between about 0.05% to about 5% by weight of the lubricant composition and the concentration of the first additive is between about 0.05% and about 5% by weight of the lubricant composition.

8. The method of claim 7, wherein the first additive is a surface additive selected from the group consisting of (a) rust inhibitors, (b) corrosion inhibitors, (c) extreme pressure agents, (d) tackiness agents, (e) antiwear agents, (f) detergents and dispersants and (g) compounded oil.

9. The method of claim 7, wherein the first additive is a performance enhancing additive selected from the group consisting of (a) pour-point depressants, (b) viscosity index modifiers, (c) emulsifiers, and (d) demulsifiers.

10. The method of claim 7, wherein the additive is a lubricant protective additive selected from the group consisting of (a) oxidation inhibitors and (b) foam inhibitors.

11. The method of claim 7, wherein the composition further includes a second antioxidant selected from the group consisting of: amine antioxidants, phenolic antioxidants, sulfurized organic compounds, organo-borate compounds, phosphite and phosphate antioxidants, copper compounds and zinc dithiodiphosphates.

12. The method of claim 7, wherein the lubricant is selected from the group consisting of petroleum based oils, synthetic oils and biolubricant oils.

* * * * *